US006972651B2

(12) United States Patent
Aoki et al.

(10) Patent No.: US 6,972,651 B2
(45) Date of Patent: Dec. 6, 2005

(54) SWITCH OPERABLE UNDER A PREDETERMINED CONDITION, EXTERNAL MAGNETIC FIELD GENERATING UNIT, COMBINATION OF SUCH A SWITCH AND AN EXTERNAL MAGNETIC FIELD GENERATING UNIT AND ELECTRONIC APPARATUS INCORPORATING THE SAME

(75) Inventors: Shigemitsu Aoki, Shinagawa (JP); Nobuyoshi Shimizu, Shinagawa (JP); Hirofumi Saso, Shinagawa (JP); Yoshio Okamoto, Shinagawa (JP); Chiaki Maeno, Shinagawa (JP); Noboru Fujii, Shinagawa (JP); Yasushi Saito, Shinagawa (JP)

(73) Assignee: Takamisawa Electric Co., LTD, Tokyo (JP)

( * ) Notice: Subject to any disclaimer, the term of this patent is extended or adjusted under 35 U.S.C. 154(b) by 246 days.

(21) Appl. No.: 10/087,849

(22) Filed: Mar. 5, 2002

(65) Prior Publication Data

US 2002/0130740 A1 Sep. 19, 2002

(30) Foreign Application Priority Data

| | | |
|---|---|---|
| Mar. 13, 2001 | (JP) | 2001-070765 |
| Jul. 24, 2001 | (JP) | 2001-223082 |
| Nov. 9, 2001 | (JP) | 2001-344703 |

(51) Int. Cl.[7] ..... H01H 9/00

(52) U.S. Cl. ..... 335/207; 335/154

(58) Field of Search ..... 335/78–86, 151–154, 335/205–207

(56) References Cited

U.S. PATENT DOCUMENTS

| | | | | |
|---|---|---|---|---|
| 3,218,406 | A | 11/1965 | Gomperts et al. | |
| 3,575,678 | A | 4/1971 | Barton | |
| 3,678,424 | A * | 7/1972 | Iwashima et al. | 335/206 |
| 3,716,810 | A * | 2/1973 | Hara et al. | 335/154 |
| 3,952,271 | A | 4/1976 | Smirnov et al. | |
| 4,091,346 | A | 5/1978 | Nishimura et al. | |
| 4,284,904 | A | 8/1981 | Tetro | |
| 5,233,323 | A * | 8/1993 | Burkett et al. | 335/207 |
| 5,239,202 | A | 8/1993 | Hostetler | |
| 5,293,523 | A * | 3/1994 | Posey | 335/205 |
| 5,633,626 | A | 5/1997 | Cawthorne | |
| 5,668,533 | A | 9/1997 | Jackson, Jr. et al. | |
| 6,014,008 | A | 1/2000 | Hartzell et al. | |
| 6,025,768 | A | 2/2000 | Martich | |
| 6,348,861 | B1 | 2/2002 | Li | |

FOREIGN PATENT DOCUMENTS

| | | |
|---|---|---|
| DE | 100 48 880 | 4/2002 |
| EP | 0 304 185 | 2/1989 |
| JP | 5-8483 | 2/1993 |
| JP | 5-70164 | 9/1993 |
| JP | 6-215744 | 8/1994 |
| JP | 7-122168 | 5/1995 |
| JP | 8-83627 | 3/1996 |

(Continued)

*Primary Examiner*—Lincoln Donovan
(74) *Attorney, Agent, or Firm*—Staas & Halsey LLP

(57) ABSTRACT

A switch operable under a predetermined condition includes a plurality of switch parts each including a pair of reed pieces and a connecting member of an electrically conductive non-magnetic material via which the plurality of switch parts are serially connected. The switch operates only under a condition where all of the plurality of switch parts are operated by external magnetic fields individually and simultaneously acting on the plurality of switch parts.

8 Claims, 38 Drawing Sheets

FOREIGN PATENT DOCUMENTS

| | | |
|---|---|---|
| JP | 8-339752 | 12/1996 |
| JP | 9-7478 | 1/1997 |
| JP | 9-212757 | 8/1997 |
| JP | 10-12109 | 1/1998 |
| JP | 11-8942 | 1/1999 |
| JP | 11-232975 | 8/1999 |
| JP | 2000-40452 | 2/2000 |
| JP | 2000-235828 | 8/2000 |

* cited by examiner

SWITCH OPERABLE UNDER A PREDETERMINED CONDITION, EXTERNAL MAGNETIC FIELD GENERATING UNIT, COMBINATION OF SUCH A SWITCH AND AN EXTERNAL MAGNETIC FIELD GENERATING UNIT AND ELECTRONIC APPARATUS INCORPORATING THE SAME

BACKGROUND OF THE INVENTION

1. Field of the Invention

The present invention relates to a switch operable under a predetermined condition, an external magnetic field generating unit, a combination of such a switch and an external magnetic field generating unit and an electronic apparatus incorporating the same and particularly relates to a switch operable under a predetermined condition that can recognize a predetermined external magnetic field acting thereon and does not operate under a normal external magnetic field but under such a predetermined external magnetic field.

2. Description of the Related Art

Many electric apparatuses have a structure including a main body and an attachment to be loaded therein. There are cases where such electric apparatuses require means for recognizing whether the attachment has been properly loaded in the main body. A switch may be used as one of the means for recognizing whether the attachment has been properly loaded in the main body. A switch that can be used for such an object is a switch operable under a predetermined condition. With such a switch being incorporated in the attachment to be loaded in the main body, the attachment should never operate when handled alone but should operate when properly loaded in the main body of an apparatus.

FIG. 1 is a diagram showing a switch 10 including a pair of reed pieces 11 and 12. When an external magnetic field generated by a permanent magnet 13 acts on the reed pieces 11 and 12, a magnetic attractive force is produced between the reed pieces 11 and 12. Accordingly, the reed pieces 11 and 12 will come into contact with each other and take a closed state indicated by double-dotted lines in FIG. 1.

In the case of the switch 10, there may be more than one pattern of magnetic fields that cause the reed pieces 11 and 12 to come in contact with each other. In other words, even with an external magnetic field of a normal pattern, the reed pieces 11 and 12 will come in contact with each other. For example, the reed pieces 11 and 12 will also come into contact with each other in case where an N-pole and an S-pole of the permanent magnet 13 are placed in an opposite manner to a state shown in FIG. 1. Therefore, there is a problem in using the above-described switch 10 as a switch operable under a predetermined condition.

SUMMARY OF THE INVENTION

Accordingly, it is a general object of the present invention to provide a switch operable under a predetermined condition that can obviate the problems described above.

It is another and more specific object of the present invention to provide a switch operable under a predetermined condition that operates only under a specific condition of an external magnetic field acting thereon.

In order to provide a switch operable under a predetermined condition, a switch is provided, according to the present invention, which includes;

a plurality of switch parts each including a pair of reed pieces; and a connecting member of an electrically conductive non-magnetic material via which the plurality of switch parts are serially connected, wherein the switch operates only under a condition where all of the plurality of switch parts are operated by external magnetic fields individually and simultaneously acting on the plurality of switch parts.

Also, an external magnetic field generating unit is provided for applying a magnetic field to each of a plurality of switch parts of a switch in which first and second switch parts each including a pair of reed pieces are serially connected via a connecting member made of an electrically conductive non-magnetic material. The external magnetic field generating unit includes:

a first magnet generating a magnetic field applied to said first switch part; and a second magnet generating a magnetic field applied to said second switch part.

Orientations of magnetic poles of said first and second magnets are aligned in a direction perpendicular to a longitudinal direction of said reed pieces.

According to the present invention, there is also provided a switch operable under a predetermined condition including:

a switch part including a pair of reed pieces; and a yoke-magnet assembly generating a magnetic field that produces a magnetic pole at a tip of one of the pair of reed pieces such that the tip is magnetically attracted towards the yoke-magnet assembly and separated away from the other one of the pair of reed pieces, the yoke-magnet assembly being provided at a position opposing the switch part, wherein the switch operates only under a condition where the reed pieces of the switch part come into contact with each other by an external magnetic field producing an opposite magnetic pole at the tip.

An external magnetic field generating unit, a switch device operable under a predetermined condition and an electronic apparatus that can achieve the objects describe above are also provided according to the present invention.

DETAILED DESCRIPTION OF THE PREFERRED EMBODIMENTS

In the following, principles and embodiments of the present invention will be described with reference to the accompanying drawings.

Figure 1:
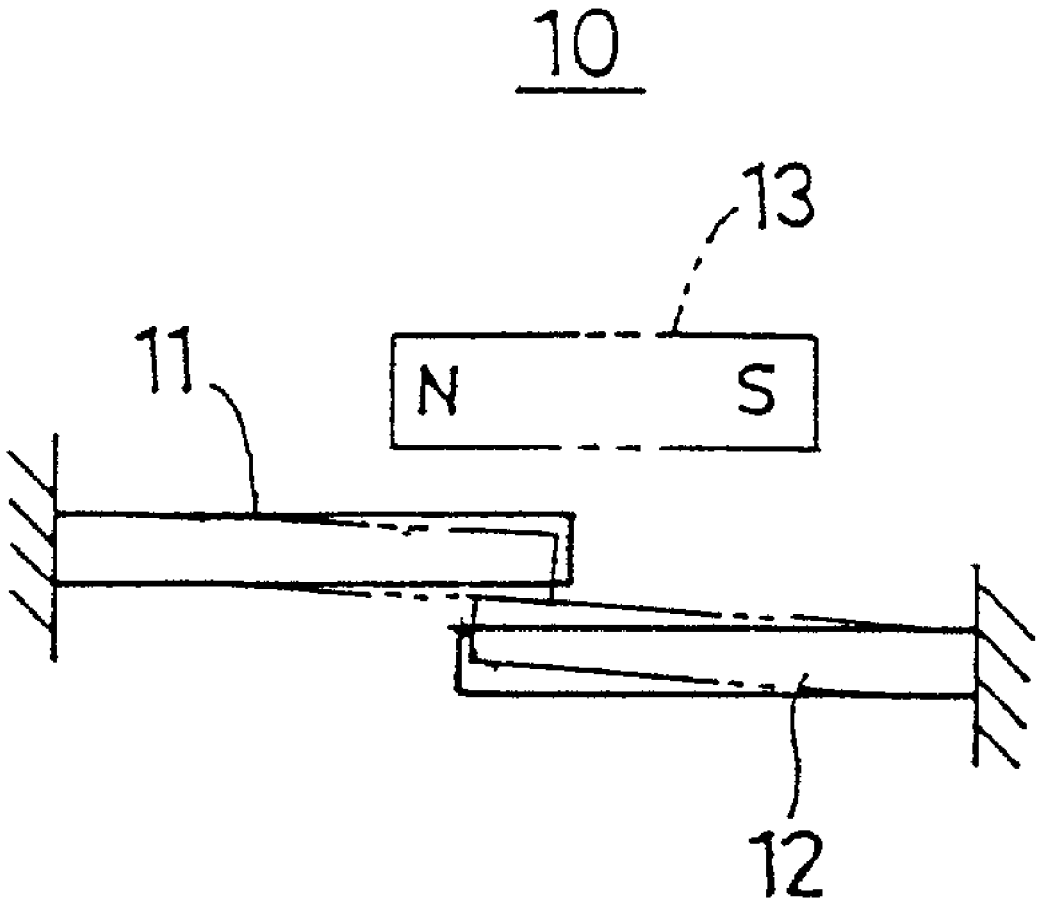
FIG. 1 PRIOR ART
FIG. 1 is a diagram of a switch of the related art in which reed pieces are used.
Figure 2:
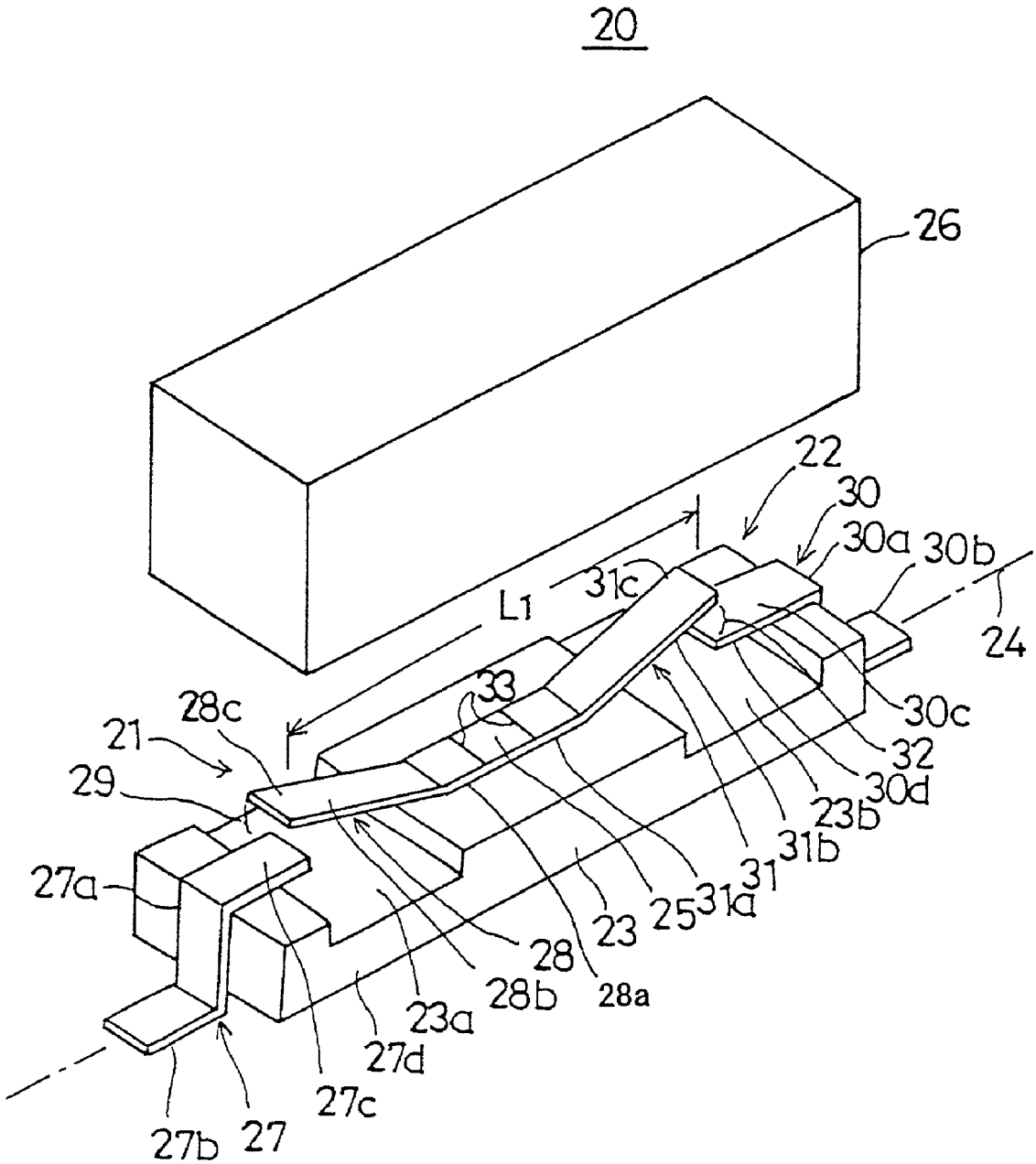
FIG. 2 is an exploded perspective diagram of a switch of a first embodiment of the present invention.
Figure 3:
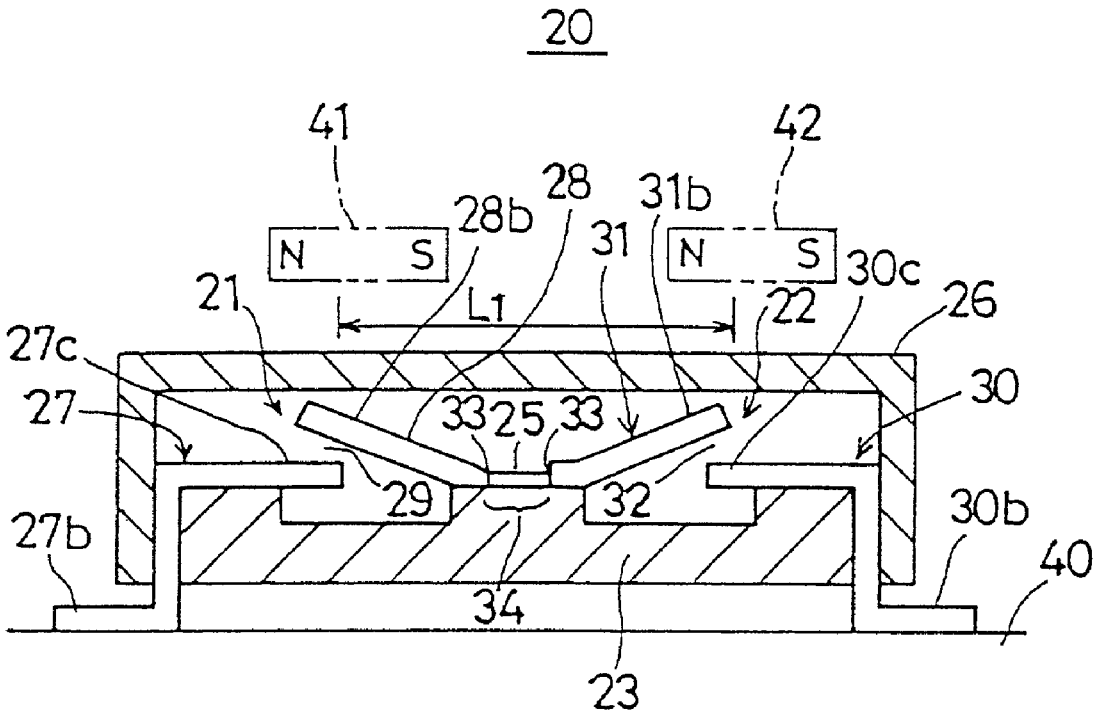
FIG. 3 is a cross-sectional diagram of the switch of the first embodiment of the present invention.
Figure 4A:
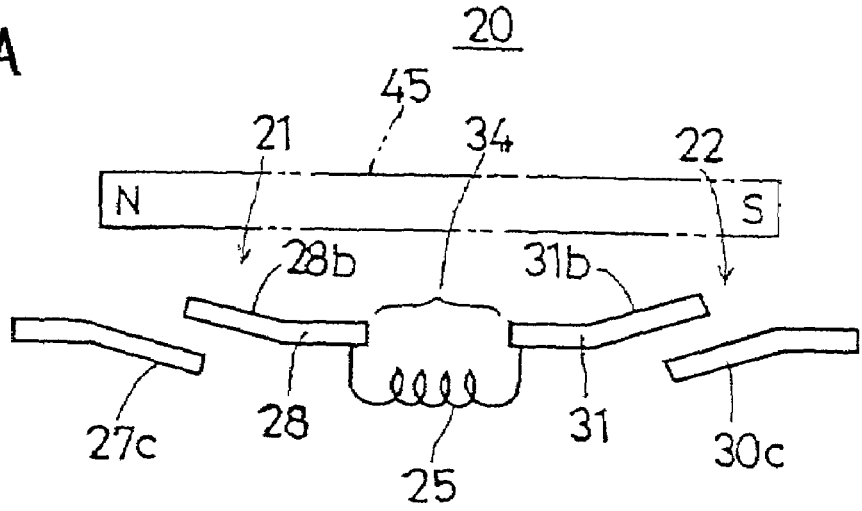
FIGS. 4A and 4B are schematic diagrams showing the switch of the first embodiment of the present invention.
Figure 4B:
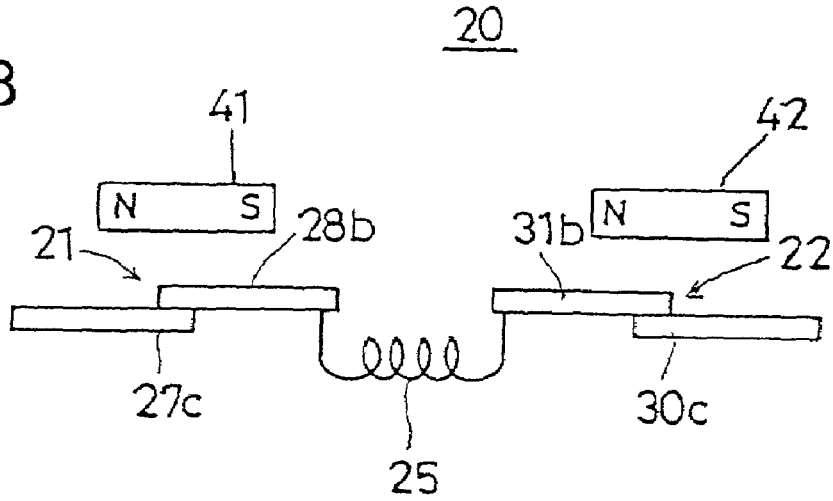

FIGS. 2 and 3 are diagrams showing a switch 20 operable under a predetermined condition of a first embodiment of the present invention. FIGS. 4A and 4B are schematic diagrams showing a structure of the switch 20. The switch 20 of the present embodiment and switches of other embodiments are all based on reed switches and are types of proximity switches.

As shown in FIGS. 2, 3 and 4A, the switch 20 includes a base 23, a first switch part 21 and a second switch part 22. The first and second switch parts 21 and 22 are supported by the base 23 and are aligned on a straight line 24. The first and second switch parts 22 and 23 are separated by a dimension along the straight line 24 and are connected in series via a connecting member 25 that is electrically conductive and non-magnetic. All elements of the switch 20 are covered with a cover 26 except for terminal parts 27*b* and 30*b* provided on either end of the switch 20. The terminal parts 27*b* and 30*b* are provided for mounting the switch 20 on a printed-circuit board (hereinafter referred to as a PCB). The switch 20 of the present embodiment operates only under a condition where two magnets are placed proximate the switch 20.

It is not necessary that the first and second switch parts 21 and 22 are aligned on a straight line as long as they are electrically connected in series. In the present invention, magnets may be of any type such as permanent magnets and electromagnets.

The base 23 and the cover 26 are electrically insulating. The base 23 has an elongated shape and is provided with recessed parts 23*a* and 23*b* near either end thereof.

The first switch part 21 includes a reed piece 27 having a crank shape and a reed piece 28 having a substantially linear shape. The reed piece 27 includes a bent part 27*a* attached to the base 23, a terminal part 27*b* protruding outwardly from the base 23 and a reed part 27*c* protruding over the recessed part 23*a*. The reed piece 28 includes a base part 28*a* attached to the base 23 and a reed part 28*b* that protrudes over the recessed part 23*a* and above the reed part 27*c*. A gap 29 exists between a contact part 27*d* at the tip of the reed part 27*c* and a contact part 28*c* at the tip of the reed part 28*b*.

The second switch part 22 has a structure symmetrical to the first switch part 21 with respect to the connecting member 25 and includes a reed piece 30 having a crank shape and a reed piece 31 having a substantially linear shape. The second switch part 22 has a terminal part 31*b* and a gap 32 exists between a contact part 30*d* of the reed piece 30 and a contact part 31*c* of the reed piece 31.

The above-mentioned reed pieces 27, 28, 30 and 31 are made of Permalloy and the contact parts 27*d*, 28*c*, 30*d* and 31*d* are gold-plated. Such a structure of the reed pieces applies to all embodiments described below.

The connecting member 25 may be a copper piece. As indicated by lines labeled a reference numeral 33, the connecting member 25 may be laser welded to the base part 28*a* of the reed piece 28 and to the base part 31*a* of the reed piece 31, respectively. Since copper has a low electric resistance and is non-magnetic, the magnetic resistance of the connecting member 25 is considerably higher than that of the reed pieces 28 and 31. Therefore, a magnetic gap 34 exists between the reed pieces 28 and 31. It is to be noted that, instead of copper, the connecting member 25 may be made of a non-magnetic metal such as aluminum or a material such as carbon.

The switch 20 is mounted on a PCB 40 with its terminal parts 27*b* and 31*b* being soldered on the terminal part of the PCB 40. The switch 20 may be incorporated in a circuit such as a power supply circuit.

In the following, an operation of the above-mentioned switch 20 will be described.

In a normal state, the switch 20 is in an OFF state shown in FIGS. 2, 3, and 4A in which the first and second switch parts 21 and 22 are both open. Therefore, there is no electrically conducting state between the terminal parts 27*b* and 31*b*.

The switch 20 only operates under a condition where a first magnet 41 approaches the first switch part 21 and also a second magnet 42 approaches the second switch part 22 as shown by double-dotted lines in FIG. 3 and solid lines in FIG. 4B. In other words, the switch 20 only operates under a condition where external magnetic fields act on the first and second switch parts 21 and 22 simultaneously such that an electrically conducting state is established between the terminal parts 27*b* and 31*b*.

In detail, when the first magnet 41 approaches the first switch part 21, a magnetic field generated by the first magnet 41 acts on the first switch part 21. Then, mutually different magnetic polarities appear at the contact parts 27*d* and 28*c* and a magnetic attractive force is produced between the contact parts 27*d* and 28*c*. The first switch part 21 is operated by the magnetic attractive force in such manner that the reed part 28*b* is flexed and the contact parts 27*d* and 28*c* come into contact with each other.

Similarly, when the second magnet 42 approaches the second switch part 22, a magnetic field generated by the second magnet 42 acts on the second switch part 22. Then, mutually different magnetic polarities appear at the contact parts 30*c* and 31*b* and a magnetic attractive force is produced between the contact parts 30*c* and 31*b*. The second switch part 22 is operated by the generated magnetic attractive force in such manner that the reed part 31*b* is flexed and the contact parts 30*c* and 31*b* come into contact with each other.

Accordingly, the switch 20 is switched to an ON state and there is an electrically conducting state between terminal parts 27*b* and 31*b*.

When the first and second magnets 41 and 42 are moved away from the switch 20, the first and second switch parts 21 and 22 are opened and thus the switch 20 is switched to an OFF state.

Now, a case illustrated in FIG. 4A is considered. As indicated by a double-dotted line in FIG. 4A, a magnet 45 having a large size covering both the first and second switches 21 and 22 approaches the first and second switch parts 21 and 22. A magnetic field generated by the magnet 45 acts on the first and second switch parts 21 and 22. However, since a magnetic gap 34 exists between the reed pieces 28 and 31, no magnetic flux flows in the reed pieces 27, 28, 31 and 30. Therefore, no magnetic poles appear at the tips of the reed pieces 27, 28, 31 and 30 and the switch parts 21 and 22 remain open. This also applies for a case with the magnet 45 having a greater magnetic strength and the switch parts 21 and 22 remains open. Therefore, even if the magnet 45 having an increased size and magnetic strength approaches the switch parts 21 and 22, the switch 20 is not operated and remains in an OFF state.

When a single magnet approaches the first switch part 21, the first switch part 21 closes but the second switch part 22 remains open and thus the switch 20 remains in an OFF state. When a single magnet approaches the second switch part 22, in a similar manner to the above case, the second switch part 22 closes but the first switch part 21 remains open and the switch 20 remains in an OFF state.

Therefore, the switch 20 operates only under a condition where the first and second switch parts 21 and 22 are simultaneously brought proximate to the magnets 41 and 42 as shown in FIGS. 3 and 4B. In other words, the operational condition of the switch 20 is restricted to a case where an external magnetic field acts on the first switch part 21 and, simultaneously, another external magnetic field acts on the second switch part 22. That is to say, the switch 20 operates only under a condition where external magnetic forces act on the first and second switch parts 21 and 22 individually and simultaneously.

It is to be noted that the above-mentioned operational condition rarely occurs in a normal state and thus the switch 20 does not switch to an ON state in an unintentional manner.

Accordingly, the switch 20 is switched to an ON state when magnets approach positions corresponding to locations of the first and second switch parts 21 and 22. In other words, the switch 20 has a function of recognizing the positions of the magnets and a function of verifying the positions of the magnets. Therefore, the switch 20 has an advantageous effect when used for applications requiring a secure operation.

Further, the switch 20 may be configured such that more than two switch parts are aligned in a series.

Figure 5:
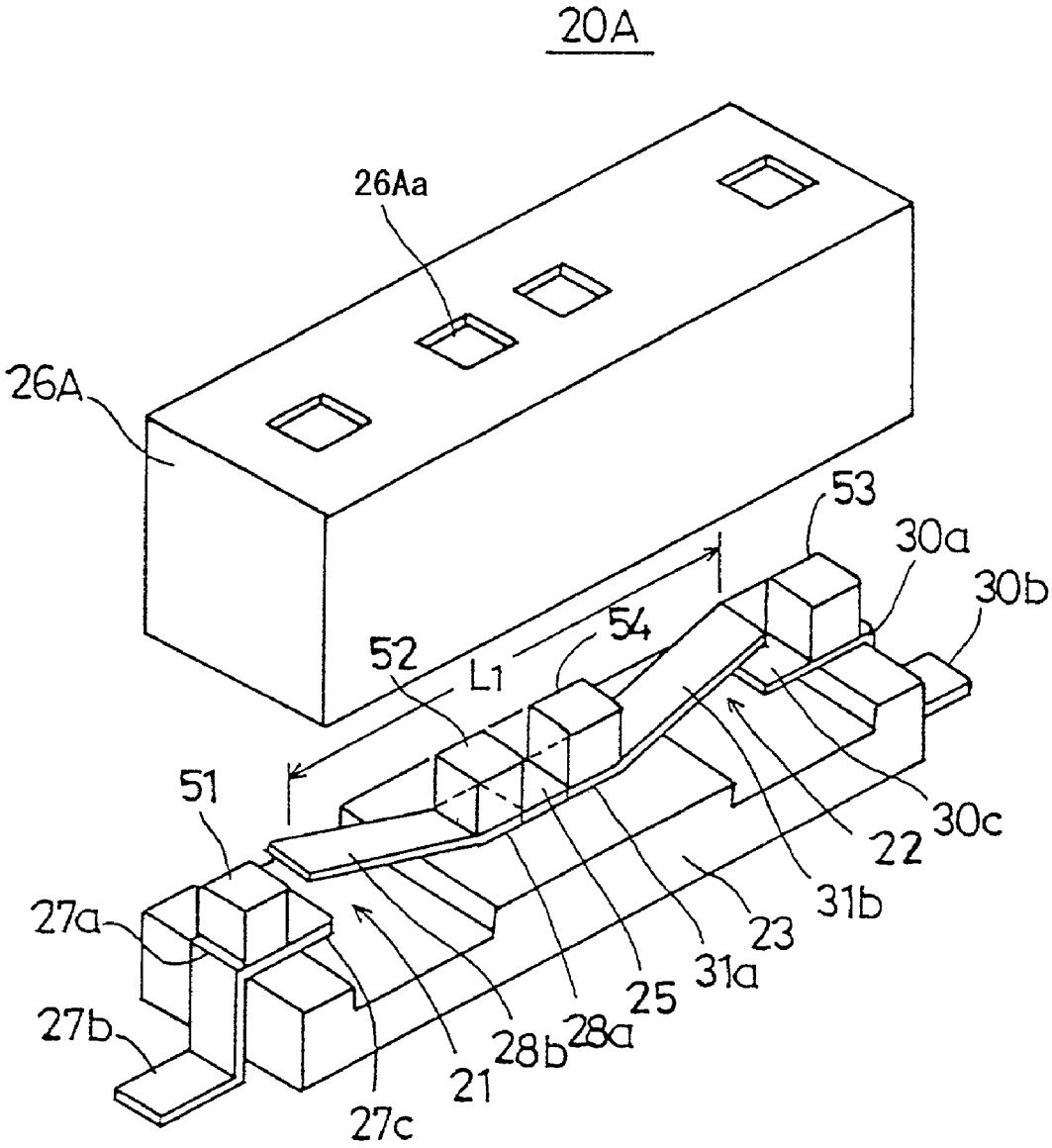
FIG. 5 is an exploded perspective diagram of a switch of a second embodiment of the present invention.
Figure 6:
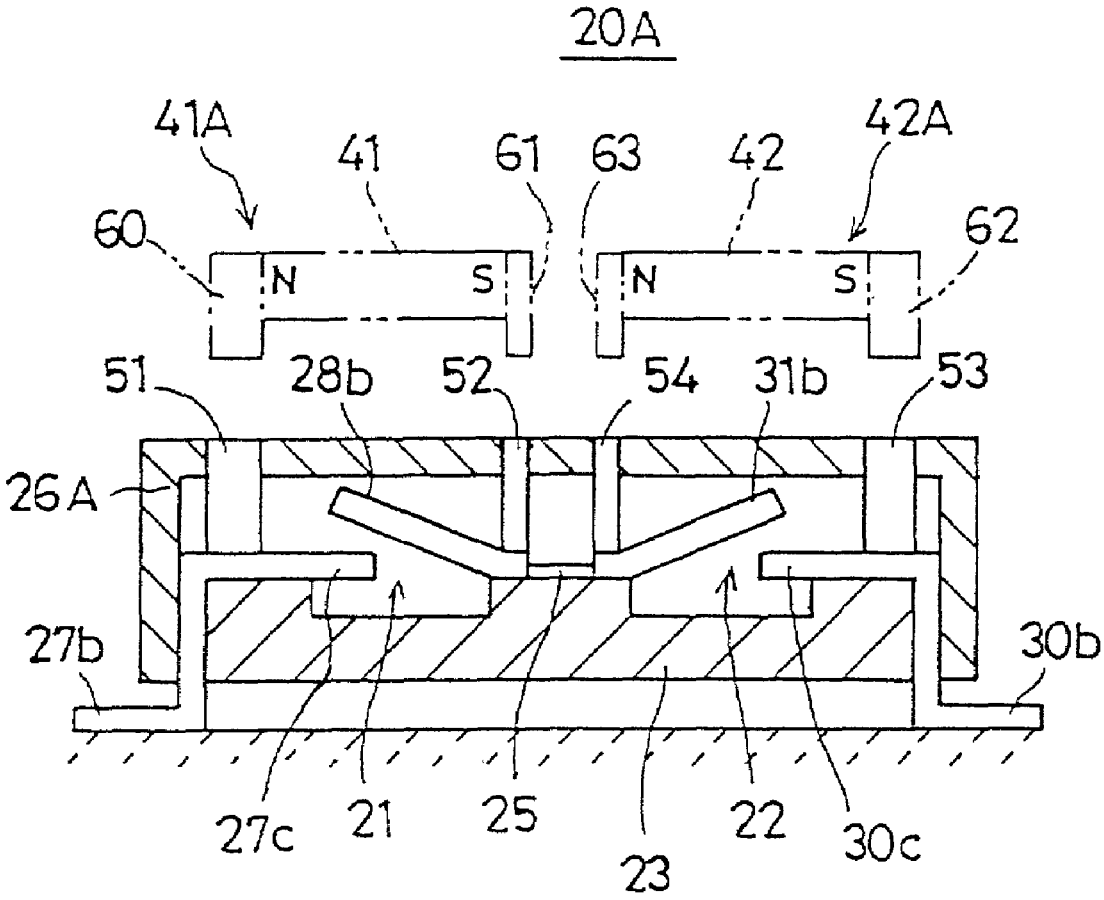
FIG. 6 is a cross-sectional diagram of the switch of the second embodiment of the present invention.
Figure 7A:
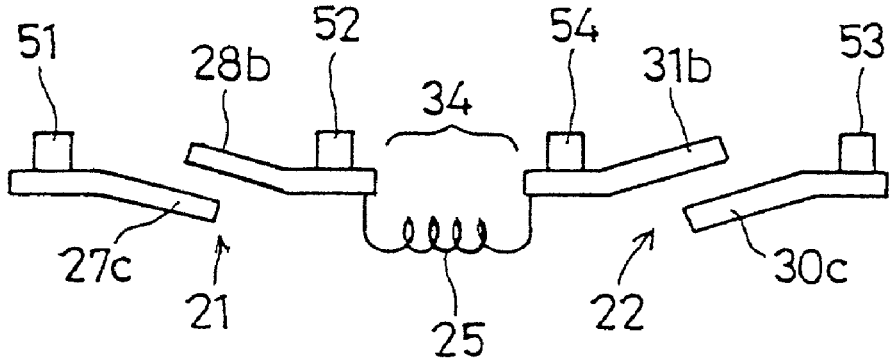
FIGS. 7A and 7B are schematic diagrams showing the switch of the second embodiment of the present invention.
Figure 7B:
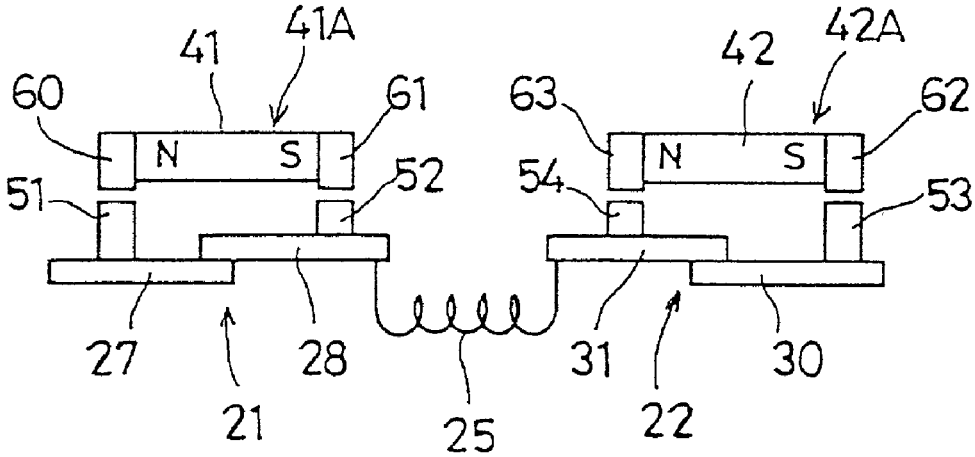

FIGS. 5 and 6 are diagrams showing a switch 20A operable under a predetermined condition of a second embodiment of the present invention. FIGS. 7A and 7B are schematic diagrams showing a structure of the switch 20A.

The switch 20A is similar to the switch 20 shown in FIGS. 2 through 4 except that pole pieces 51 through 54 are additionally provided as access parts for magnetic fluxes. In FIGS. 5, 6, 7A and 7B, elements corresponding to elements shown in FIGS. 2, 3, and 4 are indicated by the same reference numerals and detailed description is omitted. The operational condition of the switch 20A is restricted to a case where there are two magnets and that positions and sizes of the two magnets are predetermined.

The pole pieces 51, 52, 53 and 54 are attached to the bent part 27*a* of the reed piece 27, the base part 28*a* of the reed piece 28, the bent part 30*a* of the reed piece 30 and the base part 31*a* of the reed piece 31, respectively.

The cover 26A is provided with openings 26Aa at positions corresponding to the pole pieces 51 through 54. The pole pieces 51 through 54 are exposed from the openings 26Aa. The cover 26A is made of a non-magnetic material. The pole pieces 51 through 54 are attached to elements such as the reed pieces 27 and 28 at locations where no deformations occur when the switch parts are operated. Therefore, although the pole pieces 51 through 54 are attached to the cover 26A, the pole pieces 51 through 54 will not affect the operations of the switch parts 21 and 22.

In order to produce external magnetic fields acting on the switch 20A, a first magnet assembly 41A and a second magnet assembly 42A are prepared. The first magnet assembly 41A includes pole pieces 60 and 61 provided on either end of the magnet 41. The second magnet assembly 42A includes pole pieces 62 and 63 provided on either end of the magnet 42. The pole pieces 60 and 61 are provided at positions corresponding to the pole pieces 51 and 52, respectively. The pole pieces 62 and 63 are provided at positions corresponding to the pole pieces 53 and 54, respectively.

When the first and second magnet assemblies 41 and 42 simultaneously approach the first and second switch parts 21 and 22, respectively, and the pole pieces 60 through 63 accurately oppose the pole pieces 51 through 54, respectively, the first and second switch parts 21 and 22 are simultaneously operated and are closed. Accordingly, the switch 20A is switched to an ON state.

The operational condition of the switch 20A is similar to that of the switch 20 shown in FIGS. 2 and 3 except that, further to a condition where two magnets are required, the pole pieces 60 through 63 should accurately oppose the pole pieces 51 through 54, respectively.

Also, since the pole pieces 51 through 54 are exposed from the cover 26A, the switch 20A efficiently picks up magnetic flux from an external environment. Therefore, the switch 20A has a higher sensitivity than the above-mentioned switch 20, and therefore, the switch 20A can operate with the magnets 41 and 42 having weaker magnetic strength.

Further, since the exposed magnetic pieces 51 through 54 efficiently pick up magnetic flux from an external environment, the thickness of the reed pieces 28 and 31 can be increased to prevent them from being flexed. With such a structure, the switch 20A can be prevented from being erroneously switched to an ON state in case where external magnetic flux acts as noise. Therefore, the switch 20A has a noise-resistant property.

Figure 8:
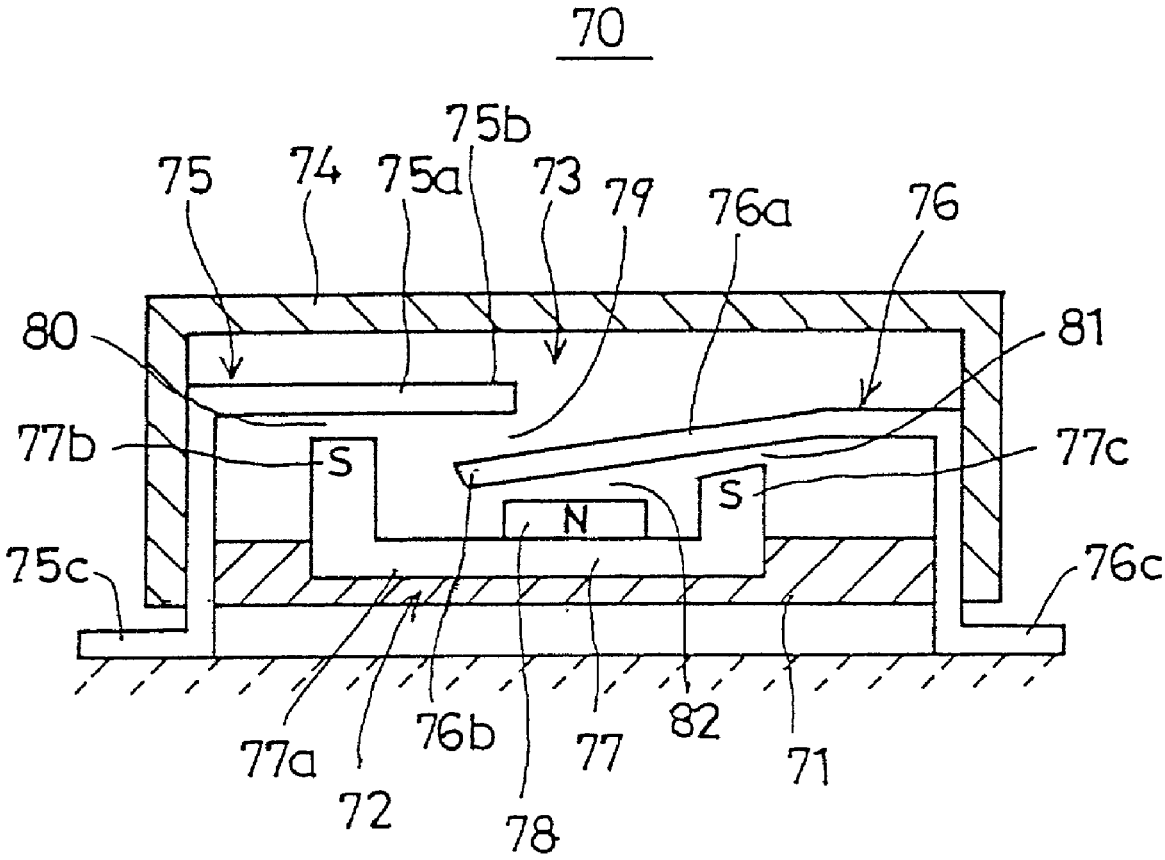
FIG. 8 is a cross-sectional diagram of a switch of a third embodiment of the present invention.
Figure 9A:
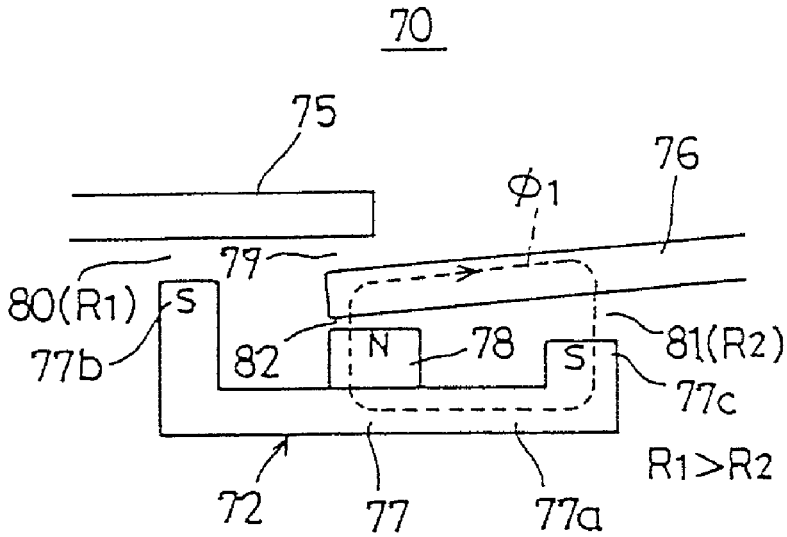
FIGS. 9A through 9C are schematic diagrams showing the switch of the third embodiment of the present invention.
Figure 9B:
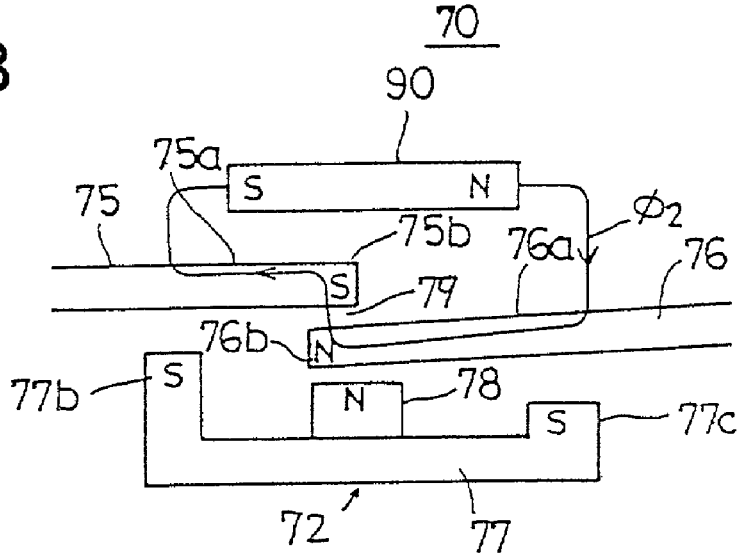
Figure 9C:
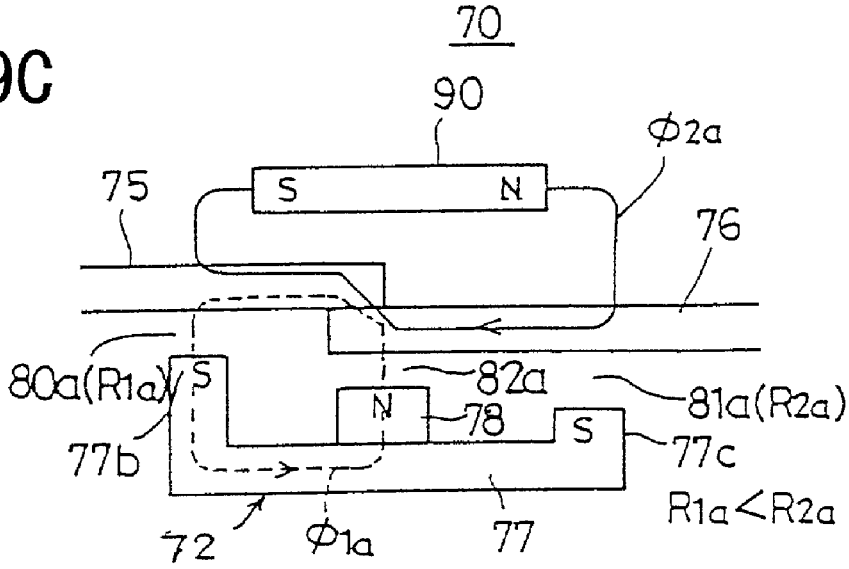

FIG. 8 is a diagram showing a switch 70 operable under a predetermined condition of a third embodiment of the present invention. FIGS. 9A through 9C are schematic diagrams showing a structure of the switch 70.

The switch 70 operates only under a condition where there is one magnet with magnetic poles being in a particular orientation.

As shown in FIGS. 8 and 9A, the switch 70 includes a base 71, a yoke-magnet assembly 72 and a switch part 73. The yoke-magnet assembly 72 and the switch part 73 are supported by the base 71. All the elements of the switch 70 are covered with a cover 74 except for terminal parts 75*c* and 76*c* provided at both ends of the switch 70 for mounting the switch 70 on a PCB.

The switch part 73 includes a reed piece 75 having a crank shape and a reed piece 76 also having a crank shape. Bent parts of the reed pieces 75 and 76 are attached to the base 71. A gap 79 exists between a contact part 75*b* at the tip of a horizontal reed part 75*a* and a contact part 76*b* at the tip of the reed part 76*a* that is placed under the contact part 75*b*. The terminal parts 75*c* and 76*c* protrude outwardly from the base 71.

The yoke-magnet assembly 72 includes a yoke member 77 and a magnet piece 78. The yoke member 77 includes an elongated main body part 77*a* and raised parts 77*b* and 77*c* provided at either end of the main body part 77*a*. The magnet piece 78 has an N-pole on its upper surface and an S-pole on its lower surface and is attached at a substantially central position of the main body part 77*a*. The raised parts 77*b* and 77*c* are both S-poles.

The magnet piece 78 opposes the tip part of the contact part 76*a* and the raised part 77*c* opposes a center part of the reed part 76*a* along its longitudinal direction. The raised part 77*b* opposes a center part along a longitudinal direction of the reed part 75*a*.

In the following, an operation of the above-mentioned switch 70 will be described.

In a normal state, the switch 70 is in a state shown in FIGS. 8 and 9A. A gap 80 between the raised part 77*b* and the reed part 75*a* has a magnetic resistance R1 and a gap 81 between the raised part 77*c* and the reed part 76*a* has a magnetic resistance R2. The relationship between the magnetic resistances R1 and R2 can be expressed as R1>R2. Accordingly, a magnetic flux generated from the yoke-magnet assembly 72 flows across the gap 81 and through the reed part 76*a* as shown by a broken line labeled $\phi$1. The contact part 76*b* becomes an S-pole and is attracted by the magnet piece 78. Thus, the reed part 76*a* is flexed downward. The contact part 76*b* is not further attracted to the magnet piece 78. Therefore, a gap 82 exists between the contact part 76*b* and the magnet piece 78.

The gap 79 exists between the contact part 75*b* and the contact part 76*b*. Therefore, the switch 70 is in an OFF state.

In a case shown in FIG. 9B, the magnet 90 serving as a means for generating an external magnetic field is moved toward the switch 70 such that its S-pole opposes the reed part 75*a* and its N-pole opposes the reed part 76*a*. Then, the magnetic field generated by the magnet 90 acts on the switch part 73 through the cover 74. The magnetic flux flows through the reed part 76*a*, the gap 79 and the reed part 75*a* as shown by a line labeled $\phi$2. The contact part 76*b* becomes an N-pole and the contact part 75*b* becomes an S-pole.

Therefore, in addition to an attractive force being produced between the contact part 76*b* and the contact part 75*b*, a repulsive force is produced between the contact part 76*b* and the magnet 78. Thus, as shown in FIG. 9C, the contact part 76*b* comes in contact with the contact part 75*b*.

Accordingly, the switch 70 is switched to an ON state and there is an electrically conducting state between the terminal parts 75*c* and 76*c*. Also, the flow of the flux $\phi$2 will change to a flow as shown by a line labeled $\phi$2*a*.

Figure 10:
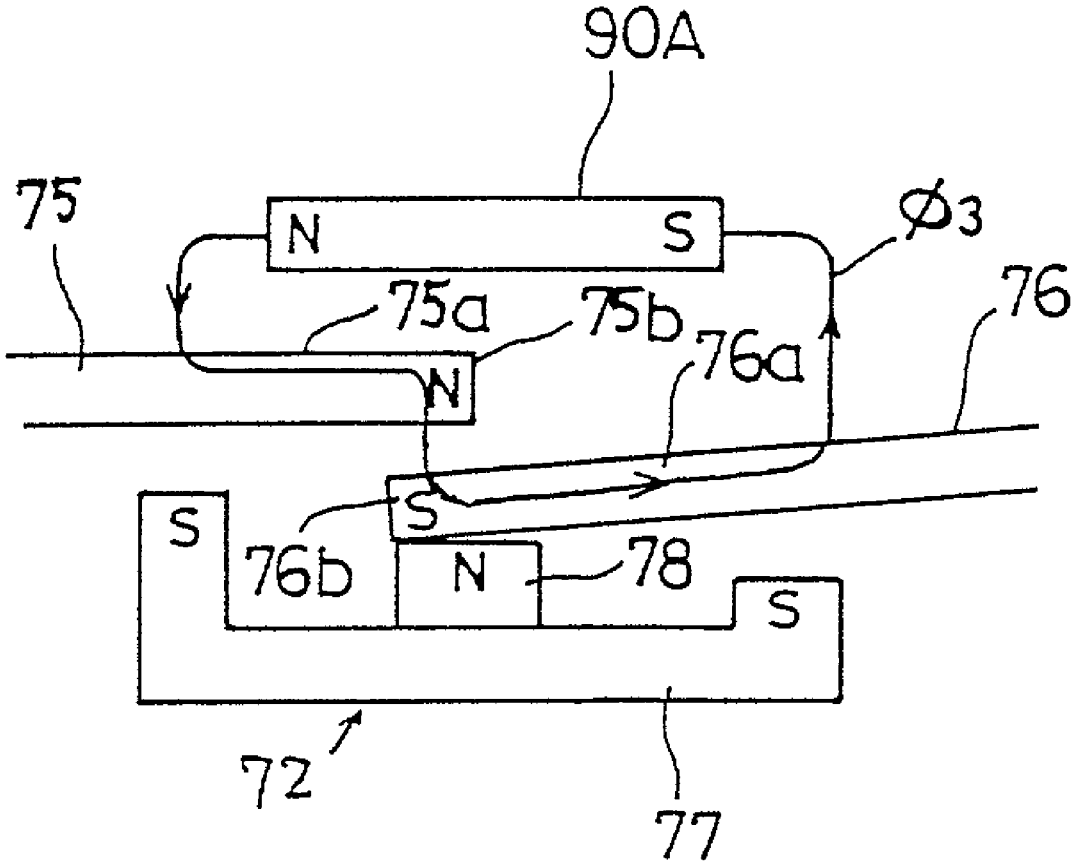
FIG. 10 is a diagram showing the switch of a third embodiment of the present invention with polarities of the magnet being reversed.

When an orientation of the magnetic poles of the magnet 90 is reversed, the switch 70 becomes a state shown in FIG. 10. The magnet 90A has its S-pole opposed to the reed part 76*a* and its N-pole opposed to the reed part 75*a*. The magnetic flux flows as shown by a line labeled $\phi$3. The contact part 76*b* becomes an S-pole and is attracted towards the magnet 78. The switch 70 does not operate and remains in an OFF state.

Accordingly, an operation of the above-mentioned switch 70 is restricted to a condition where the number of magnets is limited to one with the orientation of magnetic poles being limited to a single orientation.

Also, the above-mentioned switch 70 has advantages described below.

1. Shock-resistance

As shown in FIG. 9A, when the switch 70 is in an OFF state, the magnetic flux generated by the yoke-magnet assembly 72 flows as shown by the broken line $\phi$1, the contact part 76*b* experiences an attractive force toward the magnet piece 78. Therefore, even if an article in which the switch 70 is incorporated is dropped on the floor and a strong external force acts on the switch 70, the contact part 76*b* will be kept in a position shown in FIGS. 8 and 9A and will not be displaced upwardly by a shock. Therefore, the switch part 73 remains open and the switch 70 will never inadvertently be switched to an ON state.

2. Improved Operational Reliability

With an improved operational reliability of the switch 70, a weak magnetic strength is sufficient for the magnet 90.

As shown in FIG. 9B, when the magnet 90 approaches the switch 70, the contact part 76*b* becomes an N-pole. Accordingly, there is a magnetic attractive force between the contact part 76*b* and the contact part 75*b* and a repulsive force between the contact part 76*b* and the magnet piece 78.

As shown in FIG. 9C, when the contact parts 76*b* and 75*b* come into contact, the reed parts 76*a* and 75*a* slightly deform and the gap 81 slightly widens to a gap 81*a*. The magnetic resistance R1 increases to R1*a*, the gap part 80 slightly narrows to a gap 80*a* and the magnetic resistance R2 decreases to R2*a*. Thus the relationship between the magnetic resistance R1*a* and R2*a* is reversed: R1*a*<R2*a*. The magnetic flux generated from the yoke-magnet assembly 72 now flows across the gap 80*a* as shown by the broken line φ1*a* and produces an attractive force between the contact parts 76*b* and 75*b*.

As has been described above, the yoke-magnet assembly 72 serves to assist in causing the contact parts 76*b* and 75*b* to come into contact and in maintaining the contact parts 75*b* and 76*b* in a contacted state.

Thus, an operation of causing the contact part 76*b* to come into contact with the contact part 75*b* is reliably performed compared to a case where the operation is dependent solely on an attractive force. Accordingly, the operational reliability is improved and a weak magnetic strength is sufficient for the magnet 90.

Figure 11:
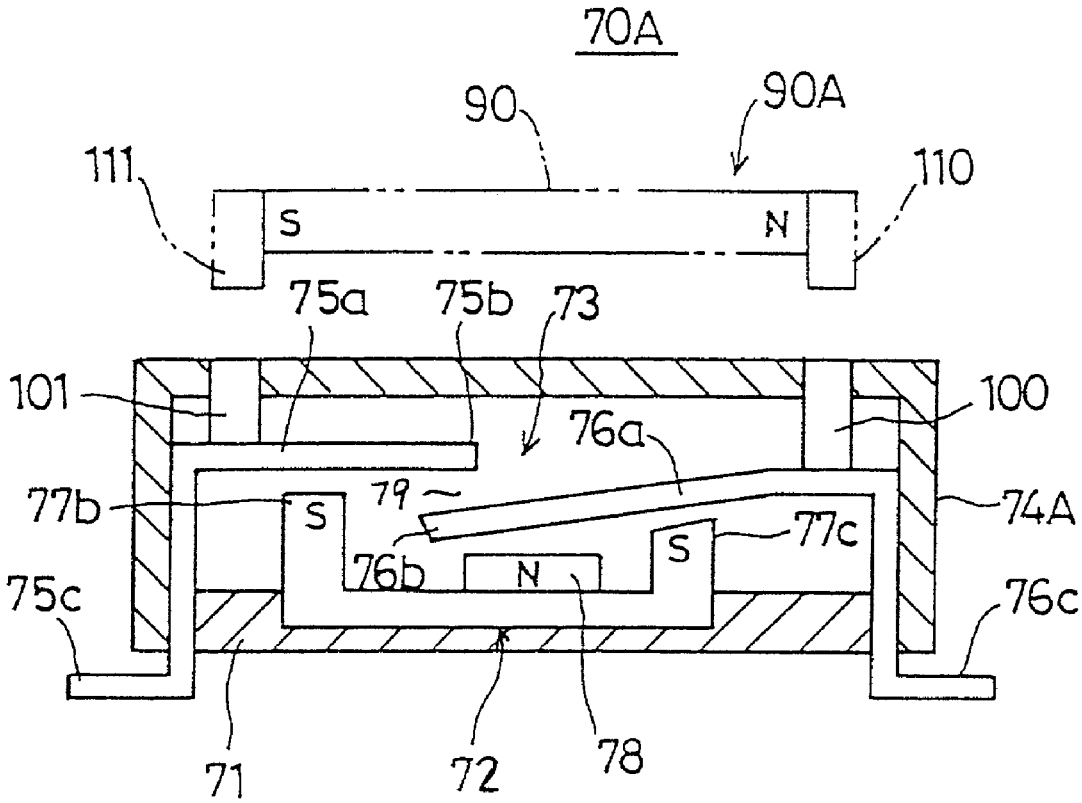
FIG. 11 is a cross-sectional diagram of a switch of a fourth embodiment of the present invention.
Figure 12A:
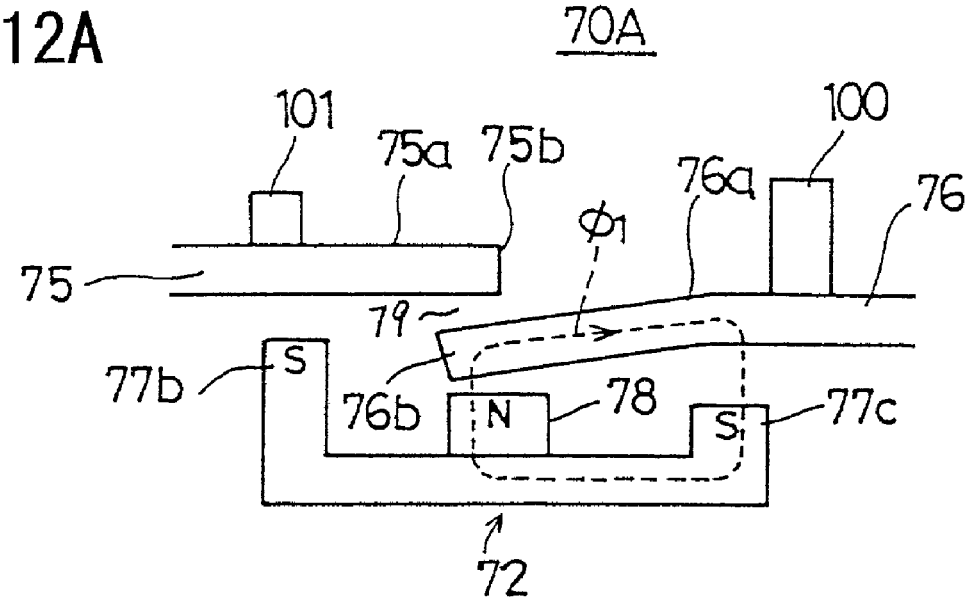
FIGS. 12A and 12B are schematic diagrams showing the switch of the fourth embodiment of the present invention.
Figure 12B:
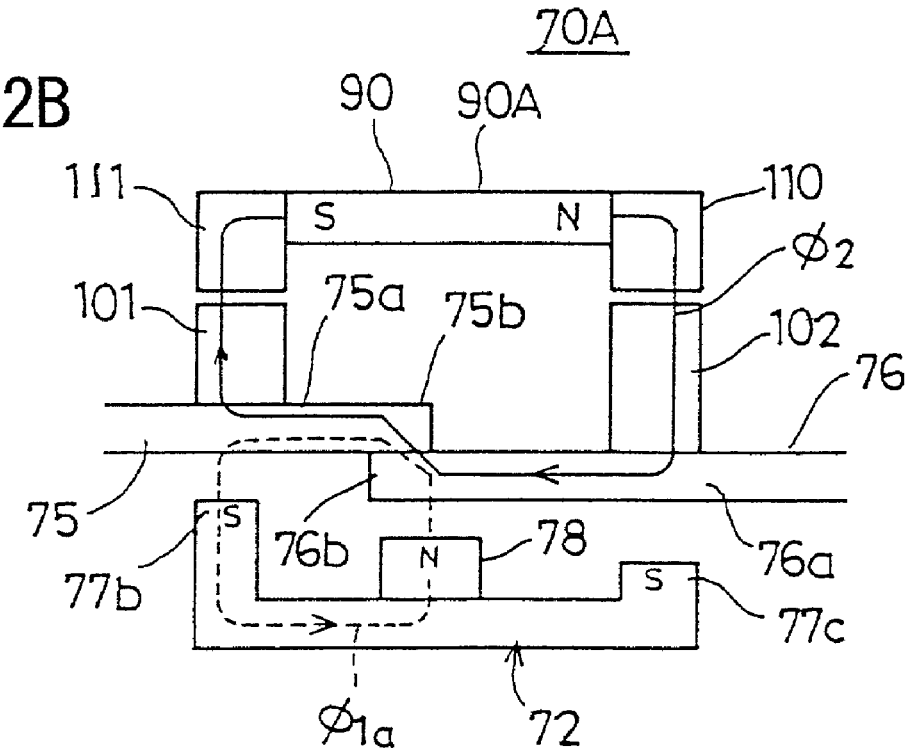

FIG. 11 is a diagram showing a switch 70A operable under a predetermined condition of a fourth embodiment of the present invention. FIGS. 12A and 12B are schematic diagrams showing a structure of the switch 70A.

The operation of the switch 70A is restricted to a condition wherein there is one magnet with magnetic poles being in a particular orientation and the magnet has a predetermined size.

The switch 70A is similar to the switch 70 shown in FIG. 8 except that pole pieces 100 and 101 are additionally provided. In FIGS. 11, 12A and 12B, elements corresponding to those shown in FIGS. 8 and 9 are indicated by the same reference numerals and detailed description is omitted.

The pole piece 100 is attached to the reed part 75*a* at a position near the base part and protrudes upward. The pole piece 101 is attached to the reed part 76*a* at a position near the base part and protrudes upward.

A cover 74A is provided with openings 74Aa at positions corresponding to the pole pieces 100 and 101. The pole pieces 100 and 101 are exposed from the openings 74Aa. The cover 74A is made of a non-magnetic material.

In order to produce external magnetic fields acting on the switch 70A, a magnet assembly 90A is prepared. The magnet assembly 90A includes pole pieces 110 and 111 provided on either end of the magnet 90.

When the magnet assembly 90A approaches the switch 70A and the pole pieces 110 and 111 accurately oppose the pole pieces 100 and 101, respectively, the contact part 76*b* and the contact part 75*b* come in contact as shown in FIG. 12B. Accordingly, the switch 70A is switched to an ON state.

The operational condition of the switch 70A is similar to that of the switch 70 shown in FIG. 8 except that, further to a condition that the magnet is provided with a particular position, the pole pieces 110 and 111 should accurately oppose the pole pieces 100 and 101, respectively.

Also, since the pole pieces 100 and 101 are exposed from the cover 74A, the switch 70A efficiently picks up externally applied magnetic flux. Therefore, compared to the above-mentioned switch 70, the switch 70A has a higher sensitivity so that it can operate properly even if the magnetic strength of the magnet 90 is weaker. Further, with the yoke-magnet assembly 72 being provided, the switch 70A has an advantage that it does not perform an erroneous operation even if a shock is applied thereto.

Figure 13:
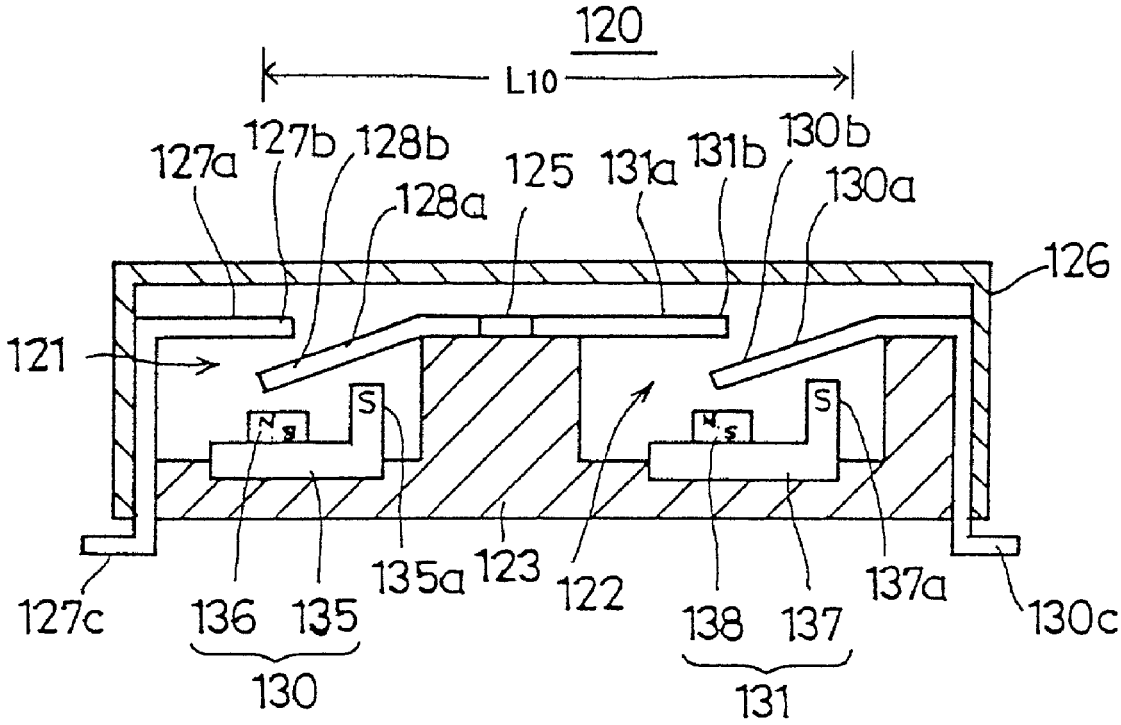
FIG. 13 is a cross-sectional diagram of a switch of a fifth embodiment of the present invention.

FIG. 13 is a diagram showing a switch 120 operable under a predetermined condition of a fifth embodiment of the present invention. FIGS. 14A through 14D are schematic diagrams showing a structure of the switch 120.

The switch 120 is similar to the switch 20 shown in FIG. 2 except that the operational condition of the switch 120 is restricted to a case where there are two magnets and the two magnets are provided with particular and same orientations.

Figure 14A:
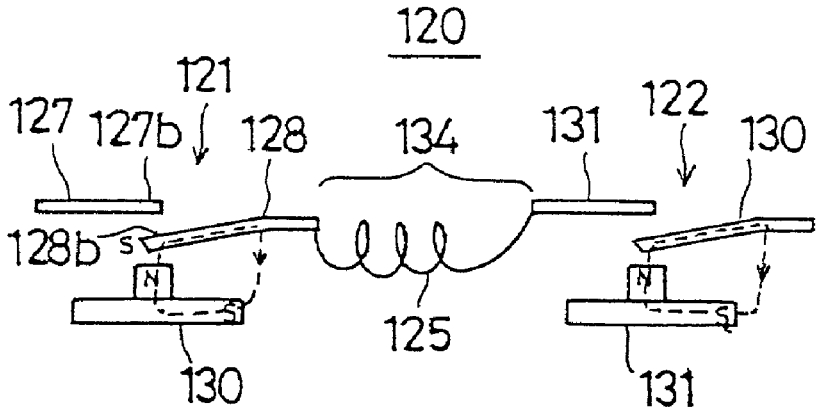
FIGS. 14A through 14D are schematic diagrams showing the switch of the fifth embodiment of the present invention.

As shown in FIGS. 13 and 14A, the switch 120 includes a base 123, a first switch part 121 and a second switch part 122. The first and second switch parts 121 and 122 are supported by the base 123. The first and second switch parts 122 and 123 are aligned on a straight line, separated apart by a dimension L10 along the straight line, and are connected in series via a connecting member 125 that is electrically conductive and non-magnetic. Yoke-magnet assemblies 130 and 131 are provided on the base 123 at positions under and opposing the first and second switch parts 121 and 122, respectively. All the elements of the switch 120 are covered with a cover 126 except for terminal parts 127*c* and 130*c* provided on either end of the switch 120 for mounting the switch 120 on a PCB.

The first and second switch parts 121 and 122 correspond to the first and second switch parts 21 and 22 shown in FIG. 2 and the connection member 125 corresponds to the connection member 25 shown in FIG. 2.

The yoke-magnet assembly 130 includes an L-shaped yoke member 135 and a magnet piece 136. The magnet piece 136 has an N-pole on its upper surface and an S-pole on its lower surface. The yoke-member 135 has an S-pole at its raised part 135*a*. The magnet piece 136 and the raised part 135*a* both oppose the reed part 128*b*. The reed part 128*b* is attracted toward the magnet piece 136 in a similar manner to the case shown in FIG. 9A.

A further yoke-magnet assembly 131 has a similar structure to that of the yoke-magnet assembly 130 and includes an L-shaped yoke member 137 and a magnet piece 138. The magnet piece 138 has an N-pole on its upper surface and an S-pole on its lower surface. The yoke-member 137 has an S-pole at its raised part 137*a*. The magnet piece 138 and the raised part 137*a* both oppose the reed piece 130*b*. The reed piece 130*b* is magnetically attracted toward the magnet piece 138 in a similar manner to the case shown in FIG. 9A.

In the following, an operation of the above-mentioned switch 120 will be described.

The normal state of the switch 120 is shown in FIGS. 13 and 14A, where the first and second switch parts 121 and 122 are both open and the switch 120 is in an OFF state.

Figure 14B:
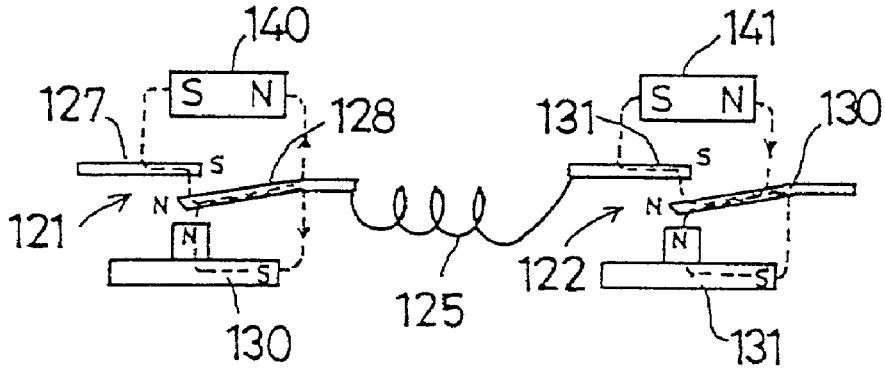

Referring to FIG. 14B, the magnets 140 and 141 approach the first and second switch parts 121 and 122, respectively, such that the magnetic poles are in the same orientation, i.e., the right-hand side end of the magnets being N-poles and the left-hand side end of the magnets being S-poles. A magnetic field generated by the magnet 140 acts on the first switch part 121 and a magnetic field generated by the magnet 141 acts on the second switch part 122. Then, the contact part 128*b* of the switch part 121 becomes an N-pole and the contact part 127*b* becomes an S-pole. There is an attractive force between the contact part 128*b* and the contact part 127*b* and a repulsive force between the contact part 128*b* and the magnet 136.

Figure 14C:
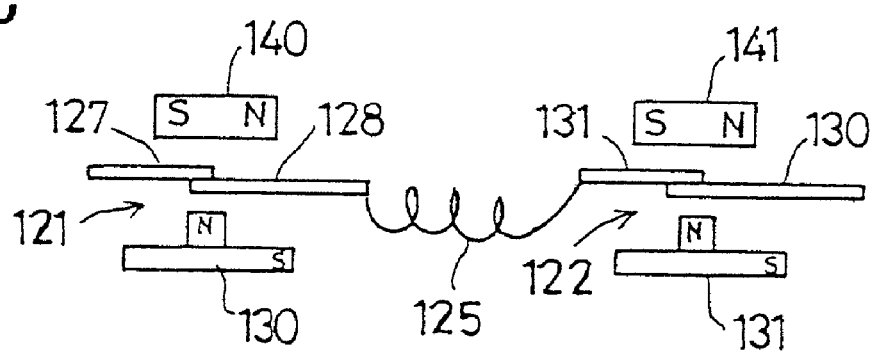

As shown in FIG. 14C, the contact parts 128*b* and 127*b* come in contact and the first switch part 121 is closed. The contact part 130*b* of the switch part 122 becomes an N-pole and the contact part 131*b* becomes an S-pole. There is an attractive force between the contact part 130*b* and the contact part 131*b* and a repulsive force between the contact part 130*b* and the magnet 138. As shown in FIG. 14C, the contact parts 130*b* and 131*b* come in contact and the second switch part 122 is closed. Therefore, the switch 120 is switched to an ON state.

When the magnets 141 and 142 are moved away from the switch 120, the first and second switch parts 121 and 122 are opened and thus the switch 120 is switched to an OFF state.

Figure 14D:
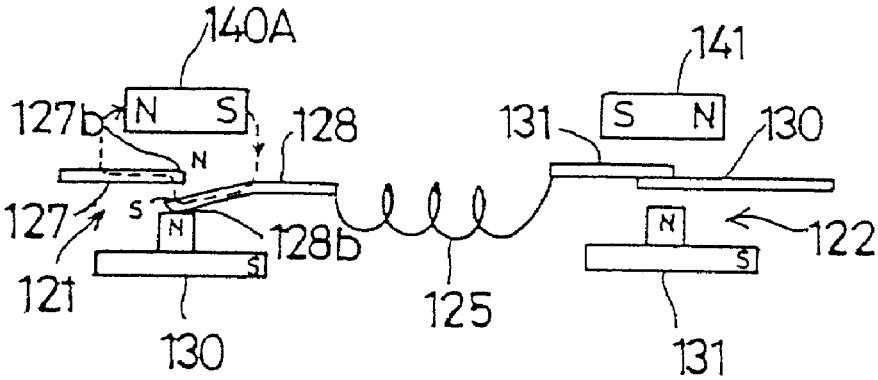

Now, a case illustrated in FIG. 14D is considered, in which orientation of the magnetic poles of the magnet 140 is reversed. As shown in FIG. 14D, a magnetic field generated by a magnet 140A causes the contact part 128*b* to become an S-pole and the contact part 127*b* to become an N-pole. Thus, an attractive force is produced between the contact part 128*b* and the magnet 136 and a repulsive force is produced between the contact part 128*b* and the contact part 127*b*. Thus, the first switch part 121 remains open and thus the switch 120 remains in an OFF state.

It is to be noted that the above-described operational condition is unlikely to happen in a normal state, and thus the switch 120 is prevented from being switched to an ON state in an unintentional manner.

Also, the switch 120 has functions of recognizing and verifying that there are two magnets and that the two magnets are placed with the magnetic poles being in a particular same orientation. Therefore, compared to the switch 20 shown in FIG. 3, the switch 120 has an advantageous effect when used for applications requiring a secure operation.

Also, the switch 120 has an improved shock-resistance property since the yoke-magnet assemblies 130 and 131 are provided.

Figure 15:
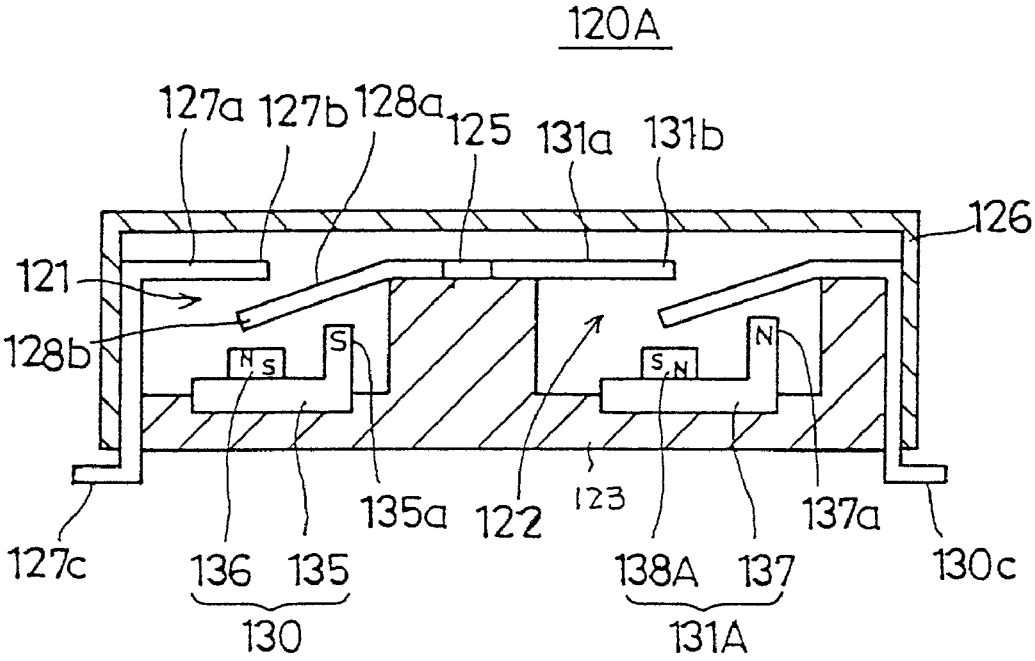
FIG. 15 is a cross sectional diagram of a switch of a sixth embodiment of the present invention.
Figure 16A:
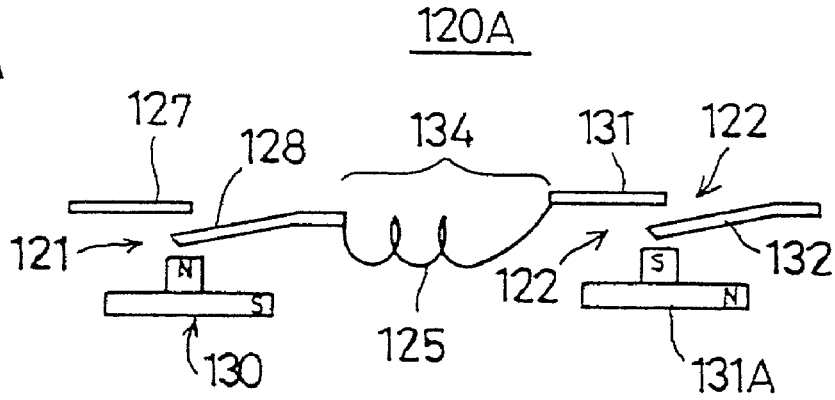
FIGS. 16A through 16C are schematic diagrams showing the switch of the sixth embodiment of the present invention.
Figure 16B:
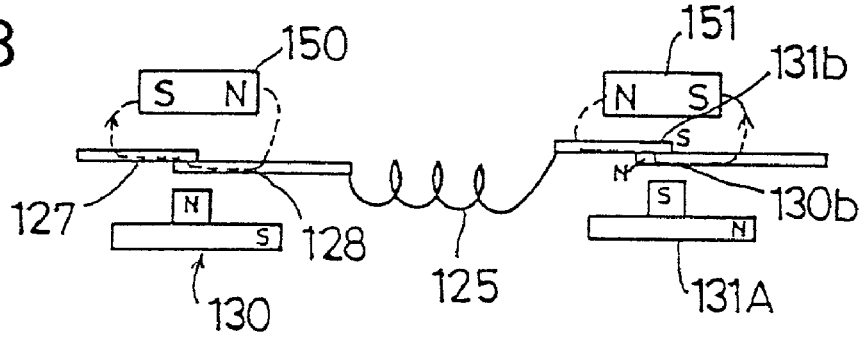
Figure 16C:
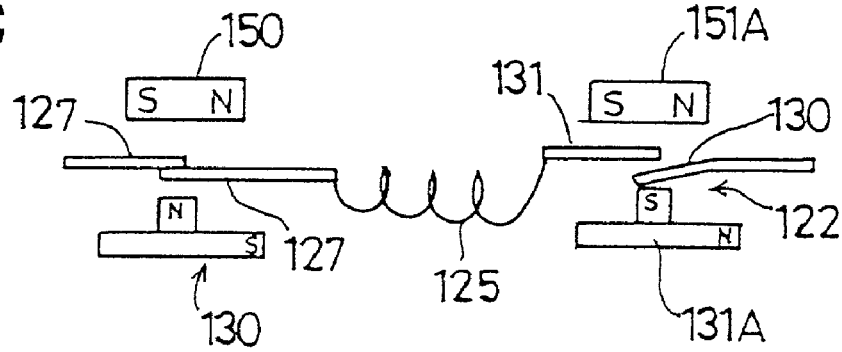

FIG. 15 is a diagram showing a switch 120A operable under a predetermined condition of a sixth embodiment of the present invention. FIGS. 16A through 16C are schematic diagrams showing a structure of the switch 120A.

The switch 120A is similar to the switch 120 shown in FIG. 13 except that the operational condition of the switch 120A requires that the orientations of polarities of the two magnets are mutually opposite. In other words, the operational condition of the switch 120A is restricted to a case where there are two magnets and that the two magnets are provided with the particular and mutually opposite orientations.

As shown in FIGS. 15 and 16A, the switch 120A is similar to the switch 120 shown in FIGS. 13 and 14A except that the structure of the yoke-magnet assembly opposing the second switch part 122 is different. In FIGS. 15 and 16A, elements corresponding to those shown in FIGS. 13 and 14A are shown with same reference numerals and will not be described in detail.

The yoke-magnet assembly 131A opposing the second switch part 122 includes a magnet piece 138A. The magnet piece 138A has an S-pole on its upper surface and an N-pole on its lower surface. The yoke-member 137 has an N-pole at its raised part 137*a*.

Referring to FIG. 16B, the magnets 150 and 151 approach the first and second switch parts 121 and 122, respectively, such that the magnetic poles are in the mutually opposite orientations, i.e., the right-hand side end being an N-pole and the left-hand side end being an S-pole for the magnet 150 and the right-hand side end being an S-pole and the left-hand side end being an N-pole for the magnet 151. Then, the first switch part is closed in a manner similar to the state shown in FIGS. 14B and 14C. For the second switch part 122, the contact part 130*b* becomes an S-pole and the contact part 131*b* becomes an N-pole. An attractive force is produced between the contact part 130*b* and the contact part 131*b* and a repulsive force is produced between the contact part 130*b* and the magnet 138A. As shown in FIG. 16B, the contact parts 130*b* and 131*b* come in contact and the second switch part 122 is closed. Thus, the switch 120A is switched to an ON state.

When the magnets 150 and 151 are moved away from the switch 120A, the first and second switch parts 121 and 122 are opened and thus the switch 120A is switched to an OFF state.

Now, a case illustrated in FIG. 16C is considered, in which an orientation of the magnetic poles of the magnet 151 is reversed. As shown in FIG. 16C, a magnetic field generated by a magnet 151A causes the contact part 130*b* to become an N-pole and the contact part 131*b* to become an S-pole. An attractive force is produced between the contact part 130*b* and the magnet 138A and a repulsive force is produced between the contact part 130*b* and the contact part 131*b*. Thus, the second switch part 122 remains open and the switch 120A remains in an OFF state.

It is to be noted that the above-described operational condition is unlikely to happen in a normal state, and thus the switch 120A is prevented from becoming an ON state in an unintentional manner.

Also, the switch 120A has functions of recognizing and verifying that there are two magnets and the two magnets are placed with the particular mutually opposite orientations of the magnetic poles. Therefore, compared to the switch 20 shown in FIG. 3 and also compared to the switch 120 shown in FIG. 13, the switch 120A has a further advantageous effect when used for applications requiring a secure operation.

Also, the switch 120A has an improved shock-resistant property since the yoke-magnet assemblies 130, 131A are provided.

Figure 17:
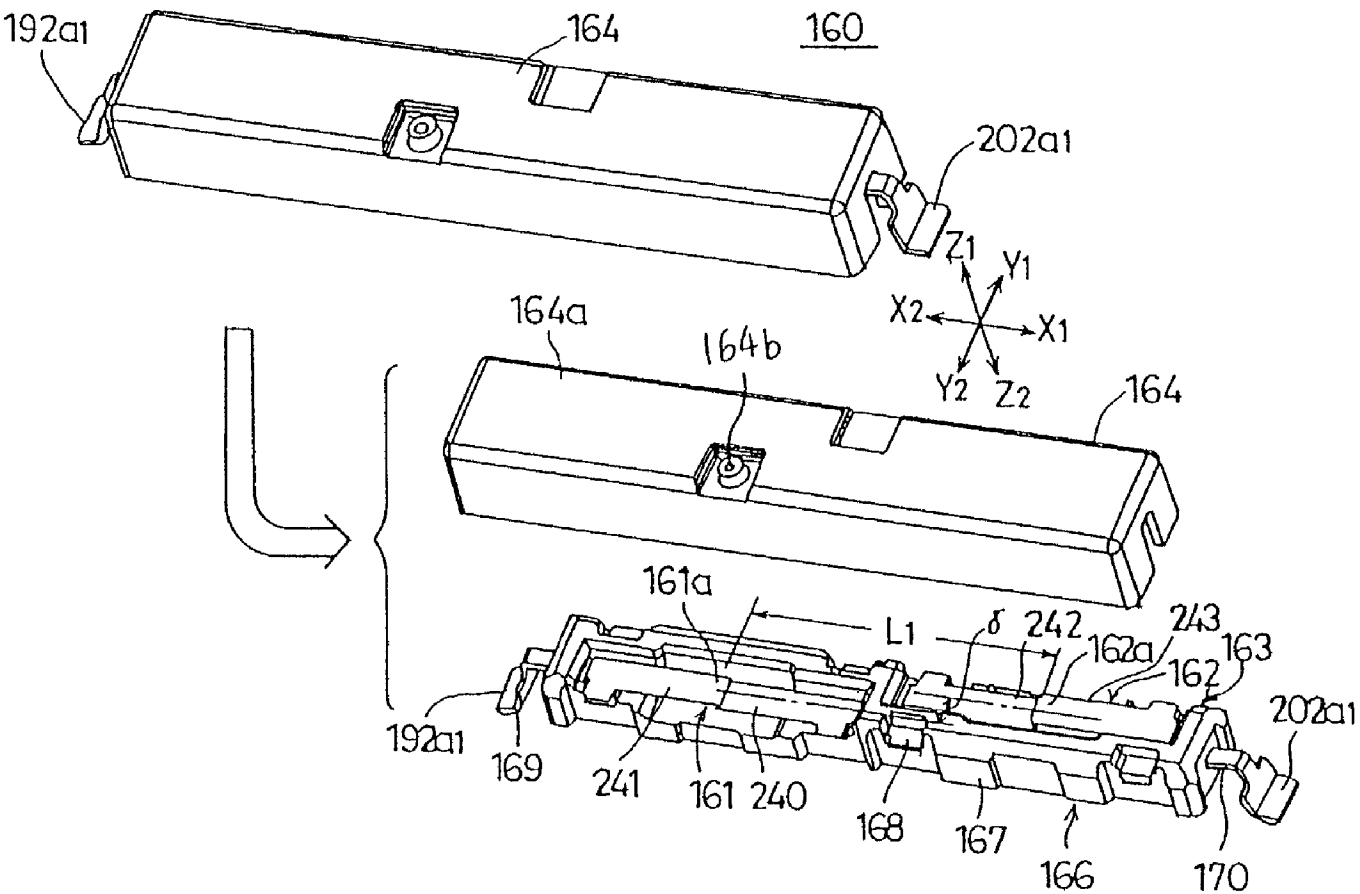
FIG. 17 is an exploded perspective diagram of a switch of a seventh embodiment of the present invention.
Figure 18:
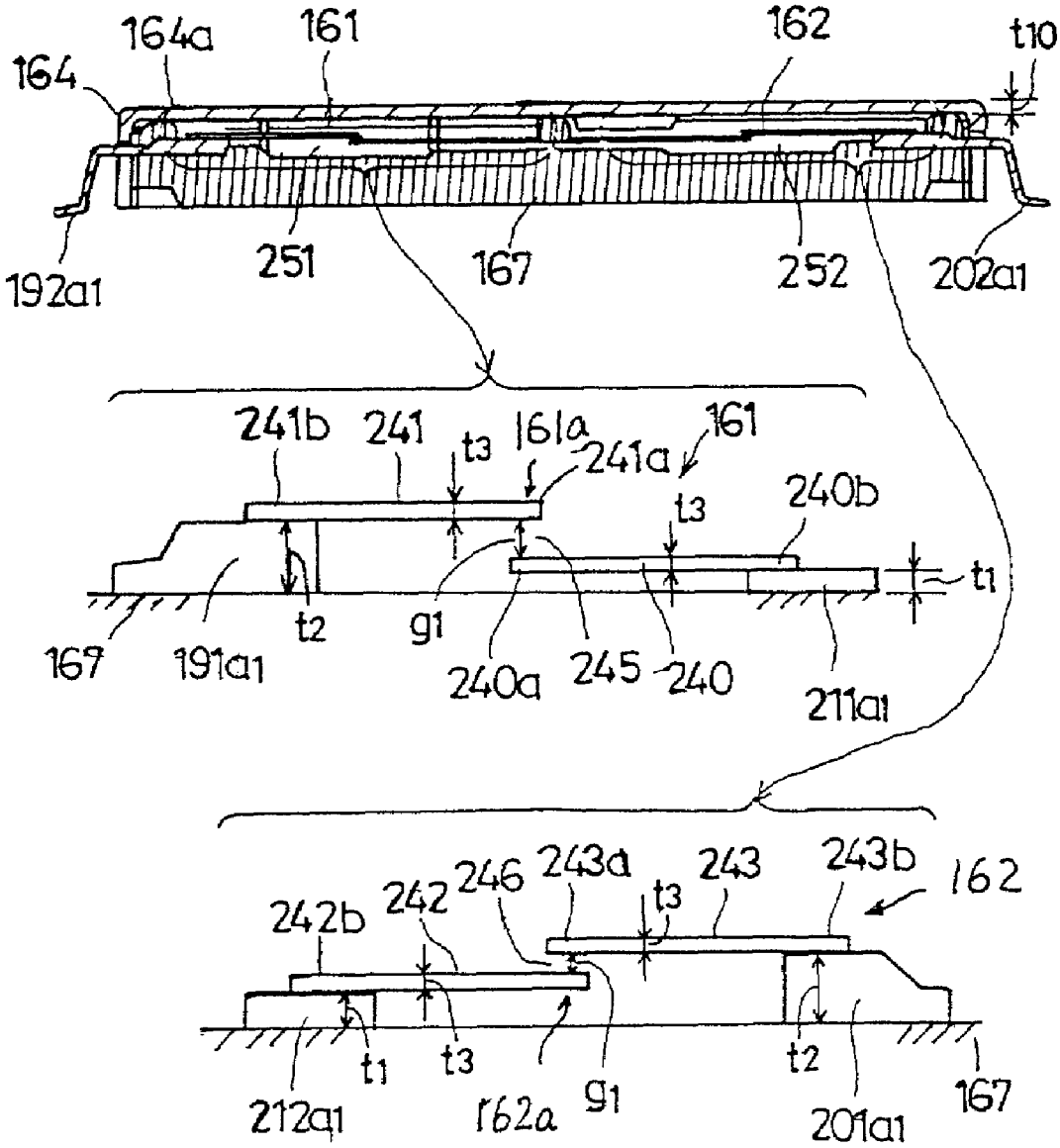
FIG. 18 is a cross-sectional diagram of the switch of the seventh embodiment of the present invention.
Figure 19:
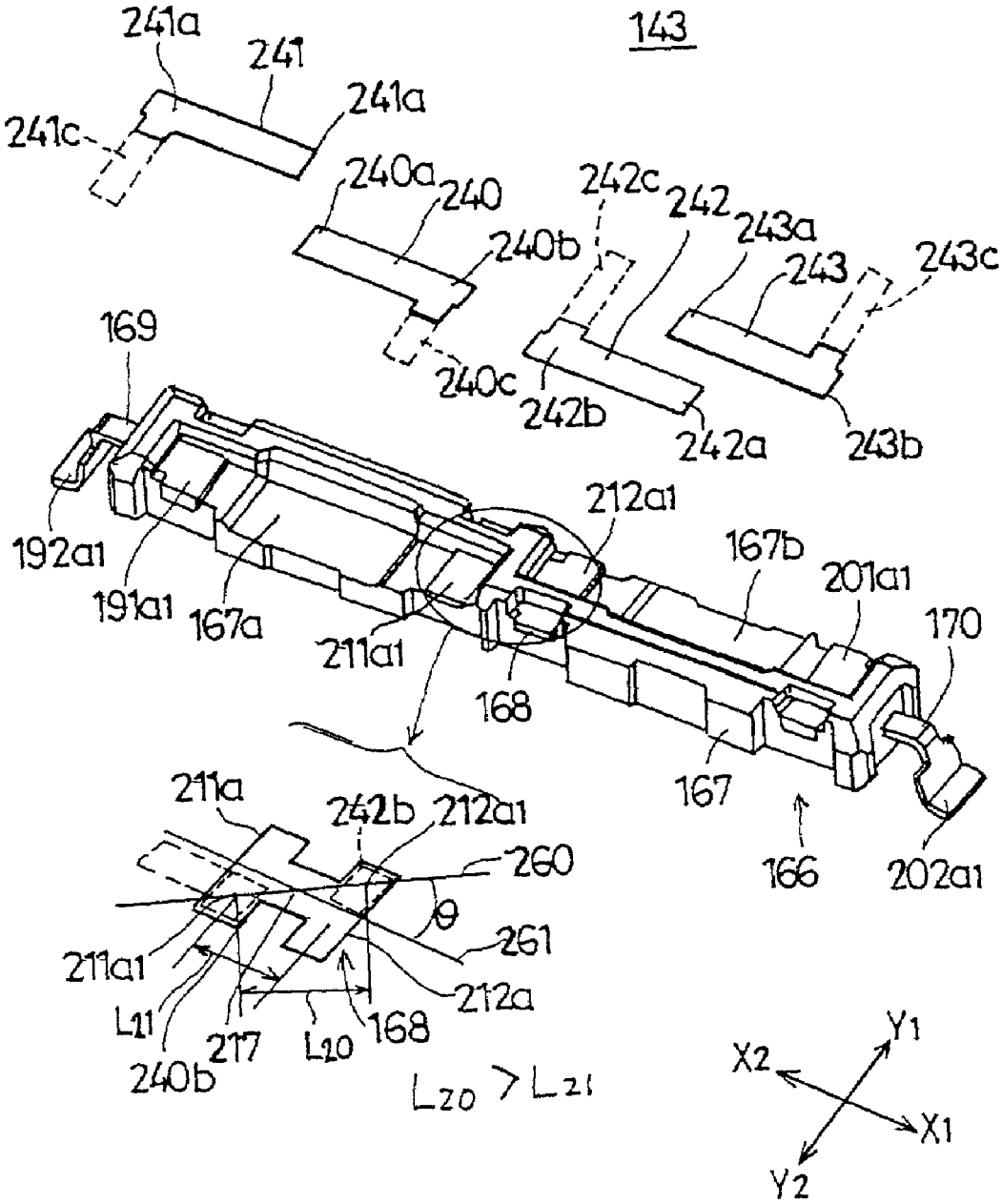
FIG. 19 is an exploded view of a switch main body of the switch of FIG. 18.

FIGS. 17 and 18 are diagrams showing a switch 160 operable under a predetermined condition of a seventh embodiment of the present invention. FIG. 19 is an exploded view of a switch main body of the switch 160. In the figures, arrows X1 and X2 indicate longitudinal directions, Y1 and Y2 indicate width-wise directions and Z1 and Z2 indicate height-wise directions of the switch 160.

The switch 160 includes a switch assembly 163 covered with a cover 164 and provided with terminal parts 192*a*1 and 202*a*1 made of copper alloy for mounting the switch on a PCB. The terminal parts may be provided on the Z2-side near both ends of the switch assembly 163. In claim 9, there is a description that "having terminal members on both ends". Therein, "both ends" includes both ends of the switch assembly 163 and parts near both ends of the switch assembly 163.

The switch assembly 163 includes an insert mold base 166 whereon a first switch part 161 and a second switch part 162 are provided connected in series. The first and second switch parts 161 and 162 are provided such that respective contact parts 161*a* and 162*a* are positioned along the X1-X2 axis with a separation of L1. The first and second switch parts 161 and 162 are offset by a distance δ along the Y1-Y2 axis. The insert mold base 166 includes a mold base main body 167, a connecting member 168 embedded in the mold base main body 167 and terminal members 169 and 170.

In order to clarify the characteristics of the switch 160, the structure of the switch assembly 163 will be described in detail according to its manufacturing method.

The switch assembly 163 is manufactured through an insert-mold step, a pressing step and reed piece welding step.

(1) Insert-Mold Step

Figure 20A:
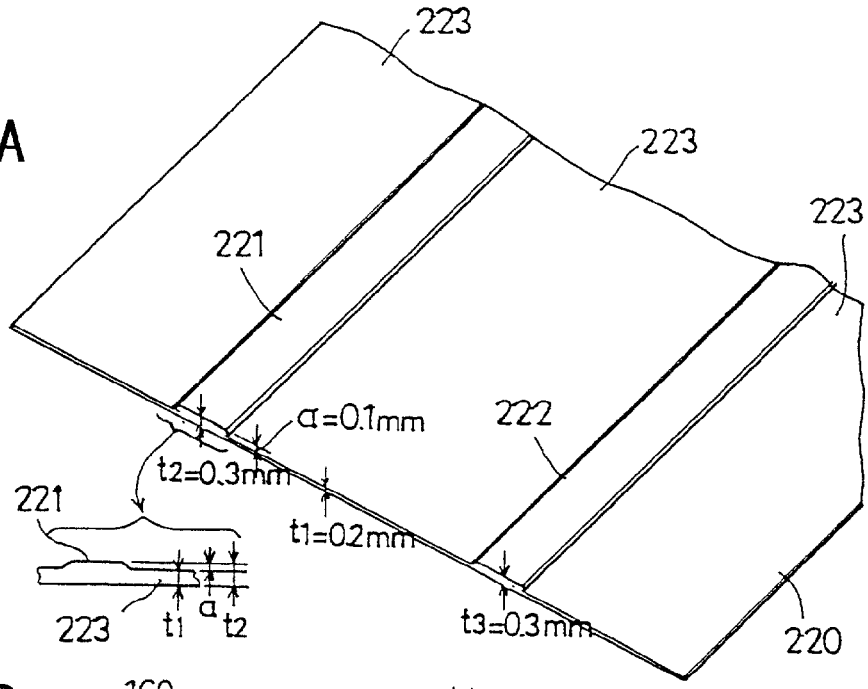
FIGS. 20A and 20B are diagrams showing an insert frame member of the switch of FIG. 18.
Figure 20B:
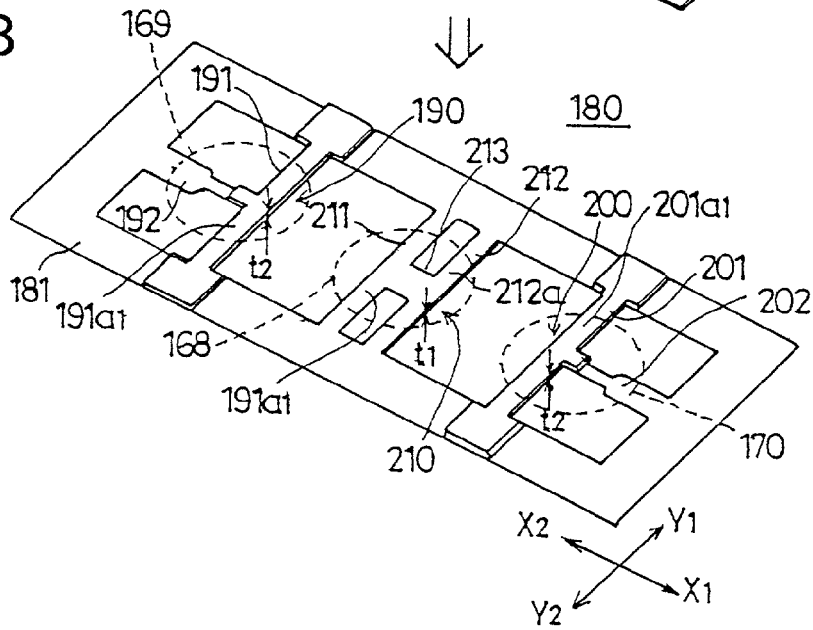

FIG. 20B shows an insert frame member 180 to be prepared. The insert frame member 180 is manufactured by punching a plate member 220 using a press machine. The plate member 220 is an irregular plate rolled by a roll having a special shape and may be made of copper alloy. The thickness t1 of the plate member 220 is approximately 0.2 mm. Two strips 221 and 222 are provided on an upper surface of the plate 220. The strips 221 and 222 have a thickness t2 of approximately 0.3 mm, which is approximately 0.1 mm greater than the thickness t1 of the plate member 220. The entire lower surface of the plate member 220 is flat. The height difference "a" between an upper surface of the strips 221 and 222 and the upper surface of the plate member 220 is approximately 0.1 mm.

The insert frame member 180 includes a rectangular frame part 181, two T-shaped parts 190 and 200 and an H-shaped part 210. The T-shaped parts 190 and 200 and the H-shaped part 210 are formed at positions inside the frame part 181 and are connected to the frame part 181.

The T-shaped parts 190 and 200 include head parts 191 and 201, respectively, and leg parts 192 and 202, respectively. The head parts 191 and 201 are formed by parts of strip parts 221 and 222 of the plate member 220 shown in FIG. 20A.

The H-shaped part 210 includes two I-shaped parts 211 and 212 and linking beam part 213 linking the I-shaped parts 211 and 212. Also, the H-shaped part 210 is formed of a part 223 of the plate 200, which part 223 has a thickness t1 of approximately 0.2 mm.

Figure 21:
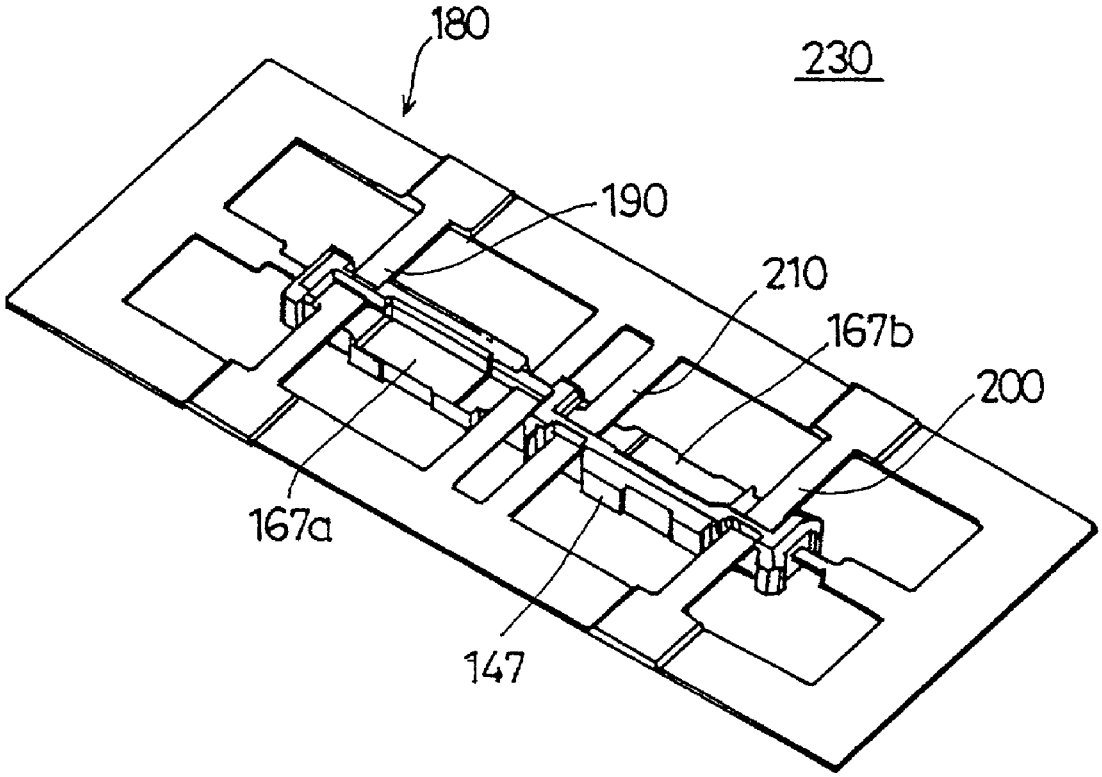
FIG. 21 is a diagram showing an insert mold member of the switch of FIG. 18.

An insert mold process is carried out by setting the above-described insert frame member 180 on a lower resin-molding mold, and then combining the upper and lower resin-molding mold and then injecting liquid crystal polymer into the resin-molding mold. Accordingly, the insert mold component 230 shown in FIG. 21 is manufactured.

The insert mold component 230 includes a mold base main body 167 made of liquid crystal polymer and an insert frame member 180. The central part of the T-shaped parts 190, 200 and the central part of the H-shaped part 210 are embedded in the mold base main body 167.

On an upper surface of the mold base main body 167, shallow recesses 167*a* and 167*b* are formed for providing the first and second switches 161 and 162.

(2) Pressing Step

The insert mold component 230 shown in FIG. 21 is set in a press machine. Then the press machine is operated to cut portions protruding from the mold base main body 167 except for leg portions 192 and 202 of the insert frame member 180. The leg portions 192 and 202 are cut near the frame part 181 and then bent. Thus, the insert mold base 166 shown in FIG. 19 is obtained.

The insert mold base 166 includes a mold base main body 167, a connecting member 168 embedded in the mold base main body 167 and terminal members 169 and 170.

The connecting member 168 is the central part of the H-shaped part 210 and includes two I-shaped parts 211 and 212 and linking beam part 213 linking the I-shaped parts 211*a* and 212*a* as shown in FIG. 19. Element 211*a*1 is a terminal part that is a Y2-side part of the I-shaped part 211*a* and is exposed to the X2-side part of the recessed part 167*b*.

The terminal member 169 is the central part of the T-shaped part 190. Element 192*a*1 is a terminal part that is also a part of the leg part 192 and protrudes in the X2-direction from the mold base main body 167. An element 191*a*1 is a terminal part that is also a part of the head part 191 and is exposed to the X2-side part of the recessed part 167*a*.

The terminal member 170 is the central part of the T-shaped part 200. Element 202*a*1 is a terminal part that is also a part of the leg part 202 and protrudes in the X1-direction from the mold base main body 167. Element 201*a*1 is a terminal part that is also a part of the head part 201 and is exposed to the X1-side part of the recessed part 167*b*.

The upper surfaces of the terminal parts 191*a*1 and 201*a*1 are 0.1 mm higher than the upper surfaces of the terminal parts 211*a*1 and 212*a*1.

(3) Reed Piece Welding Process

Referring to FIG. 19, first, the base part 240*b* of the reed piece 240 is laser welded on the terminal part 211*a*1 and then the base part 241*b* of the reed piece 241 is laser welded on the terminal part 191*a*1. Also, the base part 242*b* of the reed piece 242 is laser welded on the terminal part 212*a*1 and then the base part 243*b* of the reed piece 243 is laser welded on the terminal part 201*a*1.

The reed pieces 240 through 243 are thin pieces each having a length of approximately 3 mm and a thickness t3 of approximately 0.06 mm that are made of cobalt-iron alloy and are gold-plated. The reed pieces 240 through 243 may be made of any material such as magnetic iron and iron-nickel alloy.

It is to be noted that the reed pieces 240 through 243 are originally provided with grip parts 240*c* through 243*c* indicated by double-dotted lines in FIG. 19. When performing a laser-welding process, the jig clamps grip parts 240*c* through 243*c* so as to position the reed piece at a predetermined welding position. After laser welding, the grip parts 240*c* through 243*c* are cut off and removed.

The reed pieces 240 and 241 constitute the first switch part 161. As shown in an enlarged view in FIG. 18, a gap 245 having a length g1 of approximately 0.05 mm exists between a contact part 240*a* at the tip of the reed piece 240 and a contact part 241*a* at the tip of the reed piece 241.

The reed pieces 242 and 243 constitute the second switch part 162. In a similar manner to the above-described first switch part 161, a gap 246 having a length g1 of approximately 0.05 mm exists between a contact part 242*a* at the tip of the reed piece 242 and a contact part 243*a* at the tip of the reed piece 243. Thus, the switch assembly 163 is obtained.

The cover 164 may be a box-shaped molded component made of liquid crystal polymer. A top plate part 164*a* of the cover 164 has a predetermined thickness t10.

After covering the switch assembly 163 with the cover 164, the switch 160 is sealed by applying an epoxy resin on the bottom surface side of the switch and the applied epoxy resin is thermoset by heating it. Finally, air release holes 164*a* of the cover 164 are blocked. Thus, the switch 160 is obtained.

The top plate part 164*a* of the cover 164 touches the upper surface of the mold base main body 167. The first and second switch parts 161 and 162 are accommodated in cavities 251 and 252 formed between shallow recessed parts 167*a* and 167*b* of the mold base main body 167 and the lower surface of the top plate part 164*a* of the cover 164 and are sealed.

The switch 160 manufactured in the above-described manner may be surface mounted on a PCB with its terminal parts 192*a*1 and 202*a*1 being soldered on pads provided on the PCB.

The switch 160 manufactured in the above-described manner has improved features as follows:

(1) Improved accuracy of gap size g1 of the gaps 245 and 246 of the first and second switch parts 161 and 162.

Basically, the gap size g1 of the gap 245 of the first switch part 161 is determined by two parameters: a tolerance of a step size "a" of the plate member 20 and a tolerance of a thickness t3 of the reed pieces 240. Therefore, the gap size g1 of the gap 245 of the first switch part 161 is determined with an improved accuracy.

Similarly, the gap size g1 of the gap 246 of the second switch part 162 is determined by a step size "a" of the plate member 220 and with an improved accuracy.

(2) Strength of external magnetic fields for operating the first and second switch parts 161 and 162 can be determined by incorporating the cover 164 having the top plate part 164*a* having an appropriately selected thickness.

The top plate part 164*a* of the cover covers upper surfaces of the first and second switch parts 161 and 162 so as to reduce an effect of the external magnetic field on the first and second switch parts 161 and 162. In other words, the operating sensitivity of the first and second switch parts 161 and 162 is reduced by the top plate part 164*a* of the cover 164. When the thickness of the top plate part 164*a* is increased, the operating sensitivity of the first and second switch parts 161 and 162 are further reduced.

In the present embodiment, the thickness t10 of the top plate part 164*a* is selected as being approximately 0.3 mm such that the first and second switch parts 161 and 162 do not operate with a normal magnet but only operate with a magnet made of rare earth.

(3) Increased independence between the first switch part 161 and the second switch part 162.

The first switch part 161 and the second switch part 162 are offset along the Y1-Y2 axis. As shown in FIG. 19, a line 260 connecting the base part 240*b* of the reed piece 240 of the first switch part 161 and the base part 242*b* of the reed piece 242 of the second switch part 162 is inclined against a line along the X1-X2 axis by an angle θ. Therefore, a distance L20 between the base part 240*b* of the reed piece 240 and the base part 242*b* of the reed piece 242 is greater than a distance L21 corresponding to the distance L20 without the first and second switch parts 161 and 162 being offset along the Y1-Y2 axis.

Therefore, as compared to a configuration in which the first and second switch parts 161 and 162 are not offset along the Y1-Y2 axis, a magnetic resistance between the first and second switch parts 161 and 162 will increase and therefore there is an increased independence between the first and second switch parts 161 and 162. Accordingly, when one of the first and second switch parts 161 and 162 is operated, the other one of the first and second switch parts 161 and 162 can be prevented from being erroneously operated.

(4) Reduced voltage drop during operation.

The reed pieces 240 through 243 are made of gold-plated cobalt-iron alloy. The connection members 168, 169 and 170 are made of copper alloy. Accordingly, when the first and second switch parts 161 and 162 are operated, a voltage drop between the terminal parts 192*a*1 and 202*a*1 is very small.

(5) Surface mounting ability.

The mold base main body 147 and the cover 164 are made of liquid crystal polymer having high thermal resistance. Also, the terminal parts 192*a*1 and 202*a*1 have appropriate configurations for surface mounting purpose. Thus, the switch 160 is surface mounted on the PCB.

Next, a magnetic field generating unit for generating a magnetic field such that it simultaneously operates both switch parts will be described.

Considering an electronic apparatus and an attachment to be loaded in the electronic apparatus, a switch is provided on the attachment and an external magnetic generating unit is provided on the electronic apparatus.

Figure 22A:
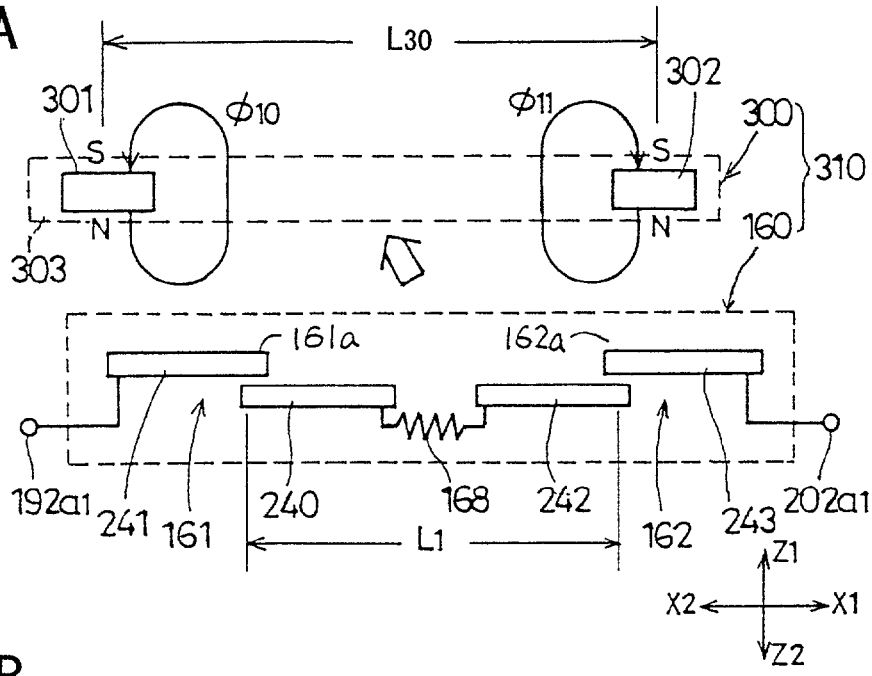
FIGS. 22A and 22B are diagrams showing a magnetic field generating unit of a first embodiment of the present invention together with a switch.
Figure 22B:
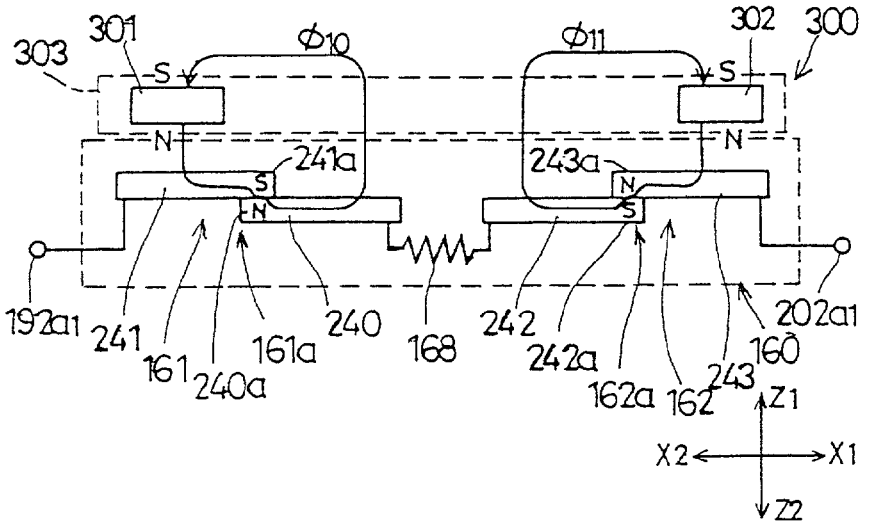

In the following description related to the external magnetic field generating unit, the switch 160 having a structure as shown in FIGS. 17 and 18 will be taken as an example of the switch. The general structure of the switch 160 is shown in FIGS. 22A and 22B. As shown in the figures, the first switch part 161 including the reed pieces 242 and 243 is serially connected to the second switch part 162 including the reed pieces 242 and 243 via the connecting member 168. The switch 160 includes the terminal parts 192*a*1 and 202*a*1 on its ends. The contact part 161*a* of the first switch part 161 and the contact part 162*a* of the second switch part 162 are separated by distance L1 along the X1-X2 axis.

FIGS. 22A and 22B are diagrams showing a magnetic field generating unit 300 of a first embodiment of the present invention together with the switch 160. As shown in FIG. 22A, the external magnetic field generating unit 300 includes a mold body 303 accommodating a first magnet 301 intended to act on the first switch part 161 and a second magnet 302 intended to act on the second switch part 162. The first and second magnets 301 and 302 are separated apart such that a distance L30 between the center the first magnet 301 and the center of the second magnet 302 along the X1-X2 axis is greater than the distance L1.

The first magnet 301 has an N-pole on the Z2-side and an S-pole on the Z1-side. The second magnet 302 also has an N-pole on the Z2-side and an S-pole on the Z1-side. The first and second magnets 301 and 302 are configured such that an orientation of magnetic poles is along the Z1-Z2 axis. The first and second magnets 301 and 302 generate magnetic fields shown by magnetic fluxes ϕ10 and ϕ11.

Considering the switch 160, the orientation of the magnetic poles of the first and second magnets 301 and 302 is perpendicular to the direction in which the first and second switch parts 161 and 162 are aligned.

Considering the reed pieces, the orientation of magnetic poles of the first magnet 301 is perpendicular to the direction in which the reed pieces 240 and 241 are aligned. The orientation of magnetic poles of the second magnet 302 is perpendicular to the direction in which the reed pieces 242 and 243 are aligned.

The first and second magnets 301 and 302 are separated such that a distance L30 between the center the first magnet 301 and the center of the second magnet 302 along the X1-X2 axis is greater than the distance L1.

The switch 160 and the external magnetic field generating unit 300 constitute a switch device 310.

Referring to FIG. 22B, when the switch 160 approaches the external magnetic field generating unit 300, the first and second switch parts 161 and 162 oppose the first and second magnets 301 and 302, respectively. The magnetic flux ϕ10 generated by the first magnet 301 flows through the reed pieces 240 and 241. Then, the contact 240*a* of the reed piece 240 becomes an N-pole and the contact 241*a* of the reed piece 241 becomes an S-pole. A magnetic attractive force is exerted such that the contact 240*a* of the reed piece 240 and the contact 241*a* of the reed piece 241 come into contact. Accordingly, the first switch part 161 is closed. The magnetic flux ϕ11 generated by the second magnet 302 flows through the reed pieces 242 and 243. Then, the contact 242*a* of the reed pieces 242 becomes an N-pole and the contact 243*a* of the reed piece 243 becomes an S-pole. A magnetic attractive force is exerted such that the contact 242*a* of the reed piece 242 and the contact 243*a* of the reed piece 243 come into contact. Accordingly, the second switch part 162 is closed. In this manner, the switch 160 is operated and is switched to an ON state. As a result, the terminal parts 192*a*1 and 202*a*1 are electrically conductive.

It is to be noted that the orientations of the magnetic poles of the first and second magnets 301 and 302 may be opposite to the orientations in the first embodiment described above and may also be opposite between the first magnet 301 and the second magnet 302.

Figure 23:
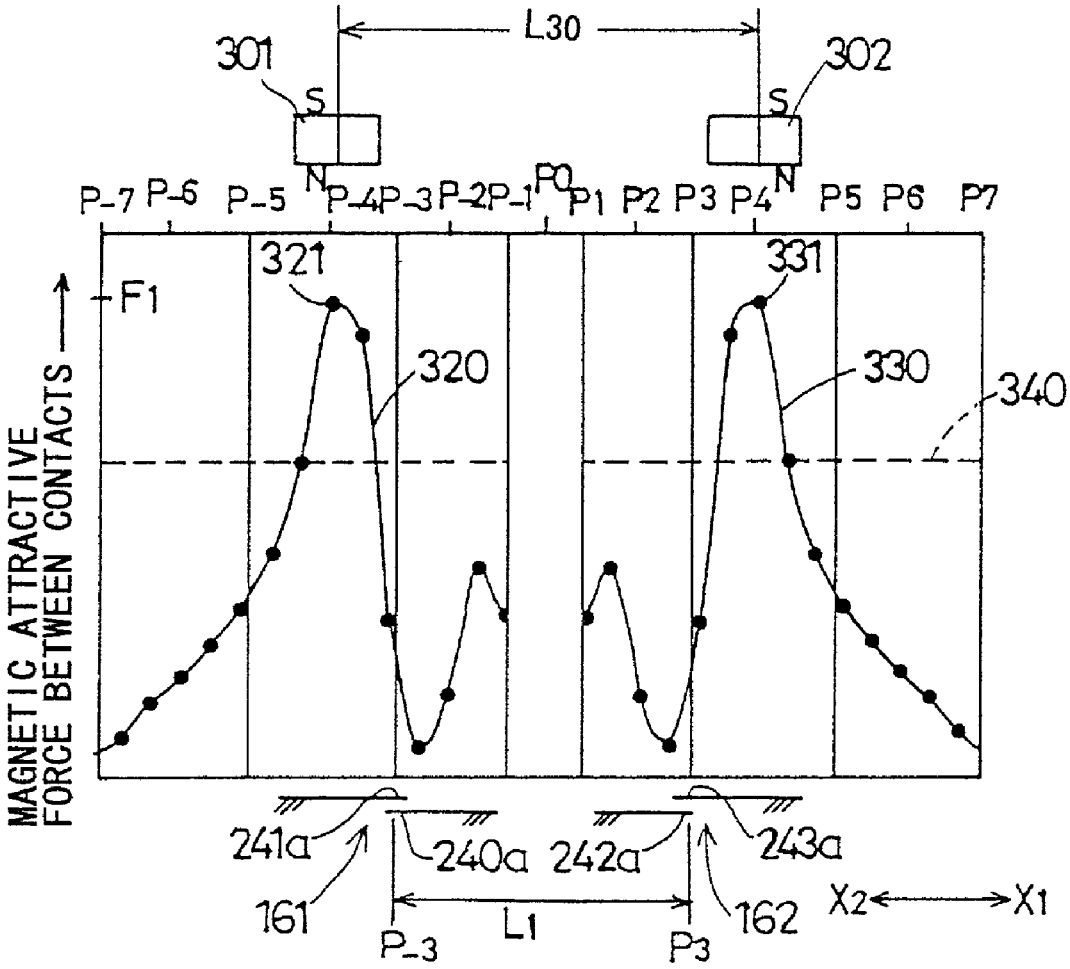
FIG. 23 is a graph showing magnetic attractive force acting on the switch part of FIGS. 22A and 22B with respect to positions of magnets having magnetic poles along the Z-direction.

FIG. 23 is a graph showing a result of a simulation of magnetic attractive force acting on contacts of a pair of reed pieces of a switch part with respect to positions along X1-X2 axis of the first and second magnets 301 and 302. It is to be noted that, along the Z1-Z2 axis, the first and second magnets 301 and 302 are placed near the switch 160.

In the graph, position P0 shows the central position of the external magnetic field generating unit 300 along the X1-X2 axis. Positions P1 through P7 are positions plotted at equal intervals from position P0 towards the X1-side. Positions P-1 through P-7 are positions symmetrical to positions P1 through P7 about position P0.

The first switch part 161 is positioned such that the contact part is at position P-3 and the second switch part 162 is positioned such that the contact part is at position P3.

When the first magnet 301 is positioned at positions P-1 through P-7, the magnetic attractive force exerted on the contact part of the first switch part 161 varies as shown by a line 320. A peak 321 appears at position P-4 that is offset from position P-3 towards the X2-direction.

When the second magnet 302 is positioned at positions P-1 through P-7, the magnetic attractive force exerted on the contact part of the second switch part 162 varies a shown by a line 330. A peak 331 appears at position P4 that is offset from position P3 towards the X1-direction.

Based on the result of the simulation, the external magnetic field generating unit 300 is configured such that the first magnet 301 is placed at position P-4 and the second magnet 302 is placed at position P4. That is to say, the first and second magnets 301 and 302 are separated such that a distance L30 between the center the first magnet 301 and the center of the second magnet 302 along the X1-X2 axis is greater than the distance L1 between the first and second switch parts 161 and 162.

It is to be noted that at the peaks 321 and 331, the magnetic attractive force is F1. Line 340 shows an operable level and when the magnetic attractive force is higher than the level shown by the line 340, the switch parts 162 and 162 are operated.

Figure 24:
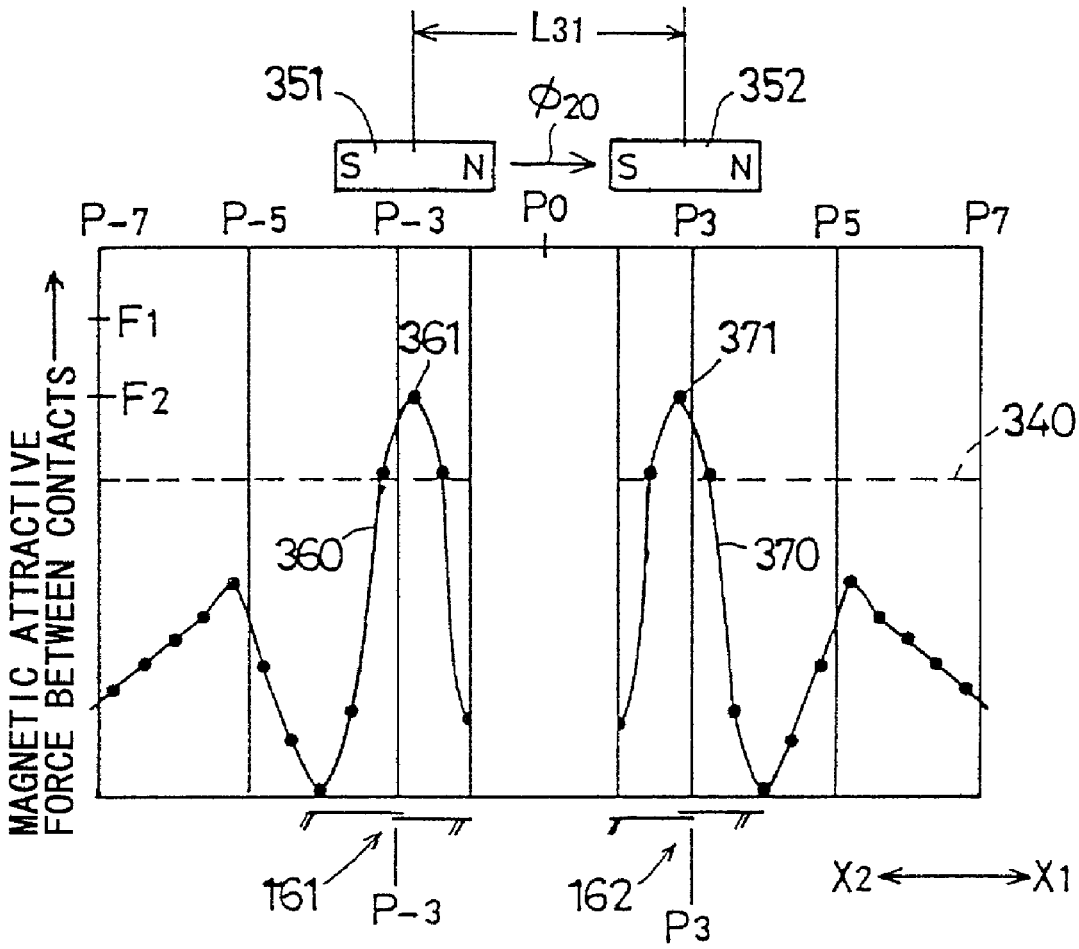
FIG. 24 is a graph showing magnetic attractive force acting on the switch part of FIGS. 22A and 22B with respect to positions of magnets having magnetic poles along the X-direction.

FIG. 24 is a graph showing a result of a simulation of magnetic attractive force acting on the switch part with respect to positions of magnets having magnetic poles along the X-direction. FIG. 24 corresponds to the case shown in FIG. 23.

When the first magnet 351 is positioned at positions P-1 through P-7, the magnetic attractive force exerted on the contact part of the first switch part 161 varies as shown by a line 360. A peak 361 appears at position P-3. When the second magnet 352 is positioned at positions P-1 through P-7, the magnetic attractive force exerted on the contact part of the second switch part 162 varies a shown by a line 370. A peak 371 appears at position P3. The magnetic attractive force F2 at the peaks 361 and 371 is lower than F1. The magnets 351 and 352 are positioned at positions P-3 and P3, respectively. The distance L31 between the magnets 351 and 352 is smaller than distance L30 mentioned above.

Comparing the result of simulation shown in FIG. 23 and the result of simulation shown in FIG. 24, it can be seen that the magnetic attractive force at the peak is greater in the case of the present invention where the magnets are disposed such that the magnetic poles are oriented in the Z-direction than in the case where the magnets are oriented in the X-direction. Accordingly, when the magnets are oriented in the Z-direction, the same effect can be obtained using magnets having smaller sizes.

Referring to FIGS. 22A and 22B, the first and second magnets 301 and 302 have reduced sized and thus the external magnetic field generating unit 300 has a reduced size.

The first and second magnets 301 and 302 may be of reduced sized because of the following reasons. When the magnets 351 and 352 are placed as shown in FIG. 24, the magnetic pole of one of the magnets opposes with the magnetic pole of the other one of the magnets. Therefore, there is a magnetic flux ϕ10 flowing from the magnet 351 to the magnet 352. Since the magnets 351 and 352 magnetically interfere with each other, the magnetic flux acting on the switch part will be weakened. On the other hand, when the magnets 301 and 302 are placed as shown in FIGS. 22A and 22B, there is less magnetic interference between the magnets 301 and 302. The first reason for this is that the magnetic poles do not oppose each other. The second reason is that the distance L30 between the magnet 301 and 302 is greater than the above-mentioned distance L31.

It is to be noted that the mold body 303 may be replaced by a casing.

Further, the switch 160 may also be operated with the magnets 301 and 302 being accommodated individually in the recessed parts of the electronic apparatus.

Figure 25A:
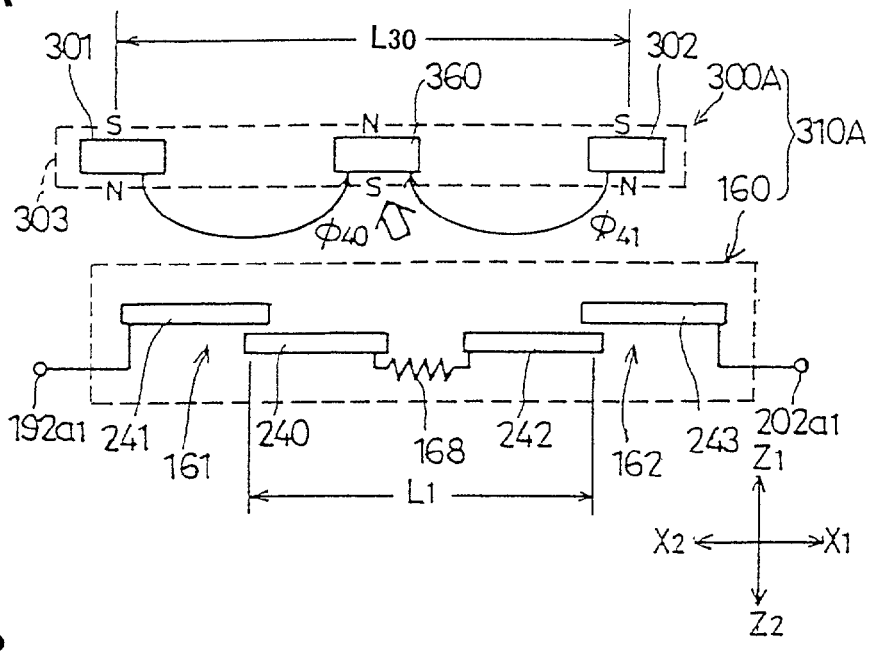
FIGS. 25A and 25B are diagrams showing a magnetic field generating unit of a second embodiment of the present invention together with a switch.
Figure 25B:
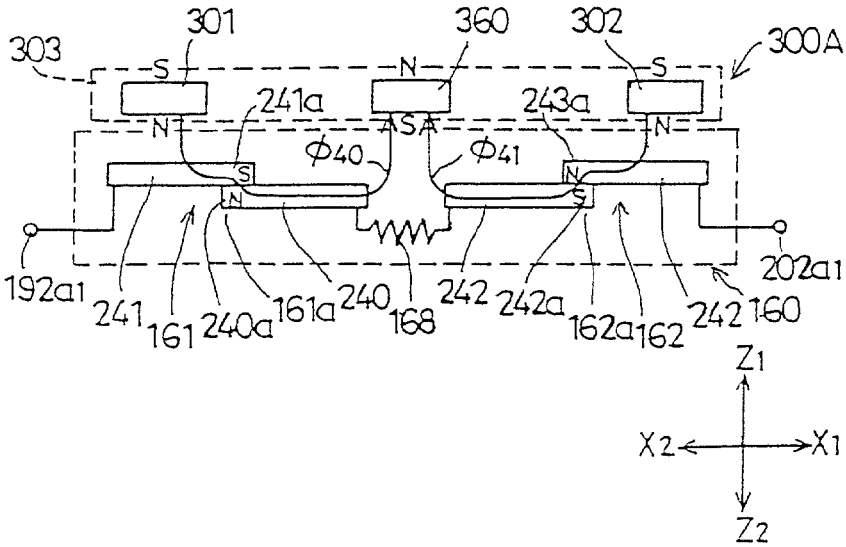

FIGS. 25A and 25B are diagrams showing a magnetic field generating unit 300A of a second embodiment of the present invention together with a switch.

As shown in FIG. 25A, the external magnetic field generating unit 300A is similar to the external magnetic field generating unit 300 shown in FIG. 22A except that a third magnet 360 is additionally provided.

The orientations of the magnetic poles of the first and second magnets 301 and 302 are the same. In the present embodiment, the Z2-side is an N-pole and the Z1-side is an S-pole. The third magnet 360 has an S-pole on the Z2-side and an N-pole on the Z1-side. In other words, the orientation of the third magnet 360 is opposite to the orientations of the first and second magnets 301 and 302. The third magnet 360 is placed at an intermediate position between the first magnet 301 and the second magnet 302.

A magnetic flux ϕ40 is generated between the first magnet 301 and the third magnet 360. A magnetic flux ϕ41 is generated between the second magnet 302 and the third magnet 360.

The switch 160 and the external magnetic field generating unit 300A constitute a switch device 310A. The magnetic flux ϕ40 generated by the first magnet 301 flows through the reed pieces 240 and 241 and the first switch part 161 becomes ON. The magnetic flux ϕ41 generated by the second magnet 302 flows through the reed pieces 242 and 243 and the second switch part 162 becomes ON.

The magnetic fluxes ϕ40 and ϕ41 flow through the reed pieces and terminate at the third magnet 360. Since the third magnet 360 is placed near the reed pieces, magnetic resistances of the magnetic paths through which the magnetic fluxes ϕ40 and ϕ41 flow will be lower than those of the external magnetic field generating unit 300 shown in FIG. 22B. Accordingly, the magnetic fluxes ϕ40 and ϕ41 efficiently act on the first and second switch parts 161 and 162, respectively.

Therefore, compared to the external magnetic field generating unit 300 shown in FIG. 22B, the external magnetic field generating unit 300 can cause an operation of the switch 150 in a more positive manner.

The first and second magnets 301 and 302 may be place such that the Z2-side is an S-pole and the Z1-side is an N-pole and the third magnet 360 may be placed such that the Z2-side is an N-pole and the Z1-side is an S-pole.

Figure 26A:
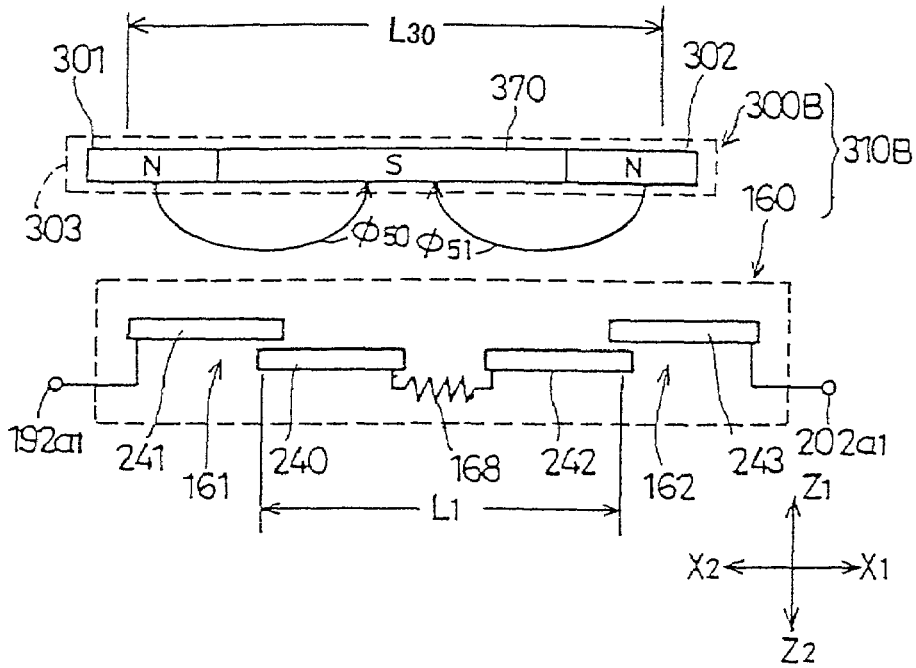
FIGS. 26A and 26B are diagrams showing a magnetic field generating unit of a third embodiment of the present invention together with a switch.
Figure 26B:
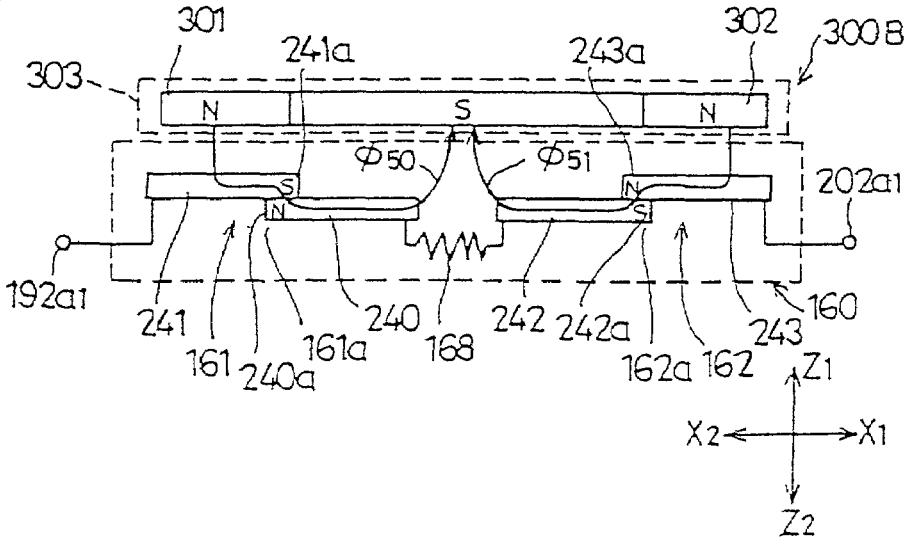

FIGS. 26A and 26B are diagrams showing a magnetic field generating unit 300B of a third embodiment of the present invention together with a switch.

As shown in FIG. 26A, the external magnetic field generating unit 300B is similar to the external magnetic field generating unit 300A shown in FIG. 25A except that the first, second and third magnets 301, 302 and 360 are replaced by a single magnet 370.

The magnet 370 is made of an elongated plate-like member that is magnetized such that N-S-N poles are provided on its Z2-side. The magnet 370 generates magnetic fields shown by magnetic fluxes ϕ50 and ϕ51.

The switch 160 and the external magnetic field generating unit 300B constitute a switch device 310B.

Referring to FIG. 26B, when the switch 160 approaches the external magnetic field generating unit 300B, the magnetic fluxes ϕ50 and ϕ51 flow through the first and second switch parts 161 and 162, respectively. Thus, the first and second switch parts 161 and 162 are closed.

Since the external magnetic generating unit 300B includes a single magnet 370, it compares advantageously to the external magnetic generating unit 300A in that the assembling process is easier and the cost is reduced.

The magnet 370 may be magnetized in the order of S-N-S poles.

Figure 27:
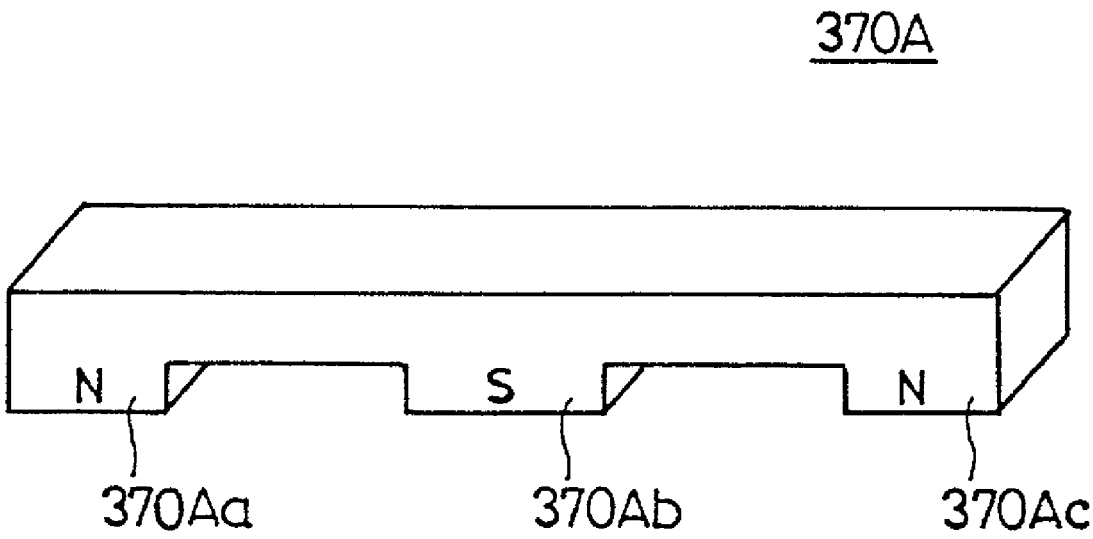
FIG. 27 is a diagram showing a variant of the magnet.

Instead of the magnet 370, the magnet 370A shown in FIG. 27 may be incorporate into the external magnetic generating unit 300B.

The magnet 370A has an E-shape with protruded parts 370Aa, 370Ab and 370Ac being magnetized in the order of N-S-N poles. Since portions to be magnetized are the protruded parts 370Aa, 370Ab and 370Ac, a magnetization process is easier compared to the case of the magnet 370.

Figure 28A:
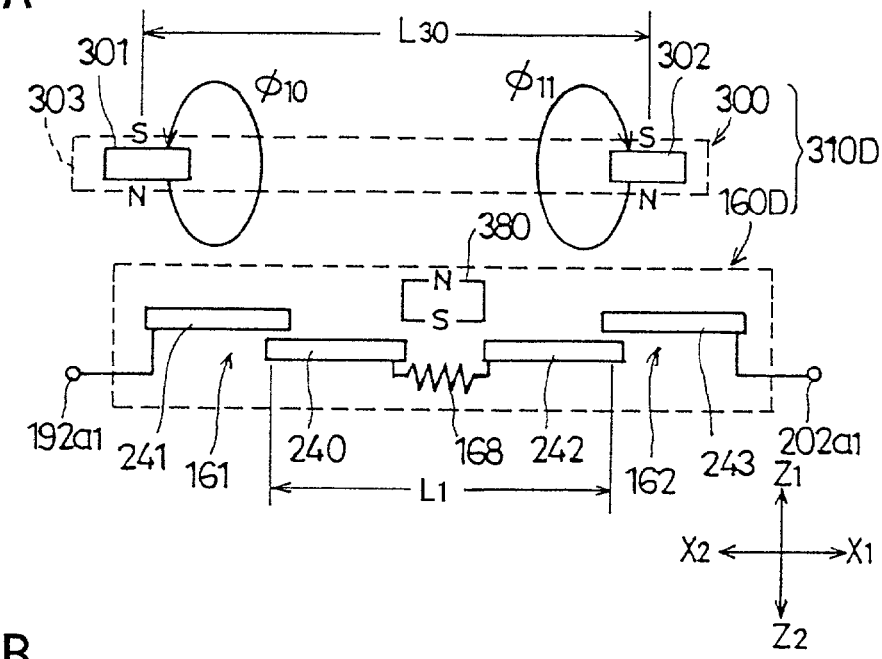
FIGS. 28A and 28B are diagrams showing a typical embodiment of a switch device of the present invention.

A typical embodiment of a switch device of the present invention will be described with reference to FIGS. 28A and 28B. Hereinafter, the switch device may also be referred to as "a switch device". FIG. 28A is a diagram showing a switch device 310D of a typical embodiment of the present invention. A switch 160D and the external magnetic field generating unit 300 constitute a switch device 310D.

The external magnetic field generating unit 300 has a structure shown in FIG. 22A.

The switch 160D is similar to the switch 160 shown in FIGS. 17 and 22A except that a magnet 380 is also incorporated therein.

The magnet 380 has an S-pole on the Z2-side and an N-pole on the Z1-side. The magnet 380 is provided between the first and second switches 161 and 162. The orientation of magnetic poles of the magnet 380 is opposite to the orientation of the magnetic poles of the first and second magnets 301 and 302.

Figure 28B:
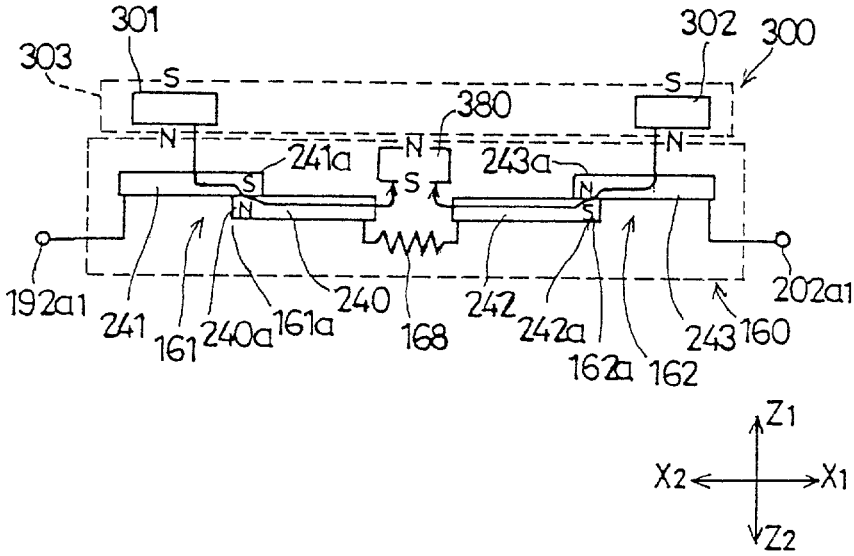

Referring to FIG. 28B, when the switch 160D approaches the external magnetic field generating unit 300, the first and second switch parts 161 and 162 oppose the first and second magnets 301 and 302, respectively. The magnetic flux ϕ10 generated by the first magnet 301 flows through the reed pieces 240 and 241 and finally reaches the magnet 380. Thus, the first switch part 161 is closed. The magnetic flux ϕ11 generated by the second magnet 302 flows through the reed pieces 242 and 243. After passing through the reed piece 242, the magnetic flux ϕ11 finally reaches the magnet 380. Thus, the second switch part 162 is closed.

When the first magnet 301 is placed in an opposite manner, i.e., the Z2-side is an N-pole and the Z1-side is an S-pole, the magnetic flux will not flow through the reed pieces 241 and 240. Therefore, the first switch part 161 does not operate and remains OFF. When the second magnet 302 is placed in an opposite manner, i.e., the Z2-side is an N-pole and the Z1-side is an S-pole, the magnetic flux will not flow through the reed pieces 243 and 242. Therefore, the second switch part 162 does not operate and remains OFF.

Therefore, the orientation of magnetic poles of the magnet 380 in the switch 160D serves to determine a unique orientation of the magnetic poles of the first and second magnets 301 and 302 in the switch 300.

When the magnet 380 is configured such that its Z2-side is an N-pole and its Z1-side is an S-pole, the first and second magnets 301 and 302 should be configured such that their Z2-sides are S-poles and their Z1-sides are N-poles.

Accordingly, the operational condition of the switch 160D is restricted to a case where the polarities of the first and second magnets 301 and 302 should be placed in the same and particular orientations. That is to say, the switch 160D has functions of recognizing and certifying that the first and second magnets 301 and 302 have polarities of the same and particular orientations. Therefore, compared to the switch shown in FIG. 17, the switch 160A has an improved effect when used for applications requiring a secure operation. For example, the external magnetic field generating unit 300 may be incorporated in the electronic apparatus main body and the switch 160D may be incorporated in a battery pack.

Figure 29A:
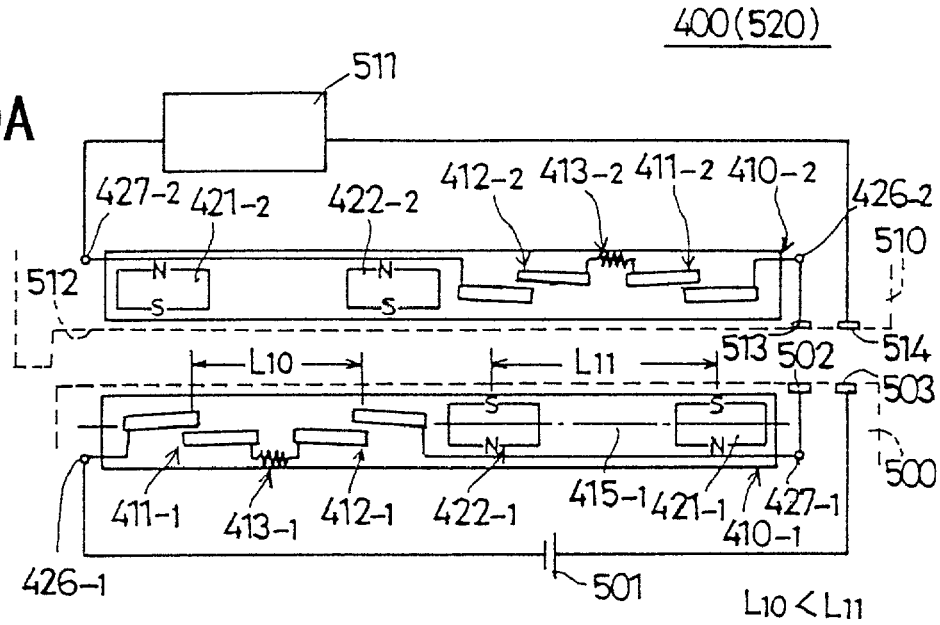
FIGS. 29A and 29B are diagrams showing a first embodiment of a switch device of the present invention.
Figure 29B:
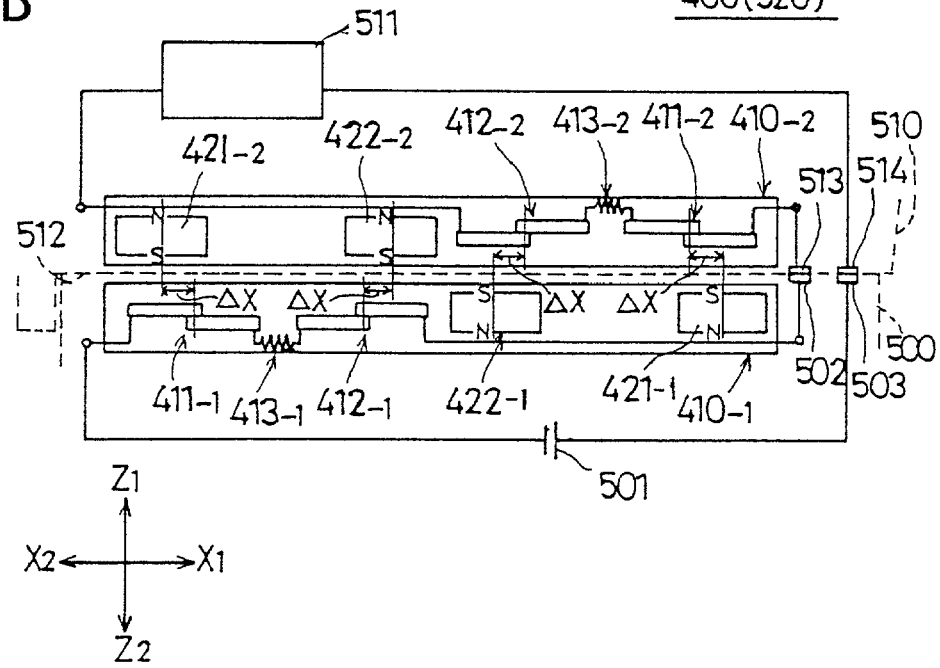

FIGS. 29A and 29B are diagrams showing a first embodiment of a switch device 400 of the present invention. The switch device 400 includes a first switch unit 410-1 and a second switch unit 410-2. Reference numerals indicate an electronic apparatus that includes an electronic apparatus main body 510 and a battery pack 500.

The first switch unit 410-1 is incorporated in the battery pack 500 and the second switch unit 410-2 is incorporated in the electronic apparatus main body 510 such that, when the battery pack 500 is loaded in the electronic apparatus main body 510, the first switch unit 410-1 is in proximity with and opposite to the second switch unit 410-2.

Figure 30:
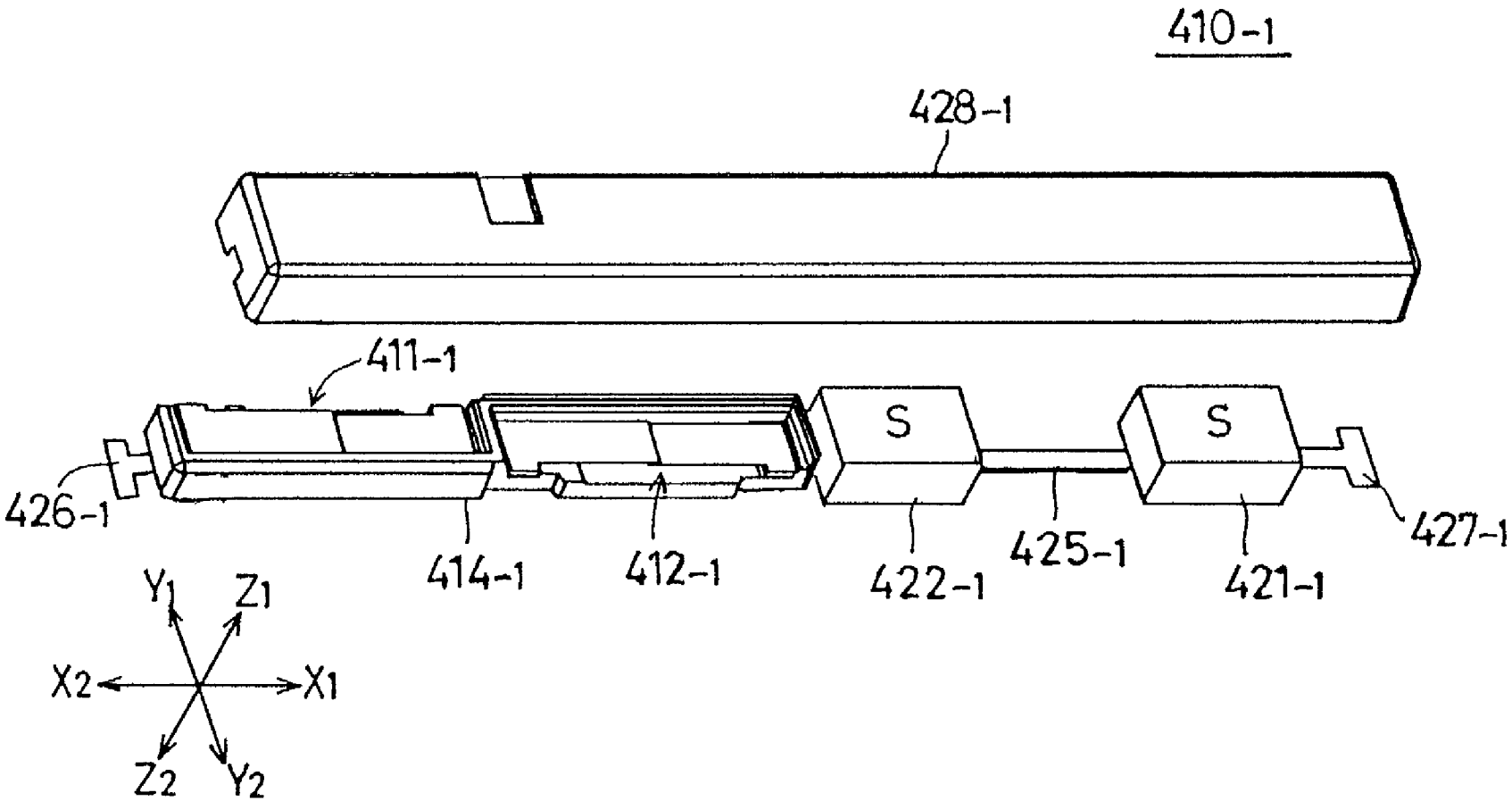
FIG. 30 is a diagram showing a first switch of the switch device shown in FIGS. 29A and 29B.

FIG. 30 is an exploded diagram showing the first switch unit 410-1 of the switch device 400 shown in FIGS. 29A and 29B. In the figures, arrows X1 and X2 indicate longitudinal directions, Y1 and Y2 indicate width-wise directions and Z1 and Z2 indicate height-wise directions of the first switch unit 410-1. A second switch part 412-1, a second magnet piece 422-1 and a first magnet pieces 421-1 are aligned in order from the X2-side to the X1-side of the figure, a first switch part 411-1 on a line 425-1. The first and second switch parts 411-1 and 421-1 are attached to a mold base 414-1 with the respective contact parts being spaced apart with a distance L10 along the X1-X2 axis and are serially connected via a connection member 413-1 that is electrically conductive and is non-magnetic. The first and second magnet pieces 421-1 and 422-1 are both provided with S-poles on their upper surfaces and N-poles on their lower surfaces. The centers of the first and second magnets 421-1 and 422-1 are spaced apart by a distance L11 along the X1-X2 axis. The distance L11 is slightly greater than the distance L10. An elongated piece 425-1 made of a material such as a copper alloy starts from the second switch part 412-1 and extends under the first and second magnet pieces 421-1 and 422-1 in the X2-direction from the mold base 414-1. The elongated piece 425-1 may be made of a material other than a copper alloy as long as it is electrically conductive and is non-magnetic. Terminal parts 426-1 and 427-1 are also provided for mounting the switch device on a PCB. The terminal part 426-1 is connected to the first switch part 411-1. The terminal part 427-1 is formed at a tip of the elongated piece 425-1. The mold base 414-1, the first magnet 421-1 and the second magnet 422-1 are covered with a mold cover 428-1.

Figure 36A:
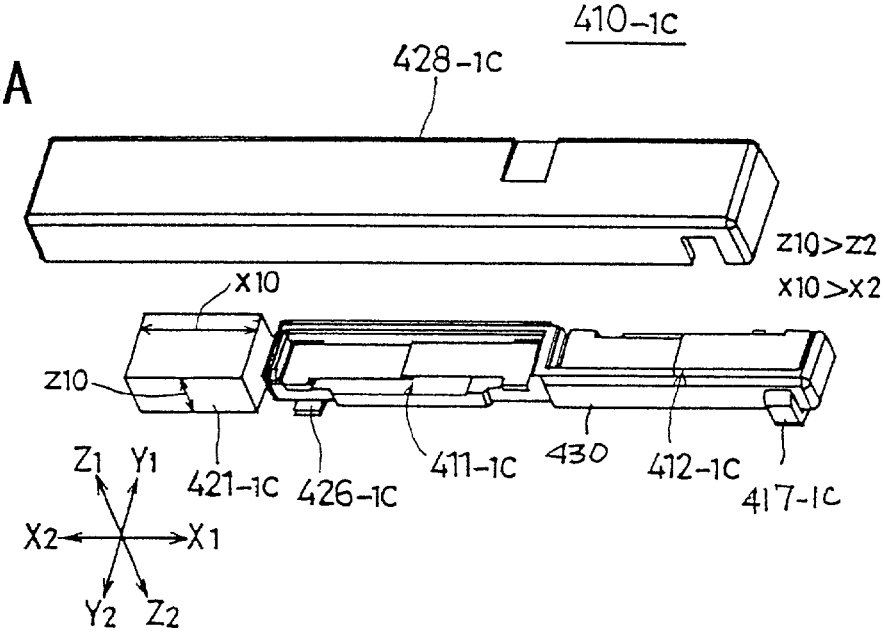
FIGS. 36A and 36B are diagrams showing a first switch of the switch device shown in FIGS. 35A and 35B.
Figure 36B:
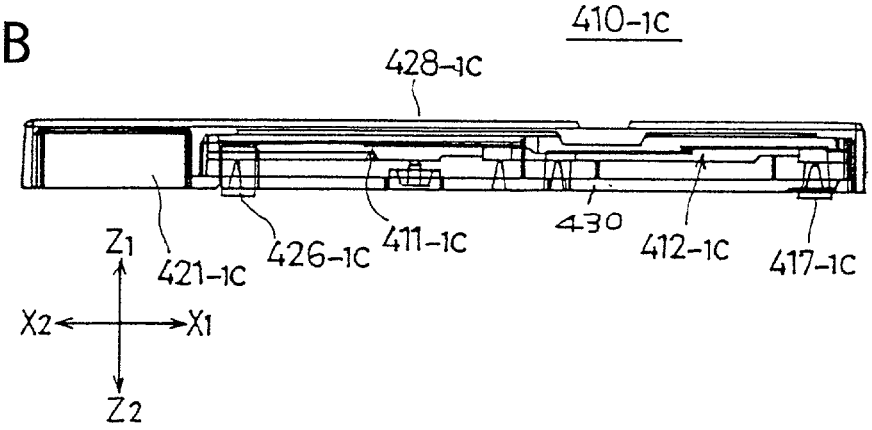
Figure 37A:
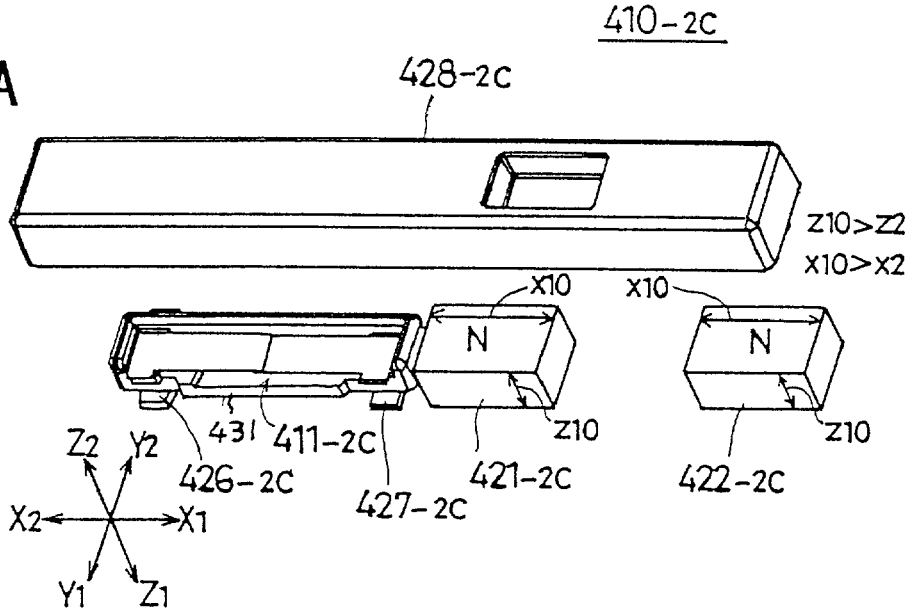
FIGS. 37A and 37B are diagrams showing a second switch of the switch device shown in FIGS. 35A and 35B.
Figure 37B:
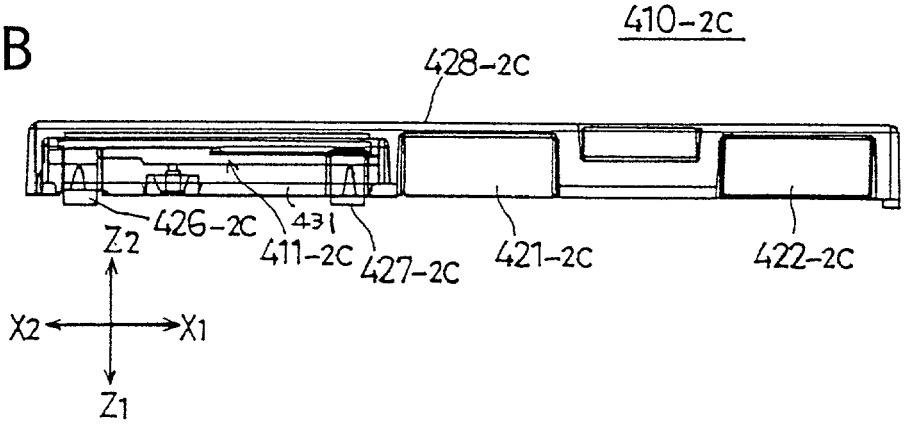

The mold base 414-1, the first magnet 421-1 and the second magnet 422-1 are positioned by being engaged with recessed parts formed inside the mold cover 428-1 (see FIGS. 36B and 37B).

The second switch part 412-1 and the second magnet 422-1 are adjacent to each other and the magnetic flux generated by the second magnet 422-1 acts on the second switch part 412-1. However, since the second switch part 412-1 is placed at a position corresponding to a center position along the thickness of the second magnet 422-1, the magnetic flux acting on the second switch part 412-1 is oriented along the Z1-Z2 axis and does not contain any substantial magnetic component along the X1-X2 axis. The magnetic flux flows across the reed piece mainly in the thickness-wise direction of the reed piece and there is a slight magnetic flux flowing in the longitudinal direction of the reed pieces. Therefore, the tip of the reed piece will not be substantially magnetized and the second switch part 412-1 remains OFF.

The battery pack 500 includes a rechargeable battery 501 provided therein and a pair of terminals 502 and 503 provided on its surface connected to electrodes of a battery main body 510. The first switch unit 410-1 is surface mounted on a PCB (not shown) in the battery pack 500. Electrically, the first switch unit 410-1 is connected between the battery 501 and the terminal 502 with a terminal part 426-1 being connected to the battery 501 and a terminal part 427-1 being connected to the terminal 502.

When the battery pack 500 is handled alone and is placed in a bag or in a pocket, the first and second switch part 411-1 and 412-1 are both OFF and therefore the voltage of the battery 501 is not applied between the terminals 502 and 503. Therefore, even in case where the terminals 502 and 503 are connected by electrically conductive items such as paper clips or chains in the bag or pocket, no current flows between the terminals 502 and 503. Therefore, such a battery pack 500 is safe since a short circuit does not occur.

The second switch unit 410-2 has a same configuration as the first switch unit 410-1 described above and elements corresponding to those of the first switch unit 410-1 are indicated by same reference numerals accompanied by a subscript "–2".

The electronic device main body 510 includes components such as a liquid crystal device 511 provided therein and a pair of terminals 513 and 514 provided in a battery pack accommodating part 512 where the battery pack 500 is loaded. Other than the liquid crystal device 511, components such as a vibration motor and a loud speaker may be provided inside the electronic device main body 510 as components operated by the battery pack 500. The second switch unit 410-2 is provided such that its position is reversed along the Z1-Z2 axis and the X1-X2 axis with respect to the first switch unit 410-1. The second switch unit 410-2 is surface mounted on a PCB (not shown) in the electronic device main body 510. Electrically, the terminal part 427-2 is connected to the liquid crystal device 511 and the terminal part 426-2 is connected to the terminal 513. The terminal 514 is connected to the liquid crystal device 511. The first and second switches 411-1 and 412-2 are both in an OFF state.

The following description relates to a case where an appropriate battery pack 500 is loaded in the electronic device main body 510 and a case where an inappropriate battery pack is loaded in the electronic device main body 510.

(1) Case where an appropriate battery pack 500 is loaded in the electronic device main body 510:

The battery pack 500 is loaded in the electronic device main body 510 as shown in FIG. 29B. The first switch unit 410-1 opposes the second switch unit 410-2 and the terminals 501 and 503 contact terminals 513 and 514, respectively.

The first and second magnet pieces 421-1 and 422-1 of the first switch unit 410-1 oppose the first and second switch parts 411-2 and 412-2 of the second switch unit 410-2, respectively. Thus, the first and second switch parts 411-2 and 412-2 are closed. Also, the first and second magnet pieces 411-1 and 412-1 of the first switch unit 410-1 oppose the first and second magnet pieces 421-2 and 422-2 of the second switch unit 410-2, respectively. Thus, the first and second switch parts 411-1 and 412-1 are closed.

Accordingly, the voltage of the battery 501 is applied between the terminals 502 and 503 via the first switch unit 410-1. Further, this voltage is applied to the liquid crystal device 511 via the second switch unit 410-2 and the electronic main body 510 will be in an operable state.

In this embodiment, since there is a relationship L10<L11, the central line along the Z1-Z2 axis of the magnet pieces 421-1, 422-1, 421-2 and 422-2 and the central line along the Z1-Z2 axis of the switch parts 411-2, 412-2, 411-1 and 412-1 are offset by ΔX along the Z1-Z2 axis. Therefore, as has been described above with reference to FIG. 23, magnetic attractive forces are efficiently generated between tips of pairs of reed pieces of each switch part 411-2, 412-2, 411-1 and 412-1. Thus, the switch parts 411-2, 412-2, 411-1 and 412-1 will operate in a positive manner.

That is to say, as for the battery pack 500, after recognition of the loaded electronic device being an appropriate electronic device main body 510, a voltage is applied between the terminals 502 and 503. Regarding the electronic device main body 510, after recognition of the loaded battery pack being a normal battery pack 500, a circuit is formed between the liquid crystal device 511 and the terminal 513.

(2) Case where an inappropriate battery pack is loaded in the electronic device main body 510:

An inappropriate battery pack refers to a battery pack having the same shape and size as the above-described battery pack 500 but not incorporating the first switch 410. Such an inappropriate battery pack may be a so-called pirated battery pack.

The inappropriate battery pack is loaded in the electronic device main body 510 in a similar to the normal battery pack 500, and a voltage is applied between the terminals 513 and 514. However, the switch parts 411-2 and 412-2 are not closed and remain in an OFF state. A circuit is not formed between the liquid crystal device 511 and the terminal 513. Accordingly, the electronic device main body 510 blocks a voltage supply from the inappropriate battery pack.

In such a manner, an occurrence of failure such as a breakage of an electronic device caused when driven by an inappropriate battery with shortage or excess of electronic power can be prevented.

When the electronic apparatus main body 510 is a recharging device, a recharging operation is not performed on an inappropriate battery.

In the following, other embodiments will be described. In the following description, configuration and effects similar to those of the switch device 400 of the first embodiment will not explained in detail or will be omitted.

Figure 31A:
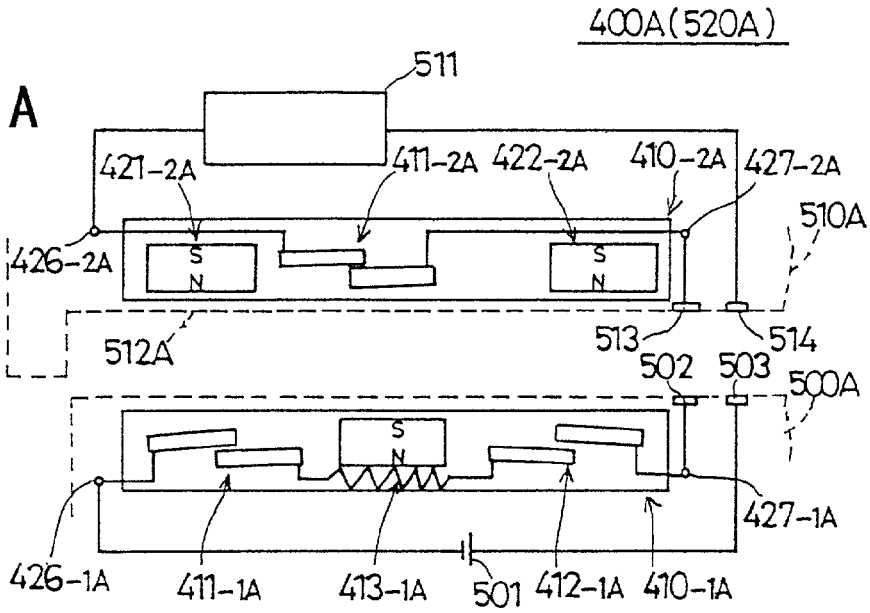
FIGS. 31A and 31B are diagrams showing a second embodiment of a switch device of the present invention.

FIG. 31A is a diagram showing a second embodiment a switch device 400A of the present invention. The first switch unit 410-1A and the second switch unit 410-2A constitute a switch device 400A. As compared to the switch device 400 shown in FIG. 29A, the switch 410 has a reduced length along the Z1-Z2 axis and thus provides a reduced sized switch device 400A. An electronic device 520A includes an electronic apparatus main body 510A and a battery pack 500A.

Figure 32A:
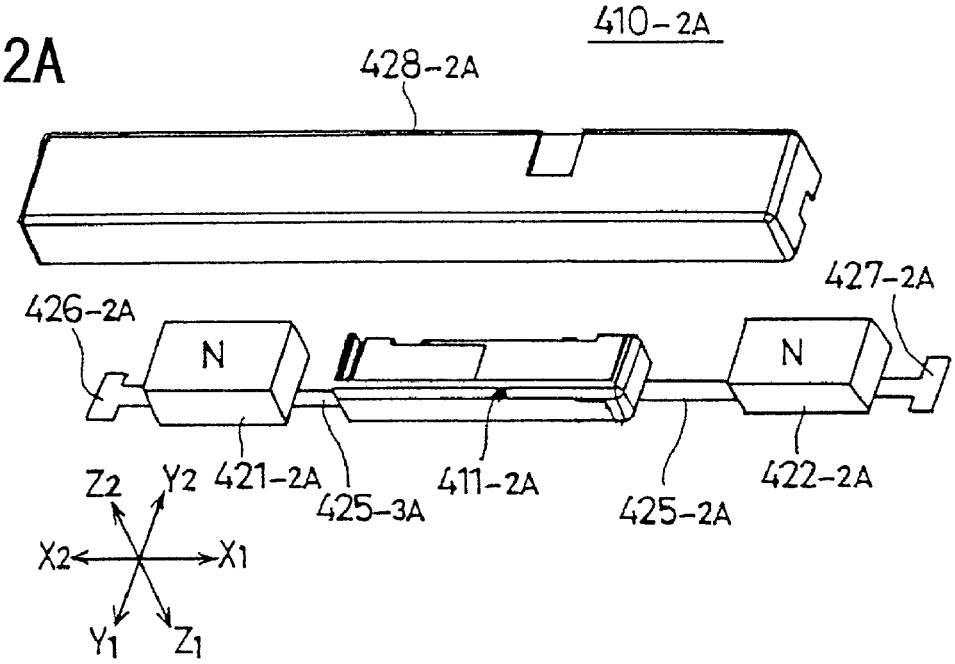
FIGS. 32A and 32B are diagrams showing switches of the switch device shown in FIG. 31.
Figure 32B:
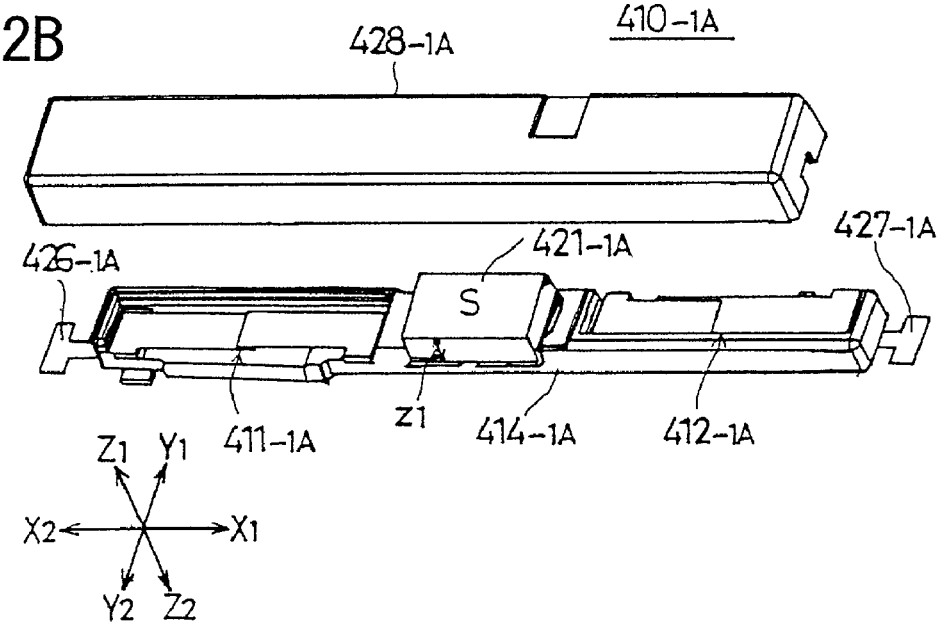

As is also shown in FIG. 32B, the first switch unit 410-1A includes a first switch part 411-1A, a first magnet 421-1A and a second switch part 412-1A aligned in order from the X2-side to the X1-side and attached on the mold base 414-1A. All the elements are covered with a mold cover 428-1A. The first and second switch parts 411-1A and 412-1A are serially connected via a connecting member 413-1A extending under the first magnet piece 421-1A. The first magnet piece 421-1A is provided with an S-pole on its upper surface and an N-pole on its lower surface. The switch 410-1A is provided with a terminal part 426-1A for surface mounting at the X1-side end, which is connected to the first switch part 411-1A and a terminal part 427-1A for surface mounting at the X2-side end, which is connected to the second switch part 412-1A.

As is also shown in FIG. 32A, the second switch unit 410-2A includes a first magnet piece 421-2A, a first switch part 411-2A and a second magnet piece 422-2A aligned in order from the X2-side to the X1-side and attached on the mold base 414-1A. All the elements are covered with a mold cover 428-2A. The first and second magnet pieces 421-2A and 422-2A are both provided with N-poles on their sides opposing the mold cover 428-2A and S-poles on the other sides. Elongated pieces 425-2A and 425-3A made of a material such as a copper alloy start from the first switch part 411-2A in the X1-direction and in the X2-direction and extend under the first and second magnets 421-2A and 422-2A and have terminal parts 426-2A and 427-2A on the tips which are provided for mounting purpose.

As shown in FIG. 31A, the first switch unit 410-1A is incorporated in a battery pack 500A and is connected to the battery 401 and terminals 502, 303. The second switch unit 410-2A is incorporated in the electronic device main body 510 and is, for example, connected to components such as a liquid crystal device 511.

The following description relates to a case where an appropriate battery pack 500A is loaded in the electronic device main body 510A and a case where an inappropriate battery pack is loaded in the electronic device main body 510A.

Figure 31B:
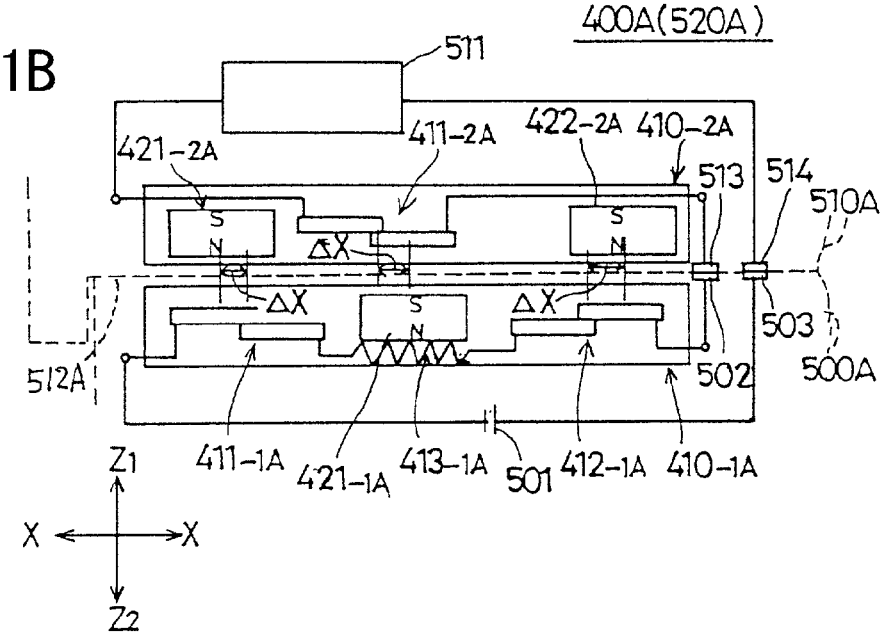

(1) Case where an appropriate battery pack 500A is loaded in the electronic device main body 510A:

As shown in FIG. 31B, the first magnet piece 421-1A of the first switch unit 410-1A opposes the second switch part 411-2A of the second switch unit 410-2A and the first switch part 411-2A is closed. The first and second switch parts 411-1A, 412-1A of the first switch unit 410-1A oppose the magnet pieces 421-2A, 422-2A of the second switch unit 410-2A, respectively, and the first and second switch parts 411-1A, 412-1A are closed.

Thus, the battery pack 500A, after recognition of the loaded electronic device being an appropriate electronic device main body 510A, applies a voltage between the terminals 502 and 503. Regarding the electronic device main body 510A, after recognition of the loaded battery pack being a normal battery pack 500, a circuit is formed between the liquid crystal device 511 and the terminal 513. Thus the electronic device main body 510A is switched to an operable state.

(2) Case where an inappropriate battery pack is loaded in the electronic device main body 510A:

The inappropriate battery pack is loaded in the electronic device main body 510A in a manner similar to the normal battery pack 500A, and a voltage is applied between the terminals 513 and 514. However, the switch part 412-2B is not closed and remains in an OFF state. A circuit is not formed between the liquid crystal device 511 and the terminal 513. Accordingly, the electronic device main body 510A blocks a voltage supply from the inappropriate battery pack.

In the present embodiment, the first switch unit 410-1A is configured such that along the X1-X2 axis, the first magnet piece 421-1A is provided on the center, the first switch part 421-1A is provided on the X2-side of the first magnet piece 421-1A and the second switch part 412-1A is provided on the X1-side. That is to say, the first switch unit 410-1A is symmetrical about the first magnet piece 421-1A. The second switch 420-2A is configured such that along the X1-X2 axis, the first switch part 411-2A is provided on the center, the first magnet piece 421-2A is provided on the X2-side of the first switch part 411-2A and the second magnet piece 422-2A is provided on the X1-side. That is to say, the second switch unit 410-2A is symmetrical about the first switch part 411-2A. Therefore, the first switch unit 410-1A operates properly even if the first switch unit 410-1A is positioned with an opposite orientation along the X1-X2 axis. That is to say, for the first and second switches 410-1A and 410-2A, there is no constraint for orientations along the X1-X2 axis. With any orientation along the X1-X2 axis, the first and second switches 410-1A and 410-2A operate in a similar manner as the embodiment described above. Therefore, the first and second switches 410-1A and 410-2A may be incorporated in the battery pack 500A and the electronic device main body 510A without considering the orientations along the X1-X2 axis. Therefore, an assembly process is facilitated.

Figure 33A:
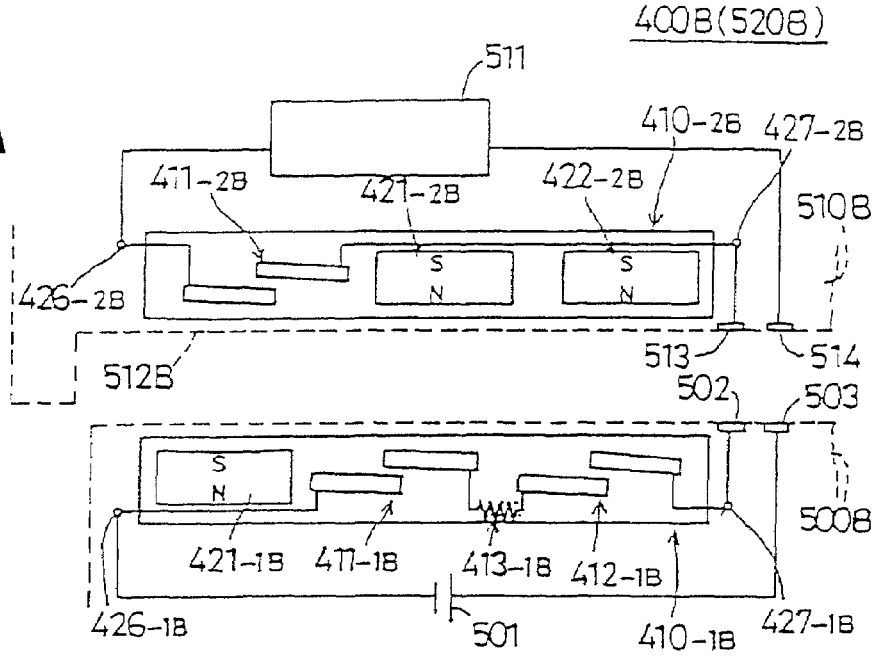
FIGS. 33A and 33B are diagrams showing a third embodiment of a switch device of the present invention.
Figure 33B:
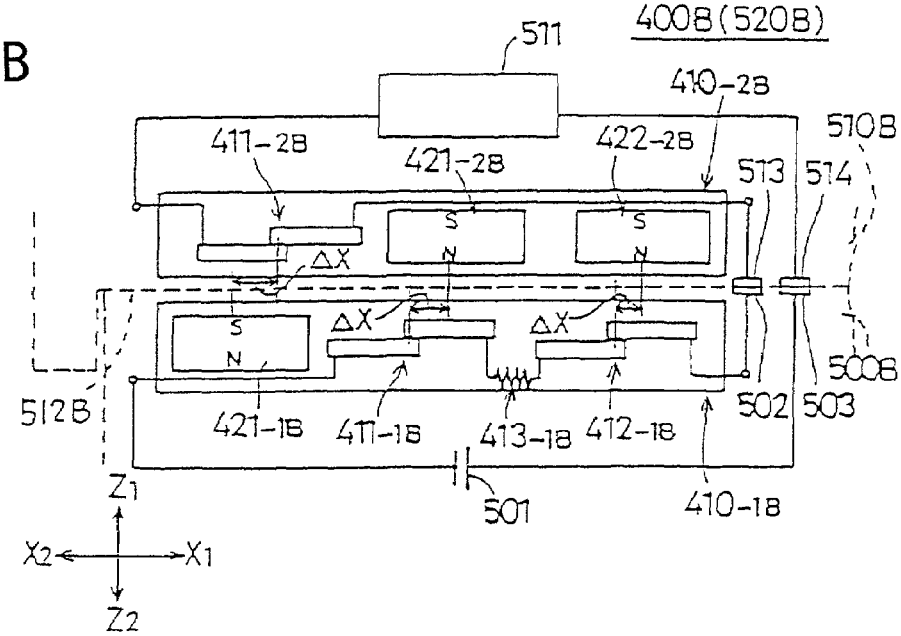

FIGS. 33A and 33B are diagrams showing a third embodiment of a switch device 400B of the present invention.

The switch device 400B includes the first switch unit 410-1B and the second switch unit 410-2B. Compared to the second embodiment, the first switch unit 410-1B has the same external size and the first magnet piece 421-1B has a greater size. An electronic device 520B includes an electronic device main body 510B and a battery pack 500B.

Figure 34A:
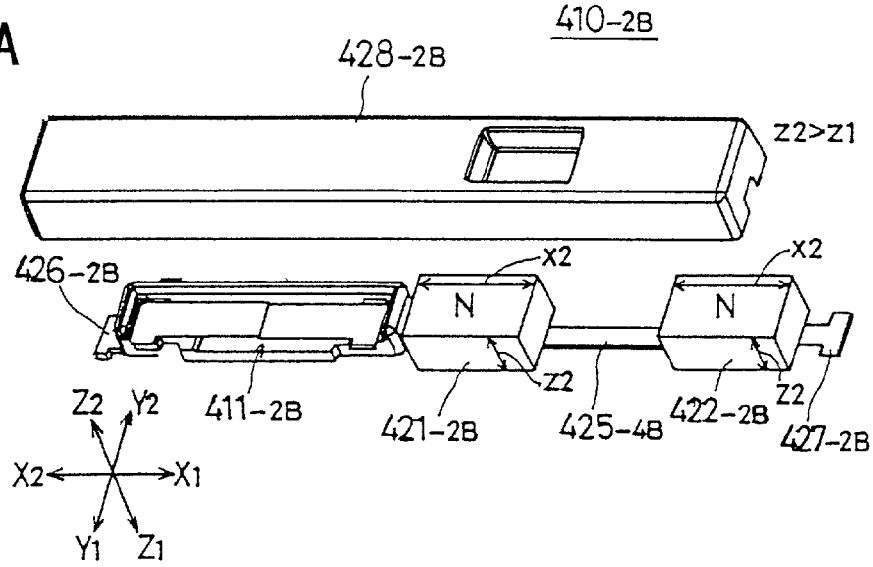
FIGS. 34A and 34B are diagrams showing switches of the switch device shown in FIGS. 33A and 33B.
Figure 34B:
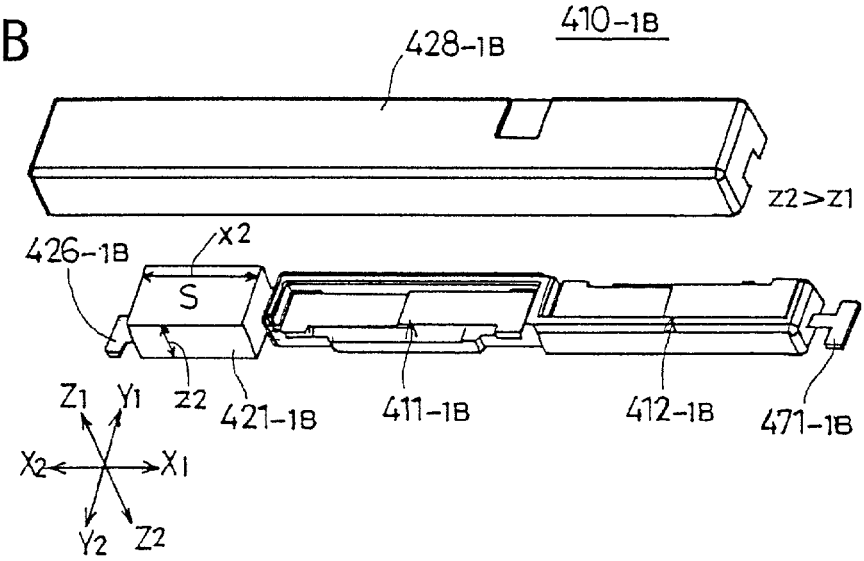

As is also shown in FIG. 34B, the first switch unit 410-1B includes a first magnet piece 421-1B, a first switch part 411-1B, and a second switch part 412-1B aligned in order from the X2-side to the X1-side and are covered with a mold cover 428-1B. The first and second switch parts 411-1B and 412-1B are serially connected via a connecting member 413-1B. The size z2 of the first magnet piece 421-1B along the Z1-Z2 axis is greater than the size zl of the corresponding first magnet piece 421-1A in the first switch unit 410-1A of the above-described second embodiment. This is because the first magnet piece 421-1B is placed at a position separate from the connecting member 413-11B. Since the size of the first magnet piece 421-1B is greater than the size of the above-mentioned first magnet piece 421-1A, the first magnet piece 421-1B generates a stronger magnetic field than the above-mentioned first magnet piece 421-1A. The size of the first magnet 421-1B is substantially the same as the sizes of first and second magnet pieces 421-2B and 422-2B, which will be described later.

As is also shown in FIG. 34A, the second switch unit 410-2B includes a first switch part 411-2B, a first magnet piece 421-2B and a second magnet piece 422-2B aligned in order from the X2-side to the X1-side and are covered with a mold cover 428-2B. An elongated piece 425-4B made of a material such as a copper alloy starts from the first switch part 411-2B in the X1-direction and extends under the first and second magnet pieces 421-2B and 422-2B.

As shown in FIG. 33A, the first switch unit 410-1B is incorporated in a battery pack 500B and is connected to the battery 401 and terminals 502, 303. The second switch unit 410-2B is incorporated in the electronic device main body 510B and is, for example, connected to components such as a liquid crystal device 511 and to terminals 513, 514.

The following description relates to a case where an appropriate battery pack 500B is loaded in the electronic device main body 510B and a case where an inappropriate battery pack is loaded in the electronic device main body 510B.

(1) Case where an appropriate battery pack 500B is loaded in the electronic device main body 510B:

As shown in FIG. 33B, the first magnet piece 421-1B of the first switch unit 410-1B opposes the second switch part 411-2B of the second switch unit 410-2B and the first switch part 411-2B is closed. The first and second switch parts 411-1B, 412-1B of the first switch unit 410-1B oppose the magnet pieces 421-2B, 422-2B of the second switch unit 410-2B, respectively, and the first and second switch parts 411-1B, 412-1B are closed.

Thus, the battery pack 500B, after recognition of the loaded electronic device being an appropriate electronic device main body 510B, applies a voltage between the terminals 502 and 503. Regarding the electronic device main body 510B, after recognition of the loaded battery pack being a normal battery pack 500B, a circuit is formed between the liquid crystal device 511 and the terminal 513. Thus the electronic device main body 510B is switched to an operable state.

In this embodiment, since the size of the first magnet 421-1B is increased, the first switch part 411-2B is closed with an improved reliability compared to the above-described second embodiment in which the first magnet piece 421-1A opposes.

(2) Case where an inappropriate battery pack is loaded in the electronic device main body 510B:

The inappropriate battery pack is loaded in the electronic device main body 510B in a manner similar to the normal battery pack 500B, and a voltage is applied between the terminals 513 and 514. However, the switch part 411-2C is not closed and remains in an OFF state. A circuit is not formed between the liquid crystal device 511 and the terminal 513. Accordingly, the electronic device main body 510B blocks a voltage supply from the inappropriate battery pack.

Figure 35A:
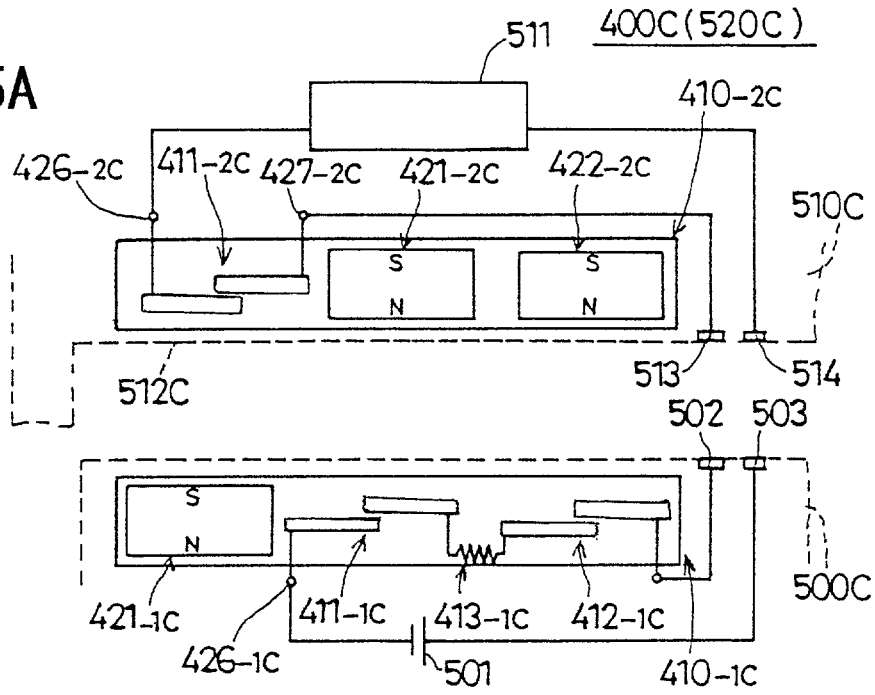
FIGS. 35A and 35B are diagrams showing a fourth embodiment of a switch device of the present invention.
Figure 35B:
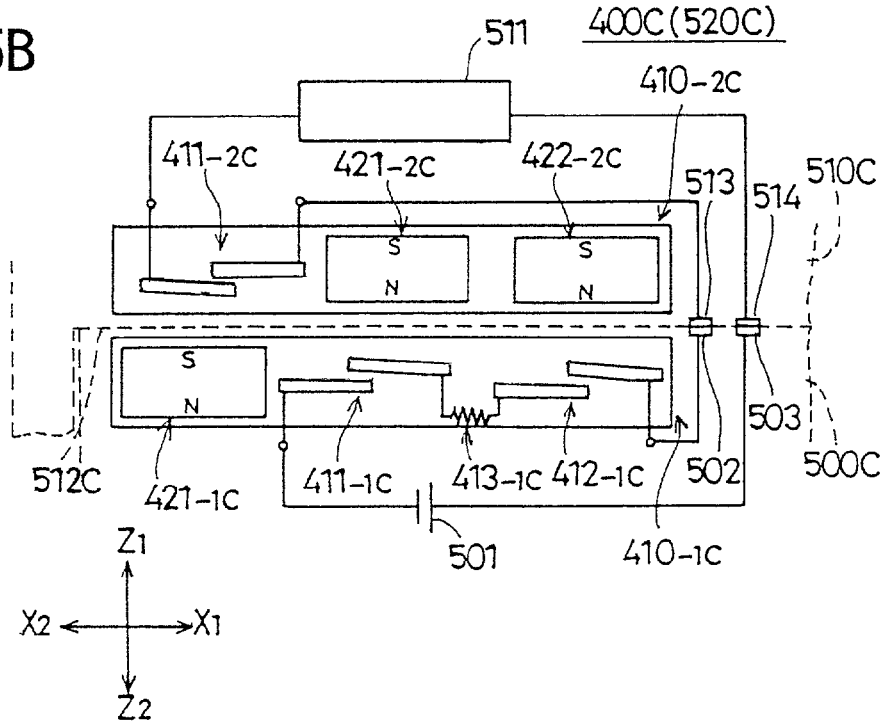

FIGS. 35A and 35B are diagrams showing a fourth embodiment of a switch device 400C of the present invention.

The switch device 400C includes the first switch unit 410-1C and the second switch unit 410-2C. Compared to the third embodiment, the magnet pieces 421-1C, 421-2C and 422-2C have greater sizes. An electronic device 520C includes an electronic device main body 510C and a battery pack 500C.

As is also shown in FIGS. 36A and 36B, the first switch unit 410-1C includes a first magnet piece 421-1C, a first switch part 411-1C, and a second switch part 412-1C aligned in order from the X2-side to the X1-side and are covered with a mold cover 428-1C. The first and second switch parts 411-1C and 412-1C are serially connected via a connecting member 413-1C. The first and second switch parts 411-1C, 412-1C and the connecting member 413-1C are supported on an insert mold base 430. A terminal part 426-1C for mounting purpose protrudes from the X2-side end of the first switch part 411-1C to the Y2-side and is bent in the Z2-direction and further in the Y2-direction so as to be exposed on the Z2-side surface which is a back surface of the insert mold base 430. Another terminal part 427-1C for mounting purpose protrudes from the X1-side end of the second switch part 412-1C to the Y2-side and is bent in the Z2-direction and further in the Y1-direction so as to be exposed on the Z2-side surface which is a back surface of the insert mold base 430.

In the present embodiment, since the terminal part 426-1C is protruded from the side surface of the insert mold base 430 and is exposed on the back surface side, the size of the magnet piece 421-1C is not limited by the terminal part 426-1C. Therefore, the magnet piece 421-1C has a dimension z10 that is greater than the dimension z2 and a dimension x10 that is greater than the dimension x2 and thus has a size greater than the magnet piece 421-1B.

As is also shown in FIGS. 37A and 37B, the second switch unit 410-2C includes a first switch part 411-2C, a first magnet piece 421-2C and a second switch part 422-2C aligned in order from the X2-side to the X1-side and covered with a mold cover 428-2C. The first switch part 411-1C is supported on an insert mold base 431. A terminal part 426-2C for mounting purpose protrudes from the X2-side end of the first switch part 411-2C to the Y2-side and is bent in the Z1-direction and further in the Y1-direction so as to be exposed on the Z2-side surface, which is a back surface of the insert mold base 431. Another terminal part 427-2C for mounting purpose protrudes from the X1-side end of the first switch part 411-2C to the Y1-side and is bent in the Z1-direction and further in the Y1-direction so as to be exposed on the Z2-side surface, which is a back surface of the insert mold base 431.

In the present embodiment, since the terminal part 411-2C is protruded from the side surface of the insert mold base 431 and is exposed on the back surface side, the sizes of the first and second magnet pieces 421-2C and 422-2C are not limited by the terminal part 427-2C. Therefore, the first and second magnet pieces 421-2C and 422-2C have dimensions z10 that is greater than the dimension z2 and a dimension x10 that is greater than the dimension x2 and thus have sizes greater than the magnet piece 421-1B.

As shown in FIG. 35A, the first switch unit 410-1C is incorporated in a battery pack 500C and is connected to the battery 501 and terminals 502, 303. The second switch unit 410-2C is incorporated in the electronic device main body 510C and is, for example, connected to components such as a liquid crystal device 511 and to terminals 513, 514.

The following description relates to a case where an appropriate battery pack 500C is loaded in the electronic device main body 510C and a case where an inappropriate battery pack is loaded in the electronic device main body 510C.

(1) Case where an appropriate battery pack 500C is loaded in the electronic device main body 510C:

As shown in FIG. 35B, the first magnet piece 421-1C of the first switch unit 410-1C opposes the second switch part 411-2C of the second switch unit 410-2C and the second switch part 411-2C is closed. The first and second switch parts 411-1C, 412-1C of the first switch unit 410-1C oppose the first and second magnet pieces 421-2C, 422-2C of the second switch unit 410-2C, respectively, and the first and second switch parts 411-1C, 412-1C are closed.

Thus, the battery pack 500C, after recognition of the loaded electronic device being an appropriate electronic device main body 510C, applies a voltage between the terminals 502 and 503. Regarding the electronic device main body 510C, after recognition of the loaded battery pack being a normal battery pack 500C, a circuit is formed between the liquid crystal device 511 and the terminal 513. Thus the electronic device main body 510C is switched to an operable state.

In this embodiment, since the size of the first magnet 421-1C is increased, the first switch part 411-2C is closed with an improved reliability compared to the above-described third embodiment in which the first magnet piece 421-1B opposes. Also, since the sizes of the first and second magnet pieces 421-2C and 422-2C are greater, the first and second switch parts 411-1C and 412-1C are closed with an improved reliability compared to the above-described third embodiment in which the first and second magnet pieces 421-1B and 422-2B oppose.

(2) Case where an inappropriate battery pack is loaded in the electronic device main body 510C:

The inappropriate battery pack is loaded in the electronic device main body 510C in a manner similar to the normal battery pack 500C, and a voltage is applied between the terminals 513 and 514. However, the switch part 411-2CA is not closed and remains in an OFF state. A circuit is not formed between the liquid crystal device 511 and the terminal 513. Accordingly, the electronic device main body 510C blocks a voltage supply from the inappropriate battery pack.

Figure 38A:
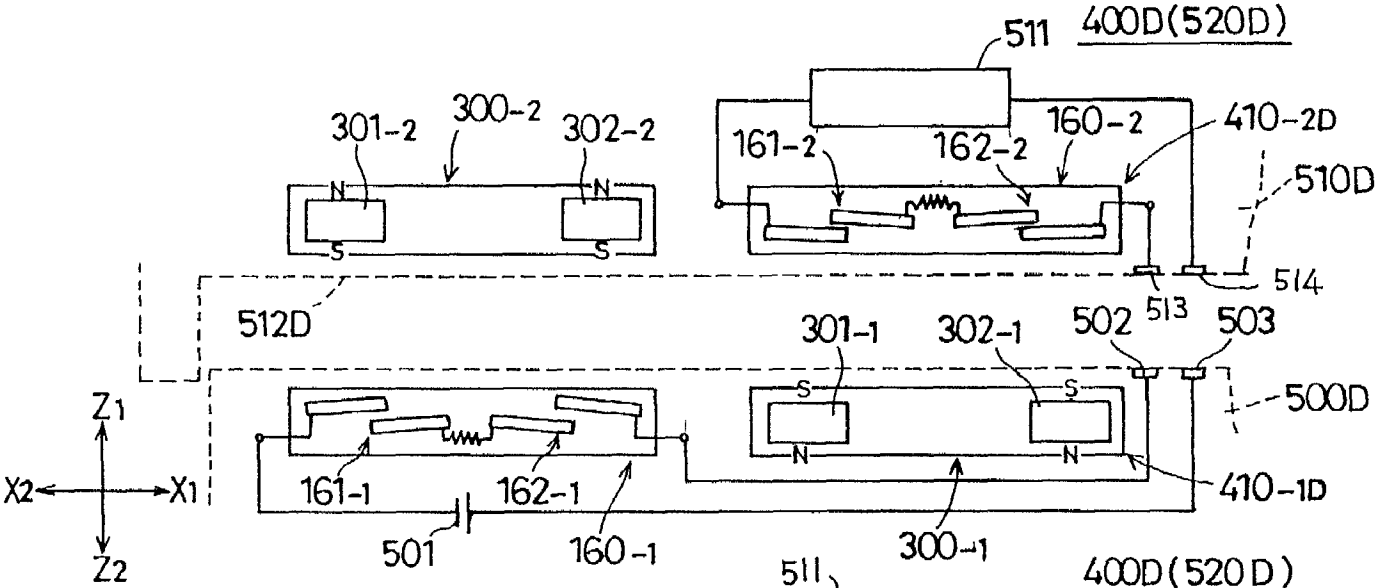
FIGS. 38A and 38B are diagrams showing a fifth embodiment of a switch device of the present invention.
Figure 38B:
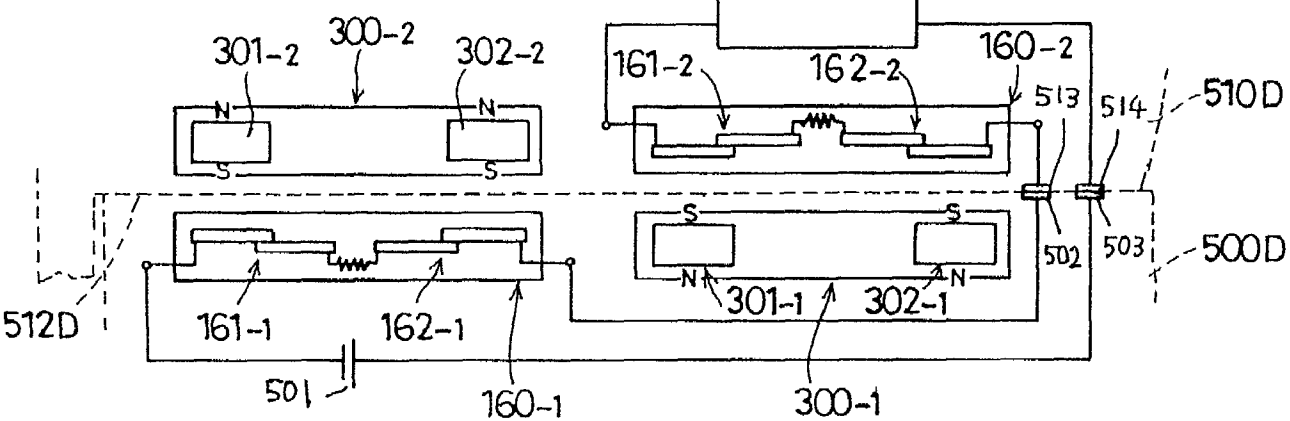

FIGS. 38A and 38B are diagrams showing a fifth embodiment of a switch device 400D of the present invention. An electronic device 520D includes an electronic device main body 510D and a battery pack 500D.

The switch device 400D includes the first switch unit 410-1D and the second switch unit 410-2D. The first switch unit 410-1D includes the switch 160-1 and the external magnetic field generating unit 300-1. The second switch unit 410-2D includes the switch 160-2 and the external magnetic field generating unit 300-2.

The switches 160-1 and 160-2 have structures shown in FIGS. 17 and 18. The external magnetic field generating units 300-1 and 300-2 have structures shown in FIG. 28. Therefore, detailed explanation is omitted.

As shown in FIGS. 38A and 38B, the switch 160-1 and the external magnetic field generating unit 300-1 are incorporated in the battery pack 500D such that they align along the X1-X2 axis and the switch 160-2 and the external magnetic field generating unit 300-2 are incorporated in the battery pack 510D such that they align along the X1-X2 axis. When the battery pack 500D is loaded in the electronic device main body 510D, the switch 160-1 opposes the external magnetic field generating unit 300-2 and external magnetic field generating unit 300-1 opposes the switch 160-2. The switch 160-1 is connected to the battery 501 and the terminals 502, 503. The switch 160-2 is, for example, connected to the liquid crystal device 511 and the terminals 513 and 514.

The following description relates to a case where an appropriate battery pack 500D is loaded in the electronic device main body 510D and a case where an inappropriate battery pack is loaded in the electronic device main body 510D.

(1) Case where an appropriate battery pack 500D is loaded in the electronic device main body 510D:

As shown in FIG. 38B, the first and second switch parts 161-1 and 162-1 of the switch 160-1 oppose the first and second magnets 301-2 and 302-2 of the external magnetic field generating unit 300-2, respectively, and are closed. Also, the first and second magnets 301-1 and 302-1 of the external magnetic field generating unit 300-1 oppose the first and second switch parts 161-2 and 162-2 of the switch 160-2, respectively, and the first and second switch parts 161-2 and 162-2 are closed.

Thus, for the battery pack 500D, after recognition of the loaded electronic device being an appropriate electronic device main body 510D, applies a voltage between the terminals 502 and 503. Regarding the electronic device main body 510D, after recognition of the loaded battery pack being a normal battery pack 500D, a circuit is formed between the liquid crystal device 511 and the terminal 513. Thus the electronic device main body 510D is switched to an operable state.

(2) Case where an inappropriate battery pack is loaded in the electronic device main body 510D:

The inappropriate battery pack is loaded in the electronic device main body 510D in a manner similar to the normal battery pack 500D, and a voltage is applied between the terminals 513 and 514. However, the first and second switch parts 161-2 and 162-2 in the switch 160-2 are not closed and remain in an OFF state. A circuit is not formed between the liquid crystal device 511 and the terminal 513. Accordingly, the electronic device main body 510D blocks a voltage supply from the inappropriate battery pack.

Further, the present invention is not limited to these embodiments, and variations and modifications may be made without departing from the scope of the present invention.

The present application is based on Japanese priority applications No. 2001-070765 filed on Mar. 13, 2001, No. 2001-223082 filed on Jul. 24, 2001, and No. 2001-344703 filed on Nov. 9, 2001, the entire contents of which are hereby incorporated by reference.

What is claimed is:

1. A switch operable under a predetermined condition comprising;

an electrically insulative base having an elongated shape;

a plurality of switch parts each including a pair of first and second reed pieces; said first reed piece being fixed and having a terminal part at one end thereof, protruding from an end part of said electrically insulative base, and a contact part at the other end of said first reed piece, and said second reed piece having a flexible reed part at one end thereof, opposing said contact part of the first reed piece via a gap;

a cover provided on said electrically insulative base and covering said first and second reed pieces of each of said switch parts; and a connecting member of an electrically conductive non-magnetic material via which said plurality of switch parts are serially connected, wherein:

without external magnetic fields being applied, said first and second reed pieces of each pair are in an open state, and said switch operates only under a condition where all of said plurality of switch parts are operated by external magnetic fields individually and simultaneously acting on said plurality of switch parts.

2. The switch as claimed in claim 1, wherein said plurality of switch parts includes pole pieces provided on said reed pieces, said pole pieces determining positions where magnetic flux enters and leaves said reed pieces.

3. A switch operable under a predetermined condition comprising:

first and second switch parts, each including a pair of first and second reed pieces, said first reed piece being fixed and having a terminal part at one end thereof, protruding from an end part of said electrically insulative base, and a contact part at the other end of said first reed piece, and said second reed piece having a flexible reed part at one end thereof, opposing said contact part of the first reed piece via a gap;

a cover provided on said electrically insulative base and covering said first and second reed pieces of each said switch parts; and a connecting member of an electrically conductive non-magnetic material via which said first and second switch parts are serially connected; and terminal members provided at both ends of said switch, wherein:

without external magnetic fields being applied, said first and second reed pieces of each pair are in an open state, said switch operates only under a condition where said first and second switch parts are operated by predetermined external magnetic fields individually and simultaneously acting on each of said first and second switch parts, and said connecting member and said terminal members have different thicknesses and are embedded in a mold base main body, base parts of said reed pieces being attached to said connecting member and said terminal members.

4. The switch as claimed in claim 3, wherein said connecting member and said terminal members are made from different parts with different thicknesses that are parts of a plate member that is insert-molded in said mold base main body.

5. A switch operable under a predetermined condition comprising:

an electrically insulative base having an elongated shape;

a first and a second switch part, each said switch part including a pair of first and second reed pieces, said first reed piece being fixed and having a terminal part at one end thereof, protruding from an end part of said electrically insulative base, and a contact part at the other end of said first reed piece, and said second reed piece having a flexible reed part at one end thereof, opposing said contact part of the first reed piece via a gap;

a cover provided on said electrically insulative base and covering said first and second reed pieces of each of said switch parts; and a connecting member of an electrically conductive non-magnetic material via which said first and second switch parts are serially connected; and terminal members provided at both ends of said switch, wherein:

without external magnetic fields being applied, said first and second reed pieces of each pair are in an open state, said switch operates only under a condition where said first and second switch parts are operated by predetermined external magnetic fields individually and simultaneously acting on each of said first and second switch parts, and said switch further comprising a switch assembly including said first and second switch parts and a cover that covers the switch assembly having said first and second switch parts, said cover having a top plate part of a predetermined thickness.

6. The switch as claimed in claim 5, wherein said first and second switch parts are offset in a direction perpendicular to a longitudinal direction of said first and second switch parts.

7. An external magnetic field generating assembly for applying a magnetic field to each of a plurality of switch parts of a switch in which first and second switch parts each including a pair of first and second reed pieces are serially connected via a connecting member made of an electrically conductive non-magnetic material, said switch comprising an electrically insulative base having an elongated shape, said first reed piece being fixed and having a terminal part at one end thereof, protruding from an end part of said eletrically insulative base, and a contact part at the other end of said first reed piece, and said second reed piece having a flexible reed part at one end thereof, opposing said contact part of the first reed piece via a gap, a cover provided on said electrically insulative base and covering said first and second reed pieces of each of said switch parts, wherein without external magnetic fields being applied, said first and second reed pieces of each pair are in an open state, and said external magnetic field generating assembly comprising:

a first magnet generating a magnetic field applied to said first switch part; and a second magnet generating a magnetic field applied to said second switch part, wherein orientations of magnetic poles of said first and second magnets are aligned in a direction perpendicular to a longitudinal direction of said reed pieces.

8. A combination comprising:

a switch operable under a predetermined condition, said switch including an electrically insulative base having an elongated shape and a plurality of reed switch parts each including a pair of first and second reed pieces, said first reed piece being fixed and having a terminal part at least one thereof, protruding from an end part of said electrically insulative base, and a contact part at the other end of said first reed piece, and said second reed piece having a flexible reed part at one end thereof, opposing said contact part of the first reed piece via a gap, a cover provided on said electrically insulative base and covering said first and second reed pieces of each of said switch parts, and at least one connecting member of an electrically conductive non-magnetic material via which said plurality of reed switch parts are serially connected, wherein without external magnetic fields being applied, said first and second reed pieces of each pair are in an open state; and an external magnetic field generating assembly generating magnetic fields meeting said predetermined conditions for operating said switch.

* * * * *

UNITED STATES PATENT AND TRADEMARK OFFICE

CERTIFICATE OF CORRECTION

PATENT NO. : 6,972,651 B2
APPLICATION NO. : 10/087849
DATED : December 6, 2005
INVENTOR(S) : Shigemitsu Aoki et al.

It is certified that error appears in the above-identified patent and that said Letters Patent is hereby corrected as shown below:

Column 28, line 37, after “condition”, please insert --,--.

Column 28, line 38, after “comprising” change “;” to --:--.

Column 28, line 41, after “pieces” change “;” to --,--.

Column 29, line 10, after “each” insert --of--.

Column 30, line 1, change “comprising” to --comprises--.

Column 30, line 18, change “eletrically” to --electrically--.

Column 3, line 34, after “combination” insert --,--.

Column 30, line 40, after “at” delete “least”

Column 30, line 40, after “one” insert --end--.

Signed and Sealed this

Eleventh Day of July, 2006

JON W. DUDAS
*Director of the United States Patent and Trademark Office*